US008958719B2

(12) United States Patent
Kuwabara et al.

(10) Patent No.: US 8,958,719 B2
(45) Date of Patent: Feb. 17, 2015

(54) IMAGE FORMING APPARATUS HAVING REPLACEABLE MODULES

(75) Inventors: Nobuo Kuwabara, Kanagawa (JP); Shinichi Kawahara, Tokyo (JP); Akio Kosuge, Kanagawa (JP); Daisuke Tomita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 478 days.

(21) Appl. No.: 13/355,730

(22) Filed: Jan. 23, 2012

(65) Prior Publication Data

US 2012/0195664 A1 Aug. 2, 2012

(30) Foreign Application Priority Data

Feb. 1, 2011 (JP) ..... 2011-019708

(51) Int. Cl.
*G03G 21/18* (2006.01)
*G03G 15/02* (2006.01)
(Continued)

(52) U.S. Cl.
CPC ..... *G03G 21/169* (2013.01); *G03G 21/1671* (2013.01); *G03G 21/1817* (2013.01); *G03G 21/1821* (2013.01); *G03G 21/185* (2013.01); *G03G 2221/1684* (2013.01)
USPC ..... 399/111; 399/113; 399/116; 399/117

(58) Field of Classification Search
CPC ..... G03G 2221/1654; G03G 21/1828
USPC ..... 399/111, 113, 116, 117
See application file for complete search history.

(56) References Cited

U.S. PATENT DOCUMENTS 5,878,304 A * 3/1999 Watanabe et al. ..... 399/92
5,926,666 A 7/1999 Miura et al.
5,937,240 A 8/1999 Kanno et al.
(Continued)

FOREIGN PATENT DOCUMENTS

CN 1119288 A 3/1996
CN 1175713 A 3/1998
(Continued)

OTHER PUBLICATIONS

Chinese Office Action and English translation thereof dated Mar. 28, 2014.
(Continued)

*Primary Examiner* — David Gray
*Assistant Examiner* — Andrew V Do
(74) *Attorney, Agent, or Firm* — Harness, Dickey & Pierce, P.L.C.

(57) ABSTRACT

When the acute angle between a normal line, oriented outward from a blade abutting portion of a photosensitive member over which a cleaning blade remains abutted before separation of the surface of the photosensitive member from the cleaning blade, and a horizontal plane, passing through the origin of the normal line, is expressed as a positive value when the normal line lies above the horizontal plane and expressed as a negative value when the normal line lies below the horizontal plane; an imaging unit frame so supports a photosensitive module that the photosensitive member can rotate to a specific rotational position having a greater angle than the angle at the time of separation of the surface of the photosensitive member from the cleaning blade. Until the photosensitive member rotates from a normal rotational position to the specific rotational position, the photosensitive module cannot be removed from the imaging unit frame.

7 Claims, 32 Drawing Sheets

(51) Int. Cl.

| | |
|---|---|
| ***G03G 15/00*** | (2006.01) |
| ***G03G 21/16*** | (2006.01) |

(56) References Cited

U.S. PATENT DOCUMENTS

| | | | |
|---|---|---|---|
| 7,483,648 | B2 | 1/2009 | Hosokawa et al. |
| 7,680,446 | B2 | 3/2010 | Shintani et al. |
| 7,844,198 | B2 | 11/2010 | Kuwabara et al. |
| 7,894,758 | B2 | 2/2011 | Shintani et al. |
| 2005/0084290 | A1 | 4/2005 | Baek et al. |
| 2006/0018680 | A1 | 1/2006 | Hosokawa et al. |
| 2008/0069614 | A1 | 3/2008 | Shintani et al. |
| 2008/0069615 | A1 | 3/2008 | Shintani et al. |
| 2009/0180801 | A1 | 7/2009 | Kuwabara et al. |
| 2010/0034557 | A1 | 2/2010 | Arai et al. |
| 2010/0183349 | A1 | 7/2010 | Shintani et al. |
| 2010/0189461 | A1 | 7/2010 | Shintani et al. |
| 2011/0026992 | A1 | 2/2011 | Shintani et al. |

FOREIGN PATENT DOCUMENTS

| | | |
|---|---|---|
| JP | 2659717 B2 | 2/1989 |
| JP | 02248963 | 4/1990 |

OTHER PUBLICATIONS

English language abstract for JP-64-038760 which corresponds to JP-2659717.

* cited by examiner

IMAGE FORMING APPARATUS HAVING REPLACEABLE MODULES

CROSS-REFERENCE TO RELATED APPLICATIONS

The present application claims priority to and incorporates by reference the entire contents of Japanese Patent Application No. 2011-019708 filed in Japan on Feb. 1, 2011. The present document incorporates by reference the entire contents of Japanese Patent Application No. 2010-060832 filed in Japan on Mar. 17, 2010.

BACKGROUND OF THE INVENTION

1. Field of the Invention

The present invention relates to an image forming apparatus such as a copying machine, a printer, or a facsimileing machine; and specifically relates to an image forming apparatus in which image formation is performed by forming a toner image on the surface of a latent image carrier and then by transferring the toner image from the latent image carrier onto a transfer member.

2. Description of the Related Art

Among such image forming apparatuses, some apparatuses are known to include a process cartridge (an imaging unit) having a single frame that integrally supports at least two replacement modules from among a latent image carrier module having a latent image carrier such as a photosensitive member, a cleaning module having a cleaning device for cleaning the surface of the latent image carrier, and a developing module having a developing device for performing a developing operation with respect to the surface of the latent image carrier. In particular, in an image forming apparatus disclosed in Japanese Patent Application Laid-open No. H1-038760, the latent image carrier module, the cleaning module, and the developing module that are supported by an imaging unit are configured to be individually-replaceable replacement modules. In the image forming apparatus disclosed in Japanese Patent Application Laid-open No. H1-038760, the imaging unit is supported in a slidable manner in the direction of the rotary shaft of the latent image carrier between the installation position of the imaging unit inside the main body of the image forming apparatus and the exposure position at which the imaging unit is exposed to the outside of the image forming apparatus. In this image forming apparatus, the imaging unit is slid and pulled out up to the exposure position on the outside of the image forming apparatus, and can be retained in that condition. Then, while the imaging unit is held in that condition, the replacement modules can be replaced.

As is the case of the image forming apparatus disclosed in Japanese Patent Application Laid-open No. H1-038760, when a latent image carrier module and a cleaning module are detachably attachable with respect to the imaging unit, following issues arise.

When the cleaning module is removed from the imaging unit, the surface of the latent image carrier separates from the cleaning member. At the time of separation, the transfer residual toner that was accumulated at the abutting portion of the cleaning member remains attached on that portion on the surface of the latent image carrier against which the cleaning member was abutting (i.e., on a cleaning-module-facing surface portion). Besides, in an image forming apparatus including a mechanism for supplying a lubricant agent to the surface of the latent image carrier, the lubricant agent also remains attached along with the transfer residual toner. Due to the physical impact at the time of removing the latent image carrier, the attached material such as the transfer residual toner or the lubricant agent that remains attached to the cleaning-module-facing surface portion on the surface of the latent image carrier spills out from the surface of the latent image carrier, and gets attached to the clothes of the operator or falls down on the floor thereby making it dirty.

Therefore, there is a need for an image forming apparatus in which the attached material that remains attached to the cleaning-module-facing surface portion on the surface of the latent image carrier is prevented from spilling out from the surface of the latent image carrier.

SUMMARY OF THE INVENTION

It is an object of the present invention to at least partially solve the problems in the conventional technology.

According to an embodiment, there is provided an image forming apparatus in which image formation is performed by forming a toner image on a surface of a latent image carrier of rotatory nature and then by transferring the toner image from the latent image carrier onto a transfer member, and in which a residual transfer toner that remains on the surface of the latent image carrier after the toner image has been transferred is removed by a cleaning member abutting against the surface of the latent image carrier. The image forming apparatus includes an imaging unit that includes a common imaging unit frame for integrally supporting a latent image carrier module, which has the latent image carrier, and a cleaning module, which has the cleaning member, as independently-replaceable replacement modules; and an imaging unit supporting member that supports the imaging unit in a movable manner between an installation position of the imaging unit inside a main body of the image forming apparatus and an exposure position at which the imaging unit is exposed to the outside of the image forming apparatus. When an acute angle between a normal line, which is oriented outward from a cleaning-module-facing surface portion of the latent image carrier over which the cleaning member remains abutted before separation of the surface of the latent image carrier from the cleaning member, and a horizontal plane, which passes through the origin of the normal line, is expressed as a positive value when the normal line lies on the upper side of the horizontal plane and expressed as a negative value when the normal line lies on the lower side of the horizontal plane, the imaging unit frame supports the latent image carrier module in such a way that the latent image carrier is able to rotate to a specific rotational position having an angle greater than the angle at the time of the separation of the surface of the latent image carrier from the cleaning member. Until the latent image carrier rotates from a normal rotational position at the time of the separation to the specific rotational position, removal of the latent image carrier module from the imaging unit frame is restricted, and once the latent image carrier rotates up to the specific rotational position, removal of the latent image carrier module from the imaging unit frame is allowed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of an image forming apparatus according to the present invention is described in detail below with reference to the accompanying drawings. The present invention is not limited to these exemplary embodiments.

Firstly, the explanation is given regarding a configuration and operations of the image forming apparatus according to the present embodiment.

Figure 1:
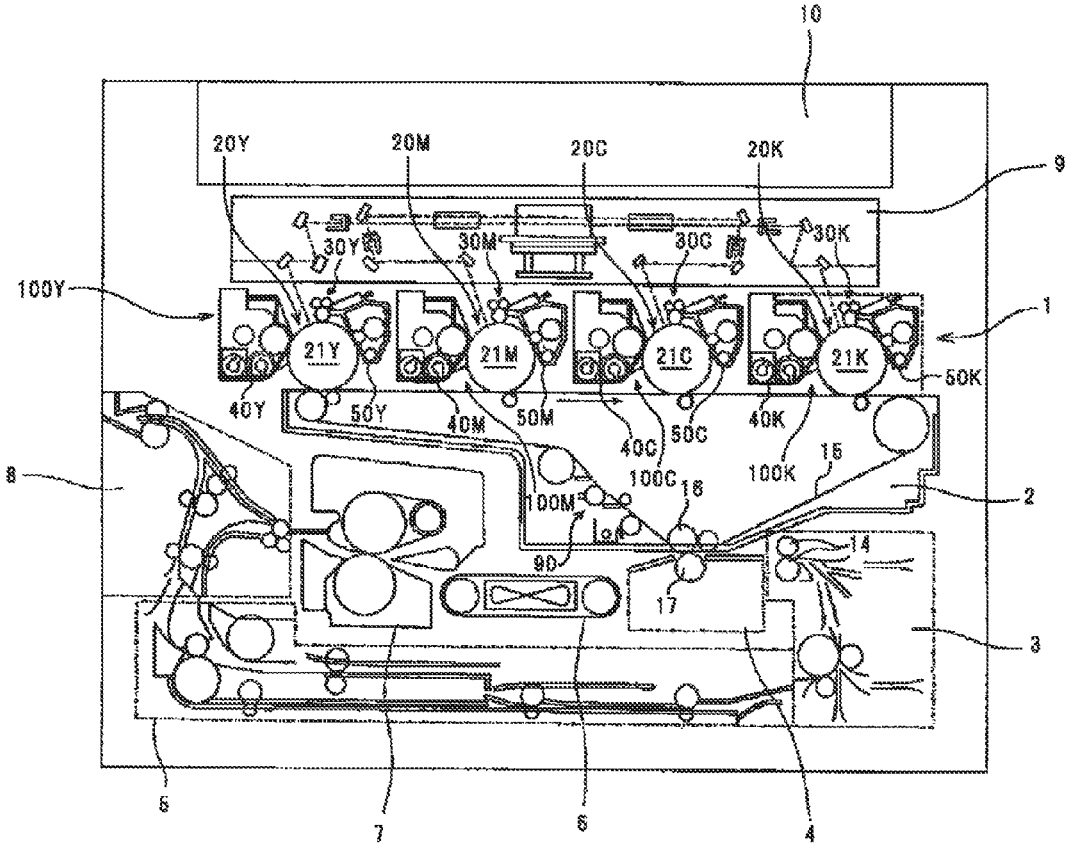
FIG. 1 is an overall configuration diagram of an image forming apparatus according to an embodiment of the present invention.

FIG. 1 is an overall configuration diagram of the image forming apparatus according to the present embodiment.

The image forming apparatus includes an image forming unit 1 in which four imaging units 100Y, 100M, 100C, and 100K are arranged in parallel to each other. In the imaging units 100Y, 100M, 100C, and 100K, respectively; common imaging unit frames are disposed for supporting the following modules: photosensitive modules 20Y, 20M, 20C, and 20K that are latent image carrier modules and that include drum-like photosensitive members 21Y, 21M, 21C, and 21K functioning as latent image carriers; charging modules 30Y, 30M, 30C, and 30K that function as charging devices; developing devices 40Y, 40M, 40C, and 40K that implement the two-component developing method; and cleaning modules 50Y, 50M, 50C, and 50K that include drum cleaning devices. Each of the imaging units 100Y, 100M, 100C, and 100K is detachably attachable in an independent manner with respect to the main body of the image forming apparatus.

Moreover, in the present embodiment, the photosensitive modules 20Y, 20M, 20C, and 20K; the charging modules 30Y, 30M, 30C, and 30K; and the cleaning modules 50Y, 50M, 50C, and 50K are configured as replacement modules. In contrast, the developing devices 40Y, 40M, 40C, and 40K are configured not as replacement modules. However, the developing devices 40Y, 40M, 40C, and 40K can also be configured as replacement modules.

On the upper side of the image forming unit 1 is disposed an exposing unit 9 that functions as a latent image forming unit. In the upper portion of the image forming apparatus is disposed a reading device 10 that reads, by means of scanning, an original placed on a platen. On the lower side of the image forming unit 1 is disposed a transfer unit 2 that includes an intermediate transfer belt 15 functioning as an intermediate transfer member that is a transfer target member. The intermediate transfer belt 15 is wound around a plurality of at the time of supporting rollers, and performs endless movement in the clockwise direction with reference to FIG. 1. On the lower side of the transfer unit 2 is disposed a secondary transfer device 4 that includes a secondary transfer roller 17, which forms a secondary transfer nip by abutting against the front face of the intermediate transfer belt 15 at a position at which the intermediate transfer belt 15 is rotated by a transfer-belt facing roller 16. To the secondary transfer roller 17 is applied a secondary transfer bias from a power supply (not illustrated). Moreover, the transfer-belt facing roller 16 is electrically-grounded. That results in the formation of a secondary transfer electric field in the secondary transfer nip. On the left side of the secondary transfer device 4 illustrated in FIG. 1, a fixing unit 7 that includes a heating roller with an internal heating element is disposed for the purpose of fixing a toner image transferred onto a paper sheet. Between the secondary transfer device 4 and the fixing unit 7 is disposed a carrying belt 6 for carrying the paper sheet that has the toner image transferred thereon to the fixing unit 7. In the lower side of the image forming apparatus, a paper feeding unit 3 is disposed for feeding, to the secondary transfer device 4, the paper sheets that are separated and fed one by one from a paper housing unit (not illustrated). Meanwhile, a paper discharging unit 8 is disposed for discharging the paper sheet that has passed the fixing unit 7 to the outside of the image forming apparatus or to a duplexing unit 5.

During a copying operation performed by the image forming apparatus, the reading device 10 reads an original. While the original is being read, the intermediate transfer belt 15 moves in the clockwise direction with reference to FIG. 1. At the same time, in the image forming unit 1, the exposing unit 9 refers to color information of yellow, magenta, cyan, and black colors based on the contents of the original that is read and accordingly exposes the surfaces of the photosensitive members 21Y, 21M, 21C, and 21K that are uniformly charged to a predetermined charge potential by the charging devices of the charging modules 30Y, 30M, 30C, and 30K, respectively. As a result, latent images are formed on the surfaces of the photosensitive members 21Y, 21M, 21C, and 21K. Then, the developing devices 40Y, 40M, 40C, and 40K develop the latent images formed on the photosensitive members 21Y, 21M, 21C, and 21K, respectively. As a result, single-color toner images are formed on the photosensitive members 21Y, 21M, 21C, and 21K. Subsequently, the single-color toner images are sequentially transferred onto the intermediate transfer belt 15 in a mutually overlapping manner. That results in the formation of a composite toner image on the intermediate transfer belt 15.

Once the toner images are transferred, the cleaning devices of the cleaning modules 50Y, 50M, 50C, and 50K remove the residual toner remaining on the photosensitive members 21Y, 21M, 21C, and 21K, respectively. With that, the photosensitive members 21Y, 21M, 21C, and 21K get ready for the subsequent image forming operation.

While the toner image formation is underway, paper sheets come out one by one from the paper housing unit (not illustrated) and stop by abutting against a pair of registration rollers 14. At the timing at which the composite toner image formed on the intermediate transfer belt 15 reaches the secondary transfer nip, the pair of registration rollers 14 is rotated thereby sending the paper sheet to the secondary transfer nip. Then, the secondary transfer device 4 transfers the composite toner image on the paper sheet. Subsequently, the paper sheet having the toner image transferred thereon is carried on the carrying belt 6 and sent to the fixing unit 7. Then, the fixing unit 7 applies heat and pressure so as to fix the toner image to the paper sheet and sends the paper sheet to the paper discharging unit 8.

In the paper discharging unit 8, a switching claw switches the direction of the paper sheet either toward a paper discharging tray (not illustrated) disposed on the outside of (and on the left side of) the image forming apparatus or toward the duplexing unit 5. Herein, in the duplexing unit 5, the paper sheet is inverted and again guided to the secondary transfer nip. Then, an image is formed also on the reverse face of the paper sheet before it is discharged to the paper discharging tray by the paper discharging unit 8. Meanwhile, once an image is transferred onto a paper sheet, an intermediate-transfer-belt cleaning unit 90 removes the residual toner remaining on the intermediate transfer belt 15. With that, the intermediate transfer belt 15 gets ready for the subsequent image forming operation.

Given below is the explanation regarding the four imaging units 100Y, 100M, 100C, and 100K.

Herein, except for the difference in toner colors, the four imaging units 100Y, 100M, 100C, and 100K have a substantially identical configuration. Hence, the following explanation is given with reference to a representative imaging unit without specifying the color-specific letters Y, M, C, and K.

Figure 2:
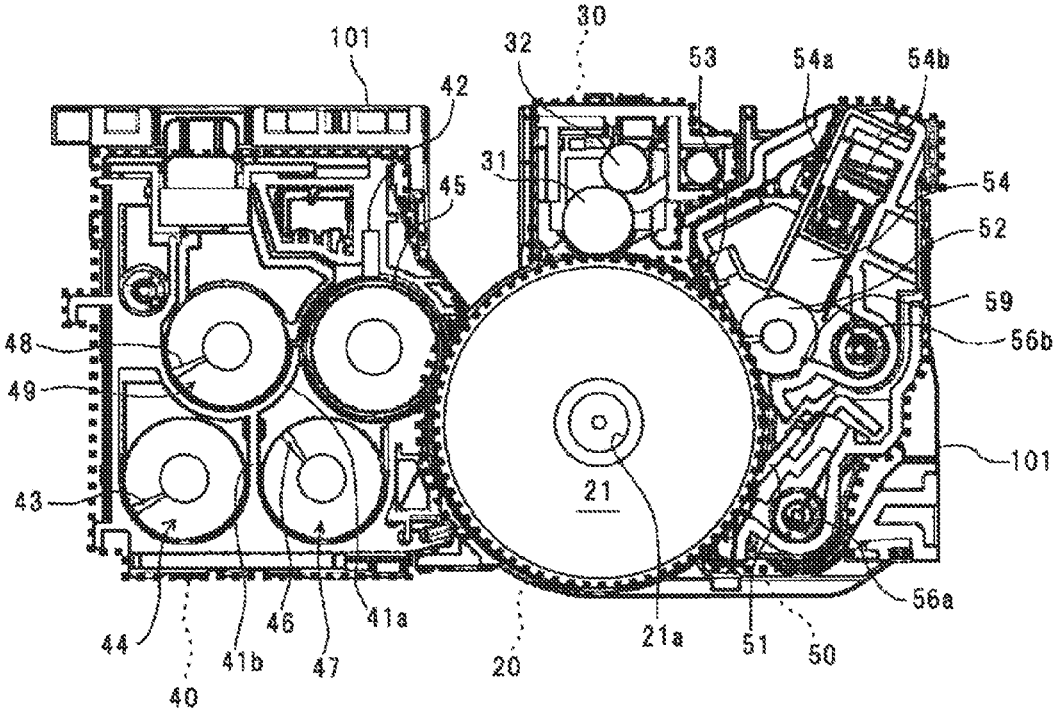
FIG. 2 is a schematic diagram of an overall configuration of a representative imaging unit of four imaging units installed in the image forming apparatus according to the embodiment.

FIG. 2 is a schematic diagram of an overall configuration of a representative imaging unit of the four imaging units 100Y, 100M, 100C, and 100K.

As illustrated in FIG. 2, while the photosensitive member 21 rotates in the counterclockwise direction with reference to FIG. 2, the surface thereof gets charged by a charging roller 31 of the charging module 30. In the present embodiment, the charging device is a contact charging/adjacent charging type of charging device that uniformly charges the surface of the photosensitive member 21. For that, the charging device includes the charging roller 31 that serves as a charging member having a charging bias applied thereto from a power source (not illustrated) and that is either placed to make contact with or placed adjacent to surface of the photosensitive member 21. However, the charging device is not limited to this particular configuration. The detailed explanation regarding the charging module 30 is given later.

On the surface of the photosensitive member 21 that has been charged, an electrostatic latent image is formed by the laser beam emitted from the exposing unit 9 (not illustrated). To the electrostatic latent image, the developing device 40 supplies a toner so as to form a toner image. The developing device 40 includes a developing roller 45 that, while performing surface movement in the clockwise direction with reference to FIG. 2, supplies a developer that is stored in a developer container to the electrostatic latent image formed on the surface of the photosensitive member 21, and develops the electrostatic latent image. The developing roller 45 includes a rotatable developing sleeve inside which is disposed a magnetic body (not illustrated) made of a plurality of magnetic poles. The magnetic body is required for retaining the developer on the surface of the developing roller 45.

Moreover, the developing device 40 includes a supplying screw serving as a supplying/carrying member that, while supplying the developer to the developing roller 45, carries the developer toward the near side with reference to FIG. 2 along the direction of axis of the developing roller 45. With respect to the portion facing a supplying screw 48 of the developing roller 45, on the downstream side in the surface movement direction is disposed a doctor blade 42 that serves as a developer regulating unit for regulating the developer, which is supplied to the developing roller 45, to have a suitable thickness. On the downstream side in the surface movement direction as compared to the developing area of the developing roller 45 positioned opposite to the photosensitive member 21, a collection path 47 lies opposite to the developing roller 45 for collecting the developer that has passed through the developing area, that has separated from the surface of the developing roller 45, and that has been used in developing. The collection path 47 has a helical collection screw 46 disposed parallel to the direction of axis of the developing roller 45. The helical collection screw 46 serves as a collection carrying member for carrying the collected developer along the direction of axis of the developing roller 45 and in the same direction as that of the supplying screw 48. A supply path 49 having the supplying screw 48 is laid in the transverse direction of the developing roller 45; and the collection path 47 having the collection screw 46 is laid beneath and in parallel to the developing roller 45.

In order to separate the developer from the developing roller 45, the magnetic body present inside the developing sleeve is set to have no magnetic pole at the portion where the developer is to be separated. That enables achieving separation of the developer. Alternatively, it is also possible to use such a magnetic body in which the magnetic pole arrangement leads to the formation of a repulsion magnetic field at the portion where the developer is to be separated.

The developing device 40 further includes an agitation path 44 laid in parallel to the collection path 47 beneath the supply path 49. The agitation path 44 has a screw-shaped agitation screw 43 that is arranged parallel to the direction of axis, that has a helical agitating blade fastened to an agitating shaft, and that serves as an agitation carrying member for carrying the developer while agitating it along the direction of axis of the developing roller 45 toward the far side with reference to FIG. 2, which is in the opposite direction to the supplying screw 48.

The supply path 49 and the agitation path 44 are partitioned by a first partition wall 41*a* serving as a partitioning member. The portion over which the first partition wall 41*a* partitions the supply path 49 and the agitation path 44 has openings on both ends at the near side and the far side with reference to FIG. 2. Through those openings, the supply path 49 and the agitation path 44 are communicated with each other. Similarly, the supply path 49 and the collection path 47 are also partitioned by the first partition wall 41*a*. However, no openings are formed at the portion over which the first partition wall 41*a* partitions the supply path 49 and the collection path 47. Meanwhile, the two developer carrying paths, namely, the agitation path 44 and the collection path 47 are partitioned by a second partition wall 41*b* serving as a partitioning member. The second partition wall 41*b* has an opening on the near side with reference to FIG. 2. Through that opening, the agitation path 44 and the collection path 47 are communicated with each other.

The supplying screw 48, the collection screw 46, and the agitation screw 43 serving as developer carrying members are made of resin or metal. During the developing operation, the developer in a thinned form is carried by the doctor blade 42, which is placed above the developing roller 45 and which is made of stainless-steel, up to the developing area facing the photosensitive member 21. The surface of the developing roller 45 is processed to have a V-groove for adjusting screw or is subjected to sandblasting, and has the developing sleeve formed with an aluminum pipe or a stainless-steel (SUS) pipe.

The developer that has been used in developing is then collected in the collection path 47 and is carried toward the near side with reference to FIG. 2. Then, the developer is transferred to the agitation path 44 at the opening of the second partition wall 41*b* placed outside the image area. Moreover, on the upstream side in the developer carrying direction of the agitation path 44 and in the vicinity of the opening formed on that second partition wall 41*b*, a toner refilling opening (not illustrated) is formed on the upper side of the agitation path 44. From the toner refilling opening is supplied a toner to the agitation path 44. Meanwhile, the developer container in the developing device 40 is formed by the wall members constituting the agitation path 44, the collection path 47, and the supply path 49.

In the supply path 49 that gets the developer supplied from the agitation path 44; while supplying the developer to the developing roller 45, the developer is carried to the downstream side in the developer carrying direction of the supplying screw 48. Then, the excess developer, which is not supplied to the developing roller 45 but which is carried up to the end on the downstream side in the developer carrying direction of the supply path 49, is supplied to the agitation path 44 via an excess opening formed on the first partition wall 41*a*. On the other hand, the developer that is supplied to the developing roller 45 is used in the developing performed at the developing area is then separated from the developing roller 45 and transferred to the collection path 47. The collected developer that is transferred to the collection path 47 from the developing roller 45 and that is carried by the collection screw 46 to the end on the downstream side in the developer carrying direction of the collection path 47 is then supplied to the agitation path 44 via a collection opening formed on the second partition wall 41*b*. Subsequently, the excess developer and the collection developer are agitated in the agitation path 44 and the agitated developer is carried to the downstream side in the developer carrying direction of the agitation screw 43 and to the upstream side in the developer carrying direction of the supplying screw 48, and is supplied to the supply path 49 via a supply opening formed on the first partition wall 41*a*.

In the agitation path 44, the agitating screw 43 carries while agitating the collected developer, the excess developer, and the toner that is supplied as necessary in a transfer unit in the opposite direction of the developer in the collection path 47 and the supply path 49. Then, the agitated developer is transferred to the upstream side in the developer carrying direction of the supply path 49, which is communicated at the downstream side in the developer carrying direction through the supply opening 91.

Thus, according to the present embodiment, the developing device 40 has the supply path 49 and the collection path 47. With that, supply and collection of the developer is performed using separate developer carrying paths. That prevents the developer which has already been used in the developing operation from getting mixed in the supply path 49. As a result, it also becomes possible to prevent a situation in which the toner concentration of the developer supplied to the developing roller 45 goes on decreasing toward the downstream side in the developer carrying direction of the supply path 49. Besides, since the developing device 40 has the collection path 47 and the agitation path 44, collection and agitation of the developer is performed using difference developer carrying paths. That prevents the developer which has already been used in the developing operation from falling out during the agitation. Hence, only the developer that has been sufficiently agitated is supplied to the supply path 49. That enables prevention of a situation in which the developer supplied to the supply path 49 is insufficiently agitated. Thus, by preventing a decrease in the toner concentration of the developer in the supply path 49 and by preventing insufficient agitation of the developer in the supply path 49, the image density during the developing operation can be maintained at a constant level.

Meanwhile, however, the developing device according to the present embodiment is not limited to the abovementioned configuration.

The toner image that is formed on the photosensitive member 21 as a result of the developing operation performed by the developing device 40 is then transferred onto the intermediate transfer belt 15. Then, the residual toner that remains on the surface of the photosensitive member 21 after the toner image has been transferred is removed by a cleaning blade 51 of the cleaning module 50. In addition to the cleaning blade 51, the cleaning module 50 according to the present embodiment also includes a lubricant agent applying brush 52 that serves as a lubricant agent supplying member for supplying, on the surface of the photosensitive member 21, a lubricant agent in the powder form, which is scraped off from a solid lubricant agent 54 manufactured by solidifying a lubricant agent containing at least boron nitride and zinc stearate. Moreover, the cleaning module 50 includes a smoothing blade 53 for smoothing off the lubricant agent supplied on the surface of the photosensitive member 21. The cleaning blade 51, the lubricant agent applying brush 52, and the smoothing blade 53 are arranged in that order from the upstream side in the surface movement direction of the photosensitive member 21. Meanwhile, the cleaning module 50 is not limited to this particular configuration. Particularly, the material of the lubricant agent is not limited to the abovementioned material. Moreover, the lubricant agent supplying member is also not limited to the abovementioned brush-like member. Alternatively, it is possible to use, for example, a sponge-like member. The detailed explanation of the cleaning module 50 is given later.

Figure 3:
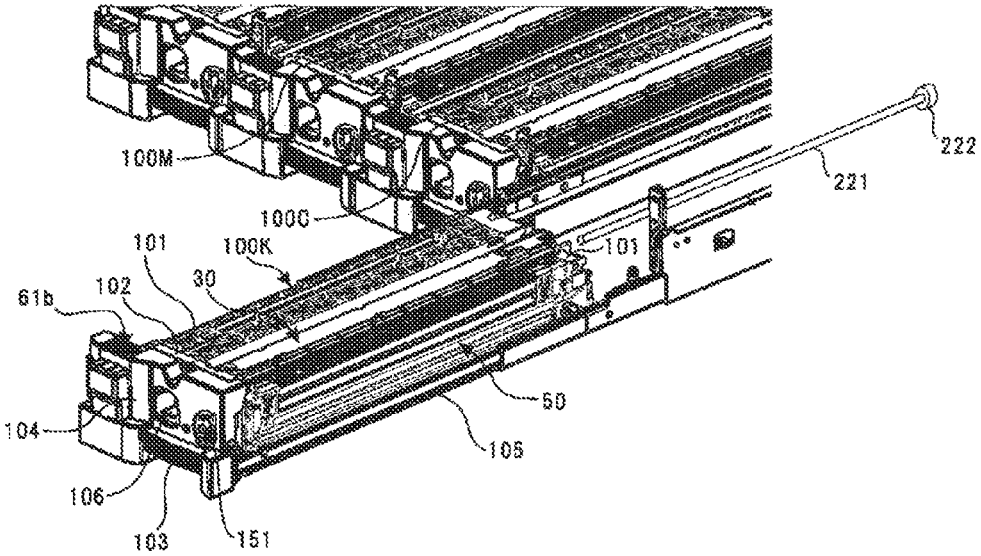
FIG. 3 is a perspective view illustrating a condition in which an imaging unit is pulled out in the horizontal direction from the image forming apparatus according to the embodiment.

FIG. 3 is a perspective view illustrating a condition in which the imaging unit 100 is pulled out in the horizontal direction from the image forming apparatus.

In the present embodiment, at the time of pulling out the imaging unit 100 horizontally from the image forming apparatus; firstly, the operator opens a door (not illustrated) that constitutes the outer wall of the image forming apparatus. The door is disposed at the position opposite to the leading end face (front face) of the imaging unit 100 that happens to be on the leading side (hereinafter, referred to as "front side") at the time of sliding the imaging unit 100 from the installation position thereof inside the image forming apparatus up to a replacement enabling position at which it becomes possible to replace the replacement modules 20, 30, and 50 that are supported by the imaging unit 100.

Upon opening the door, the operator puts the four fingers except the thumb on a handle 103 disposed on the front face of the imaging unit 100 and presses down a lock releasing lever 106 with the thumb. As a result, the imaging unit 100 is released from the locked state with respect to the main body of the image forming apparatus. That enables pulling out the imaging unit 100 toward the front side in the horizontal direction. Then, while pressing the lock releasing lever 106 with the thumb, the operator pulls the handle 103 toward the front side and pulls out the imaging unit 100 to the front side. With that, as illustrated in FIG. 3, it becomes possible to slide the imaging unit 100 up to the replacement enabling position. In the present embodiment, two slide rails 105 are disposed as imaging unit supporting members that support the imaging unit 100. The two slide rails 105 are disposed at both sides along the sliding direction in such a manner that even when the imaging unit 100 is slid to the replacement enabling position illustrated in FIG. 3, it does not fall down and is held at the replacement enabling position. Hence, according to the present embodiment, once the imaging unit 100 is pulled out to the replacement enabling position; it becomes possible to replace the replacement modules 20, 30, and 50.

In the present embodiment, in the sliding path on which the imaging unit 100 slides from the installation position to the replacement enabling position; the only obstruction is the door. However, when opened, the door gets positioned at a location away from the sliding path of the imaging unit 100. Hence, once the door is opened, the operator can pull out the imaging unit 100 without having to move any other component away from the sliding path.

In the present embodiment, a toner supply opening is formed at the end on the upstream side of the developer carrying direction of the agitation path 44 of the developing device 40. Through the toner supply opening, the toner is supplied to the developing device 40 disposed above the imaging unit 100. A refilling toner that is to be refilled through the toner supplying opening to the developing device 40 is carried via a toner path from a toner bottle (not illustrated) placed in the main body of the image forming apparatus. Thus, the toner path is divided into a toner path on the side of the imaging unit 100 (imaging-unit-side toner path) and a toner path on the side of the main body of the image forming apparatus (main-body-side toner path). When the imaging unit 100 is positioned at the installation position, the imaging-unit-side toner path and the main-body-side toner path need to be connected to each other. In that regard, if that connection point is placed on the rear side of the imaging unit 100, the main-body-side toner path is not laid on the front side. Hence, the main-body-side toner path is in no position to obstruct the sliding path of the imaging unit 100. However, in that case, there is a need to place the toner supply opening for the developing device 40 on the rear side or there is a need to lay a toner path for carrying the refilling toner to the toner supply opening on the front side. In the former case, due to the constraints on the space allotted for a driving member or a power supplying member on the rear side of the developing device 40, it becomes difficult to form the toner supply opening at a suitable position. In the latter case, from the connection point positioned on the rear side to the toner supply opening formed on the front side, the refilling toner needs to be carried via the imaging-unit-side toner path above the imaging unit 100. Hence, not only does it become necessary to reserve the space for the imaging-unit-side toner path above the imaging unit 100, it also becomes necessary to have a driving power to drive a carrying mechanism that would carry the toner in the imaging-unit-side toner path up to the toner supply opening. As a result, it becomes difficult to avoid an increase in the size and complexity of the imaging unit 100.

In that regard, in the present embodiment, the connection point of the imaging-unit-side toner path and the main-body-side toner path is positioned on the front side of the imaging unit. The specific explanation thereof is given below with reference to the accompanying drawings.

Figure 4:
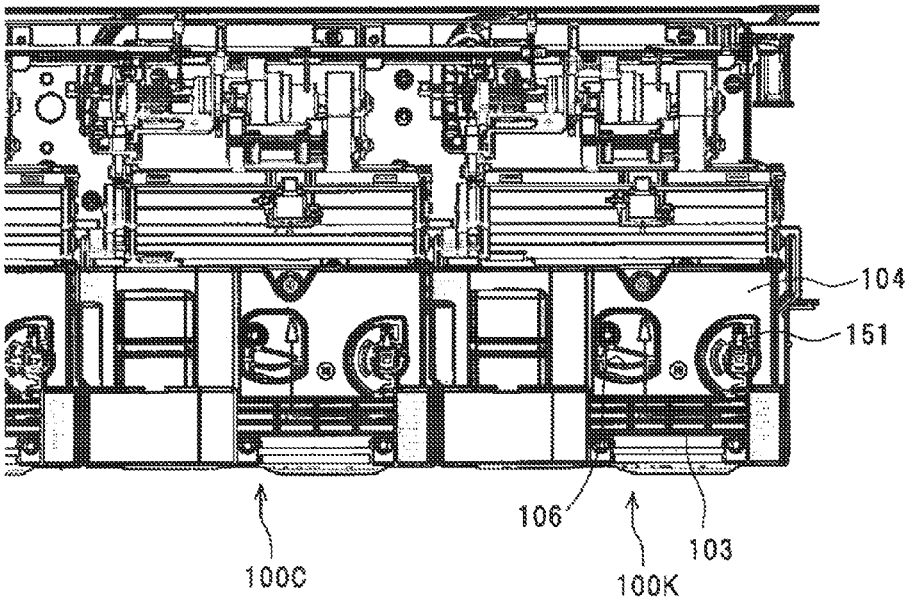
FIG. 4 is a front view of the front side of the imaging unit that is positioned at an installation position thereof.

FIG. 4 is a front view of the front side of the imaging unit 100 that is positioned at the installation position thereof.

Figure 5:
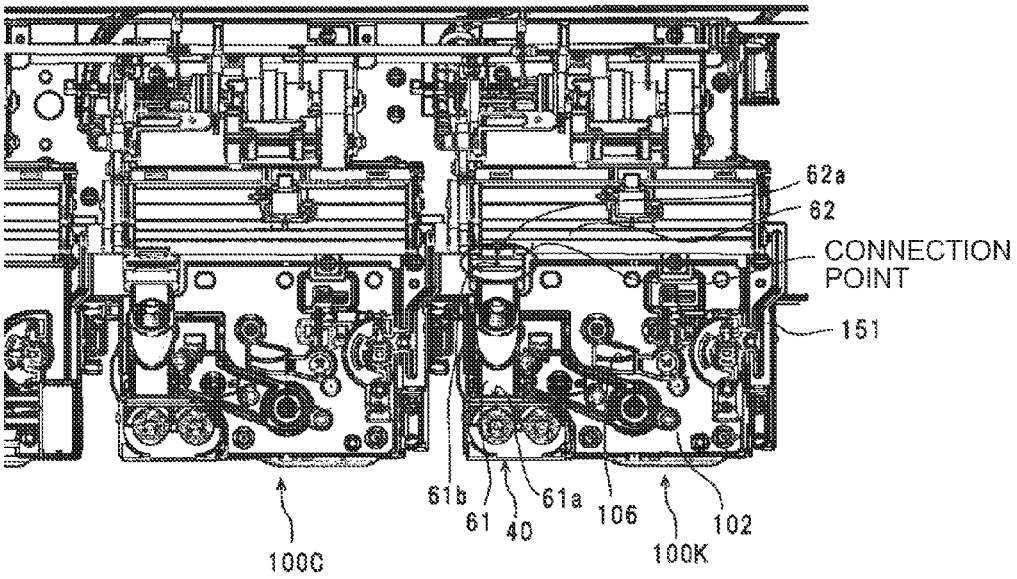
FIG. 5 is a front view illustrating a condition in which a front side cover of the imaging unit illustrated in FIG. 4 is removed.

FIG. 5 is a front view illustrating a condition in which a front side cover 104 of the imaging unit 100 illustrated in FIG. 4 is removed.

In the present embodiment, a toner supply opening 61*a* is formed on the top face at the end on the upstream side in the developer carrying direction of the agitation path 44 of the developing device 40. As illustrated in FIG. 5, the toner supply opening 61*a* is formed more on the front side as compared to an imaging unit frame 101 present on the front side. To the toner supply opening 61*a* is connected the lower end of an imaging-unit-side toner path 61 that extends in the vertical direction. At the upper end of the imaging-unit-side toner path 61 is formed a toner receiving opening 61*b* that, when the imaging unit 100 is positioned at the installation position, engages with a discharge opening 62*a* of a main-body-side toner path 62 that is laid in the main body of the image forming apparatus. In the present embodiment, the engaging point between the toner receiving opening 61*b* and the discharge opening 62*a*, that is, the connection point between the imaging-unit-side toner path 61 and the main-body-side toner path 62 is positioned away from the sliding path of the imaging unit 100. Thus, since the main-body-side toner path 62 is positioned away from the sliding path of the imaging unit 100, the sliding movement of the imaging unit 100 is not obstructed by the main-body-side toner path 62.

Figure 6:
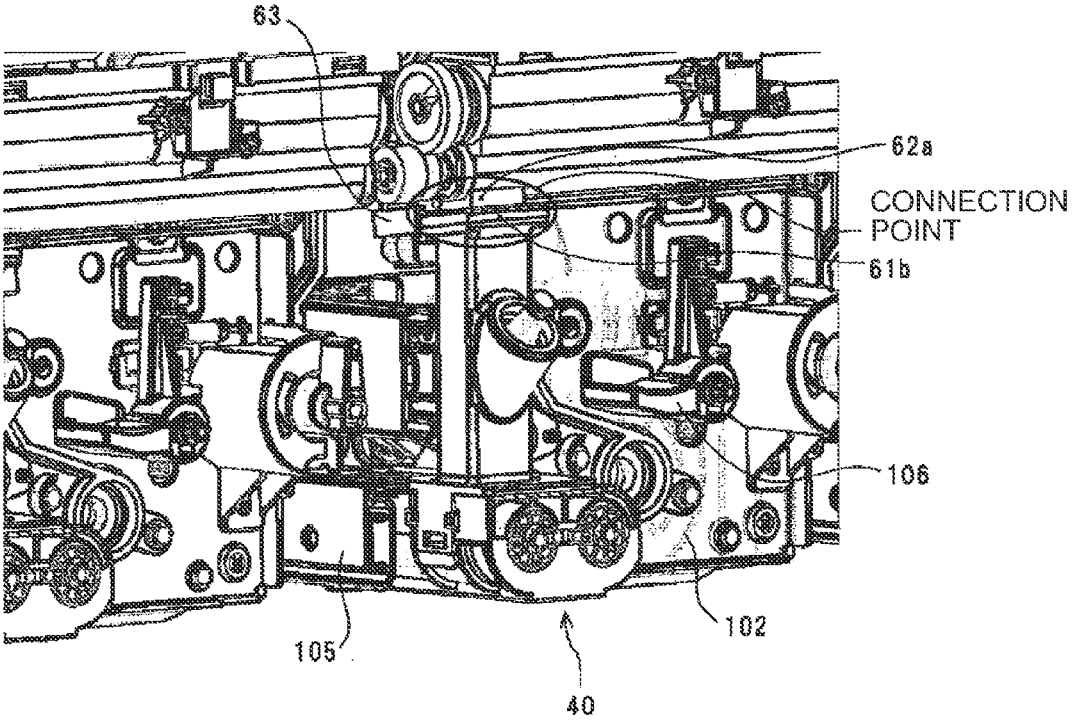
FIG. 6 is an enlarged perspective view of a connection point when the imaging unit is positioned at the installation position.

FIG. 6 is an enlarged perspective view of the connection point when the imaging unit 100 is positioned at the installation position.

Figure 7:
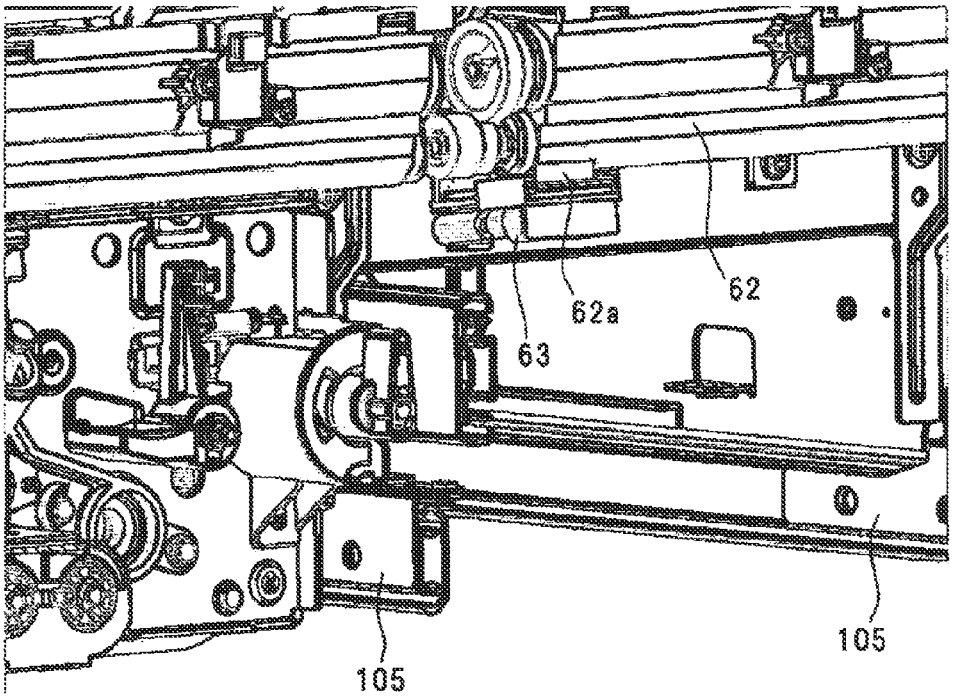
FIG. 7 is an enlarged perspective view of a connection point when the imaging unit is positioned at a replacement enabling position.

FIG. 7 is an enlarged perspective view of the connection point when the imaging unit 100 is positioned at the replacement enabling position.

In the present embodiment, the discharge opening 62*a* formed in the main-body-side toner path 62 opens in the downward direction. Therefore, when the imaging unit 100 is pulled out to the replacement enabling position thereby causing a separation between the toner receiving opening 61*b* formed in the imaging-unit-side toner path 61 and the discharge opening 62*a*, then there is a possibility that the toner drops out from the discharge opening 62*a*. In that regard, in the present embodiment, the discharge opening 62*a* is provided with a shutter 63 that opens and closes in tandem with the pulling out and pressing in of the imaging unit 100. The shutter 63 is biased toward the front side by a biasing member such as a spring (not illustrated). When the imaging unit 100 is slid toward the installation position, the toner receiving opening 61*b* of the imaging-unit-side toner path 61 abuts against the shutter 63. When the imaging unit 100 is further pressed in toward the installation position, the pressing force causes the toner receiving opening 61*b* to press the shutter 63 toward the rear side against the biasing force of the biasing member. As a result, the shutter 63 that was in the closed state to cover the discharge opening 62*a* slides toward the rear side and changes to the open state. When the imaging unit 100 is positioned at the installation position; as illustrated in FIG. 6, the toner receiving opening 61*b* in the imaging-unit-side toner path 61 engages with the discharge opening 62*a* in the main-body-side toner path 62, and the shutter 63 remains pressed (remains in the open state) by the toner receiving opening 61*b*.

On the other hand, when the imaging unit 100 is slid from the installation position toward the replacement enabling position, the pressing force that kept the shutter 63 in the open state is released. Consequently, the shutter 63 slides toward the front side due to the biasing force of the biasing member. With that, the shutter 63 changes to the closed state thereby covering the discharge opening 62*a*. That prevents the toner from dropping out from the discharge opening 62*a*.

Given below is the explanation regarding a positioning configuration of various devices mounted on the imaging unit 100.

Figure 8:
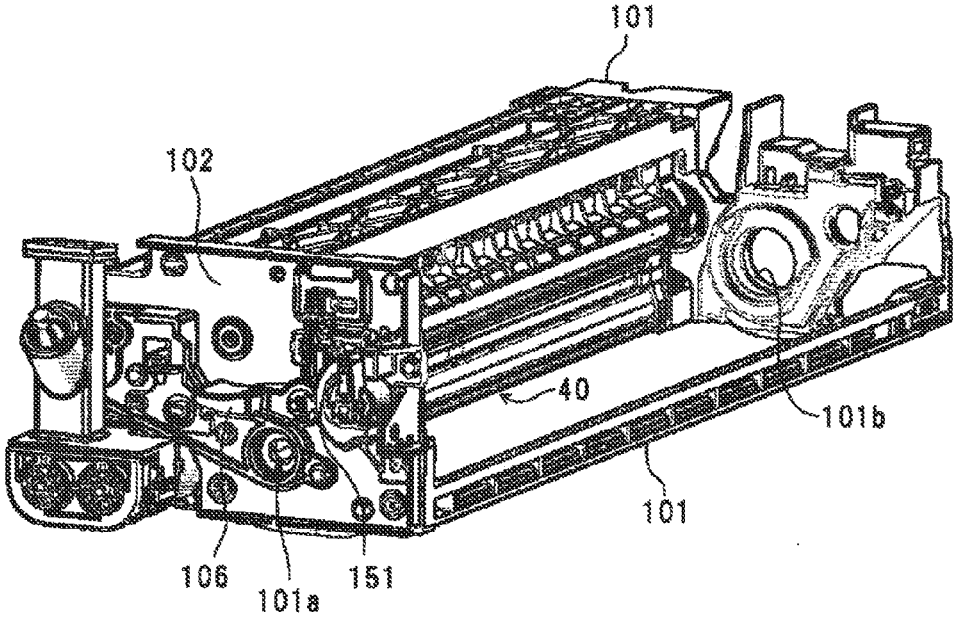
FIG. 8 is a perspective view of a condition of the imaging unit after removing all replacement modules that were mounted.

FIG. 8 is a perspective view of a condition of the imaging unit 100 after removing all of the replacement modules 20, 30, and 50.

Figure 9:
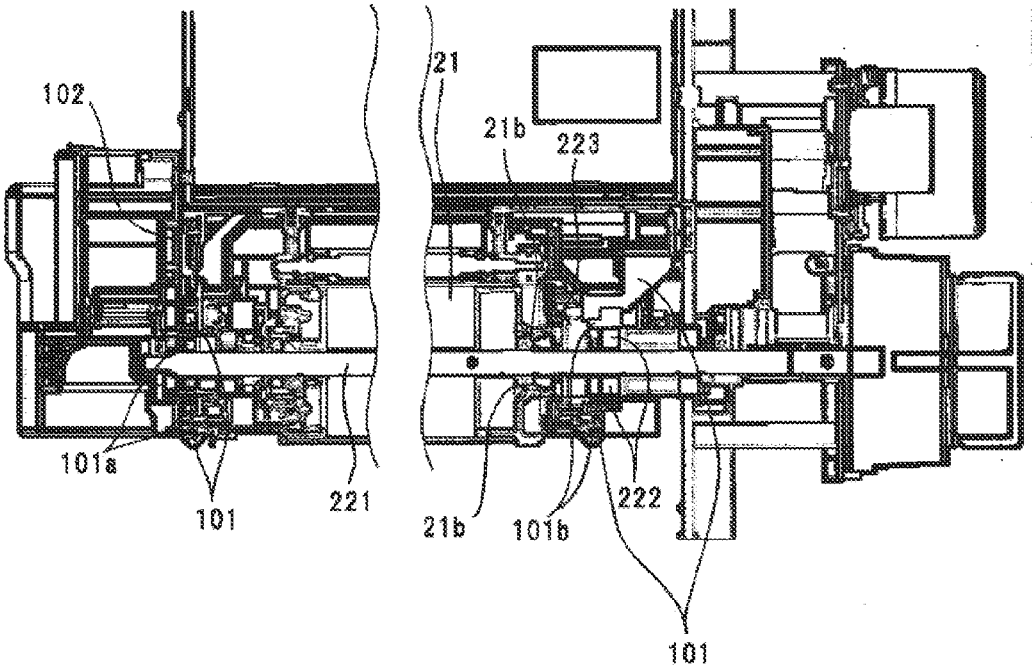
FIG. 9 is a cross-sectional view, along the axial direction of a photosensitive member, of the imaging unit positioned at the installation position.

FIG. 9 is a cross-sectional view, along the axial direction of the photosensitive member 21, of the imaging unit 100 positioned at the installation position.

In the present embodiment, the replacement modules 20, 30, and 50 and the other devices (such as the developing device 40) that are mounted on the imaging unit 100 are integrally supported by the common imaging unit frame 101. On the front side portion of the common imaging unit frame 101, a metallic front plate 102 is attached with the aim of enhancing the strength as well as the positioning accuracy regarding the front side portion of the imaging unit frame 101. As far as the rear side portion of the common imaging unit frame 101 is concerned, when the imaging unit 100 is positioned at the installation position, coupling members of various drive systems disposed on the rear side portion of the imaging unit 100 get connected with coupling target members on the main body of the image forming apparatus at a plurality of locations. That results in the enhancement of the strength as well as the positioning accuracy regarding the rear side portion of the imaging unit frame 101.

Each of the replacement modules 20, 30, and 50 mounted on the imaging unit 100 is detachably attached to the imaging unit frame 101. At the time of mounting, lock mechanisms (described later) are used for fastening and positioning the replacement modules 20, 30, and 50 with respect to the imaging unit frame 101. Since the replacement modules 20, 30, and 50 and the other devices (such as the developing device 40) that are mounted on the imaging unit 100 are positioned with respect to the common imaging unit frame 101, manufacturing the common imaging unit frame 101 with high dimensional accuracy enables achieving a highly accurate relative positional relationship between various devices mounted on the imaging unit 100.

Moreover, when the imaging unit 100 is positioned at the installation position, positioning of the imaging unit frame 101 of the imaging unit 100 with respect to the image forming apparatus is achieved by a photosensitive member drive shaft 221 and a bearing 222 thereof that are disposed on the main body of the image forming apparatus. More particularly, on the photosensitive member 21 of the photosensitive module 20 is formed an insertion hole 21*a* for inserting the photosensitive member drive shaft 221 disposed on the side of the main body of the image forming apparatus. Once the photosensitive member drive shaft 221 is completely inserted in the insertion hole 21*a*; then, as illustrated in FIG. 9, a photosensitive member drive joint 223 on the photosensitive member drive shaft 221 gets coupled with a joint target member 21*b* of the insertion hole 21*a* formed on the photosensitive member 21. With that, the photosensitive member 21 becomes integrally rotatable with the photosensitive member drive shaft 221. Moreover, once the photosensitive member drive shaft 221 is completely inserted in the insertion hole 21*a*; the end on the front side of the photosensitive member drive shaft 221 fits in a front face fitting member 101*a* disposed on the front side portion of the imaging unit frame 101, and the bearing 222 on the photosensitive member drive shaft 221 fits in a rear face fitting member 101*b* disposed on the rear side portion of the imaging unit frame 101. As a result, with respect to the photosensitive member drive shaft 221 on the main body of the image forming apparatus, positioning of the imaging unit frame 101 of the imaging unit 100 is achieved on the front side as well as on the rear side.

Herein, the image forming apparatus according to the present embodiment is what is called a tandem-type image forming apparatus. Hence, in case the relative positions of the photosensitive members 21Y, 21M, 21C, and 21K in the four imaging units 100Y, 100M, 100C, and 100K, respectively, are not determined with a high accuracy, the positional gaps prominently appear in the form of color shift in the images. On the other hand, regarding the various other devices (the charging module 30, the developing device 40, the cleaning module 50, etc.) except the photosensitive member 21 that are mounted on the imaging unit 100, the positional relationship with respect to the photosensitive member 21 is important from the perspective of image quality, but the positional relationship with respect to the other imaging units 100Y, 100M, 100C, and 100K does not directly affect the image quality. Hence, as far as the photosensitive member 21 mounted on the imaging unit 100 is concerned, the positioning with respect to the main body of the image forming apparatus is determined with a high accuracy; and as far as the charging module 30, the developing device 40, and the cleaning module 50 mounted on the imaging unit 100 are concerned, the positioning with respect to the photosensitive member 21 is determined with a high accuracy. Such a positioning configuration enables maintaining a high image quality.

In the positioning configuration according to the present embodiment, positioning of the photosensitive member 21 mounted on the imaging unit 100 is achieved directly with respect to the photosensitive member drive shaft 221 disposed on the main body of the image forming apparatus. That enables achieving a high positioning accuracy with respect to the main body of the image forming apparatus. On the other hand, regarding the charging module 30, the developing device 40, and the cleaning module 50 mounted on the imaging unit 100, positioning with respect to the main body of the image forming apparatus is achieved via at least the imaging unit frame 101 apart from the photosensitive member drive shaft 221. Because of that, a high positioning accuracy is not achieved with respect to the main body of the image forming apparatus, as compared to the positioning accuracy of the photosensitive member 21 with respect to the main body of the image forming apparatus. However, regarding the charging module 30, the developing device 40, and the cleaning module 50 mounted on the imaging unit 100, since the positioning is achieved via the imaging unit frame 101 that also determines the positioning of the photosensitive member 21 mounted on the imaging unit 100, a high positioning accuracy can be achieved with respect to the photosensitive member 21.

Given below is the explanation regarding the charging module 30 mounted on the imaging unit 100.

Figure 10:
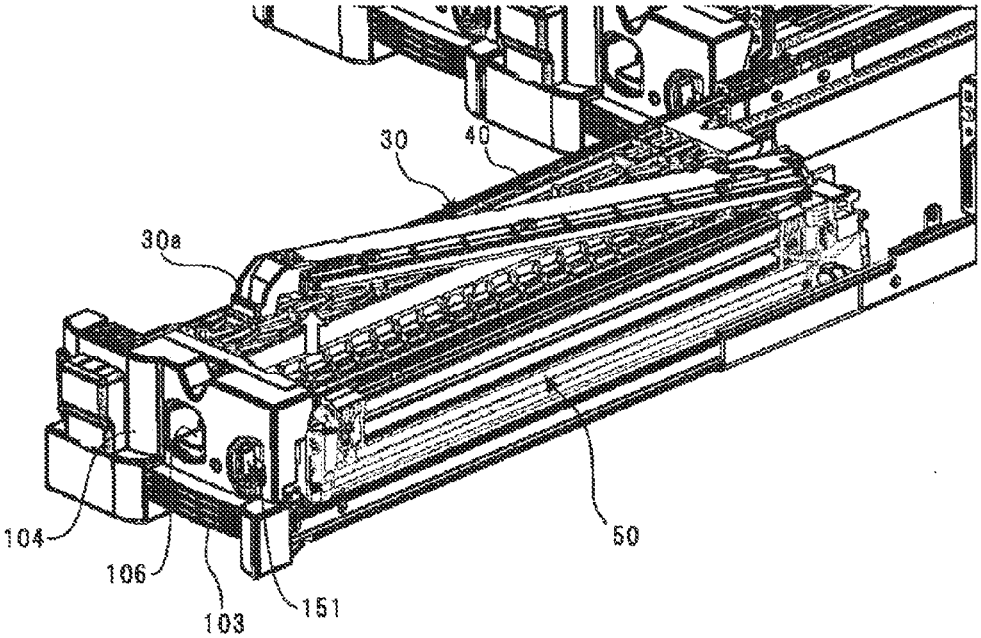
FIG. 10 is an explanatory diagram for explaining a condition at the time of removing a charging module according to the embodiment from the imaging unit.

FIG. 10 is an explanatory diagram for explaining the condition at the time of removing the charging module 30 from the imaging unit 100.

Figure 11A:
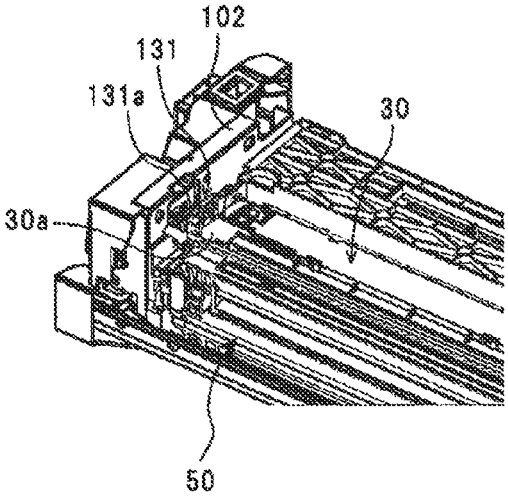
FIG. 11A and FIG. 11B are explanatory diagrams for explaining the operation of a lock mechanism of the charging module.
Figure 11B:
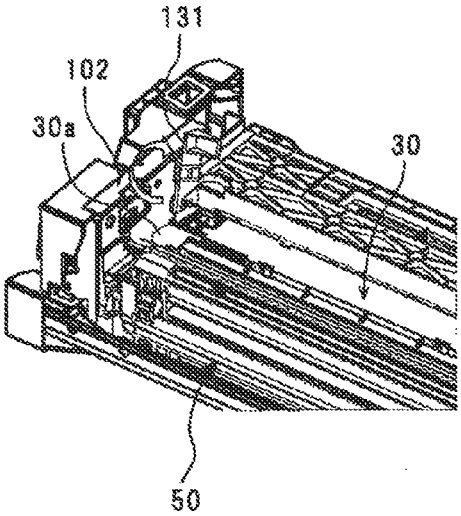

FIG. 11A and FIG. 11B are explanatory diagrams for explaining the operation of a lock mechanism of the charging module 30.

When removing the charging module 30 from the imaging unit 100, firstly, the operator holds a knob 131*a* of a charging module lock member 131 disposed on the front side portion of the imaging unit 100 and turns the charging module lock member 131 from a locked state illustrated in FIG. 11A to an unlocked state illustrated in FIG. 11B. Once the charging module lock member 131 is turned to the unlocked state, the upper restriction on a front side portion 30*a* of the charging module 30 is released. As a result, the front side portion 30*a* of the charging module 30 can be lifted upward as illustrated in FIG. 10.

Figure 12:
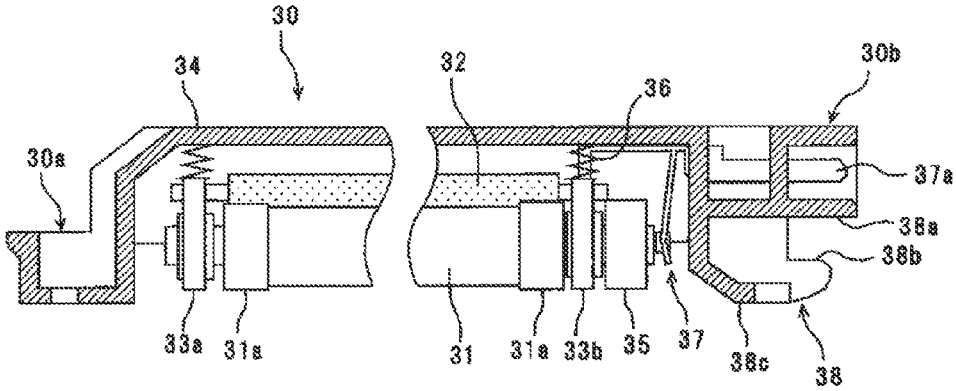
FIG. 12 is a schematic diagram of an overall configuration of the charging module.

FIG. 12 is a schematic diagram of an overall configuration of the charging module 30.

Figure 13:
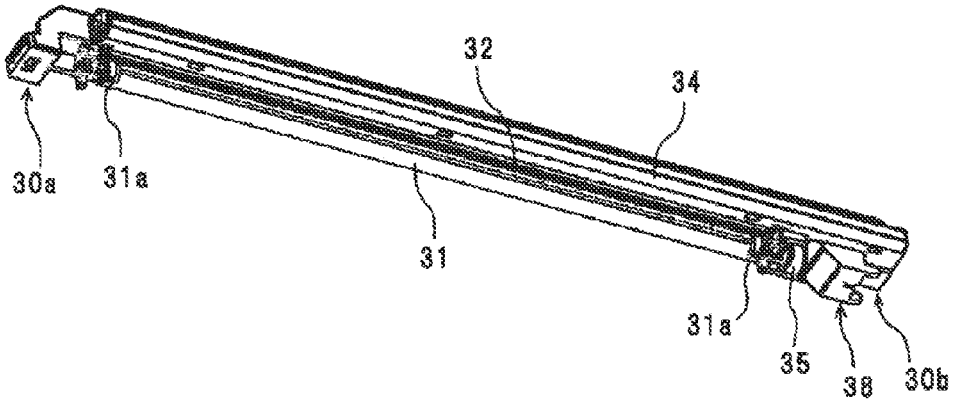
FIG. 13 is a perspective view of the charging module when viewed from below.

FIG. 13 is a perspective view of the charging module 30 when viewed from below.

In the charging module 30 according to the present embodiment, the charging roller 31 and a cleaning roller 32, which cleans the charging roller 31, are attached to a charging module frame 34 via common rotary shaft supporting members 33*a* and 33*b*, which support both ends of the common rotary shaft of the charging roller 31 and the cleaning roller 32. On the rotary shaft at the rear side of the charging roller 31 is fastened a driven gear 35. When the imaging unit 100 is positioned at the installation position inside the main body of the image forming apparatus, the driven gear 35 engages with a drive gear (not illustrated) positioned therebelow. Then, as the drive force from the drive gear is transmitted to the driven gear 35, the charging roller 31 is rotary driven. Meanwhile, the cleaning roller 32 is attached to be rotatable with respect to the rotary shaft supporting members 33*a* and 33*b*, and rotates due to the rotation of the charging roller 31.

The rotary shaft supporting members 33*a* and 33*b*, which support the charging roller 31 and the cleaning roller 32, are biased toward the photosensitive member 21 by a pressure spring 36 disposed as a biasing member on the charging module frame 34. Thus, when the charging module 30 is installed in the imaging unit 100 by setting the charging module lock member 131 to the locked state illustrated in FIG. 11A and by pressing the front side portion 30*a* of the charging module 30 from above with the charging module lock member 131, the biasing force of the pressure spring 36 makes the charging roller 31 biased toward the photosensitive member 21 via the rotary shaft supporting members 33*a* and 33*b*. At both ends of the outer periphery of the charging roller 31, spacers 31*a* having a greater diameter than the central area of the outer periphery of the charging roller 31 are disposed across the entire circumference of the charging roller 31. When the charging module 30 is installed in the imaging unit 100, the spacers 31*a* abut against a non-image region on the surface of the photosensitive member 21 due to the biasing force of the pressure spring 36. With that, a clearance gap is formed between the central area of the outer periphery of the charging roller 31 and the surface of the photosensitive member 21. Even when the charging roller 31 is rotary driven, that clearance gap is stably maintained by the spacers 31*a*. Thus, in the present embodiment, the adjacent charging method is implemented in which the charging roller 31 is placed adjacent to the surface of the photosensitive member 21 for performing the charging operation. However, alternatively, it is also possible to implement the contact charging method in which the charging roller 31 is placed to make contact with the surface of the photosensitive member 21 for performing the charging operation.

Meanwhile, against the end face of the rotary shaft on the rear side of the charging roller 31 abuts an electrode 37 that is disposed on the charging module frame 34. The electrode is connected to a power feed receiving member 37*a* that is coupled with a power feeding unit (not illustrated) in the main body of the image forming apparatus. Thus, once the imaging unit 100 is positioned at the installation position, the power feeding unit in the main body of the image forming apparatus gets connected. With that, it becomes possible to apply a predetermined charging bias to the charging roller 31 via the electrode 37.

As the positioning configuration of the charging module 30 with respect to the imaging unit 100, following configuration can be implemented. For example, the imaging unit 100 is configured to include a base, on which rests the bottom face at both ends in the longitudinal direction (the front-back direction) of the charging module 30. Then, pins are erected and fastened on the base and are fit in fitting holes formed on the bottom face at both ends of the charging module 30. Subsequently, the charging module 30 is locked in such a way that the condition in which the bottom faces at both ends of the charging module 30 abut against the base is maintained. If such a positioning configuration is implemented, then the positioning in the vertical direction of the charging module 30 is achieved with the bottom face at both ends of the charging module 30 and with the base of the imaging unit 100. Similarly, the positioning in the horizontal direction (the front-back direction, the direction perpendicular to the front-back direction (hereinafter, referred to as "transverse direction"), rotation on the horizontal plane) of the charging module 30 is achieved with the fitting holes formed on the charging module 30 and with the pins erected in the imaging unit 100. However, in such a positioning configuration, at the time of installing the charging module 30 in the imaging unit 100, the operator needs to bring down the charging module 30 straight from above. At that time, usually, the operator holds both ends in the longitudinal direction of the charging module 30 with both hands. However, the charging module 30 is left free of any restrictions on the movement in the front-back direction, the movement in the transverse direction, and the rotation. Hence, depending on the handling by the operator, the charging module 30 can freely move or rotate. Thus, while adjusting the movement and the rotation entirely with the hands, the operator needs to install the charging module 30 in such a way that the pins erected in the imaging unit 100 fit in the fitting holes formed on the charging module 30. Such an installing task is not easy to perform.

In the present embodiment, in order to reduce the burden on the operator while installing the charging module 30, following configuration is implemented as the positioning configuration of the charging module 30 with respect to the imaging unit 100.

Figure 14:
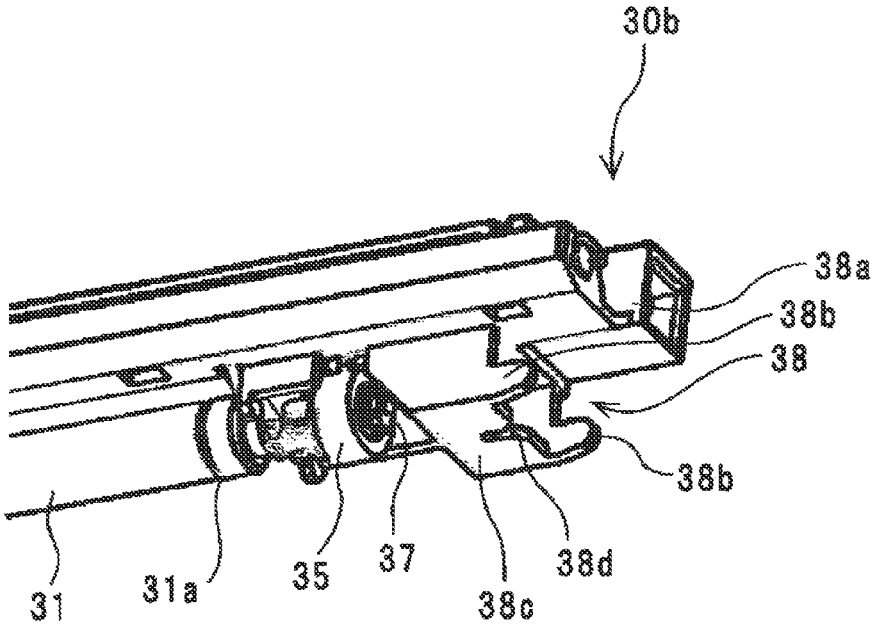
FIG. 14 is an enlarged perspective view of the rear side portion of the charging module when viewed from below.

FIG. 14 is an enlarged perspective view of a rear side portion 30*b* of the charging module 30 when viewed from below.

Figure 15:
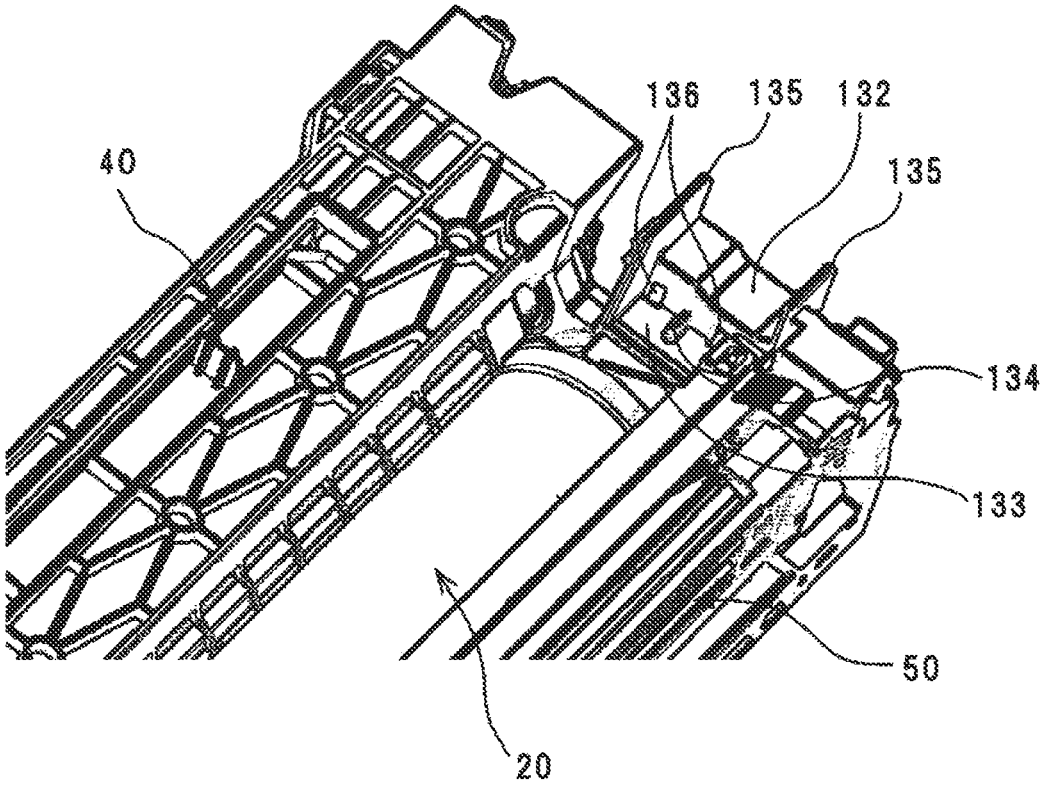
FIG. 15 is a perspective view, when viewed from above, of the rear side portion of the imaging unit to which is attached the rear side portion of the charging module.

FIG. 15 is a perspective view, when viewed from above, of the rear side portion of the imaging unit 100 to which is attached the rear side portion 30*b* of the charging module 30.

Figure 16A:
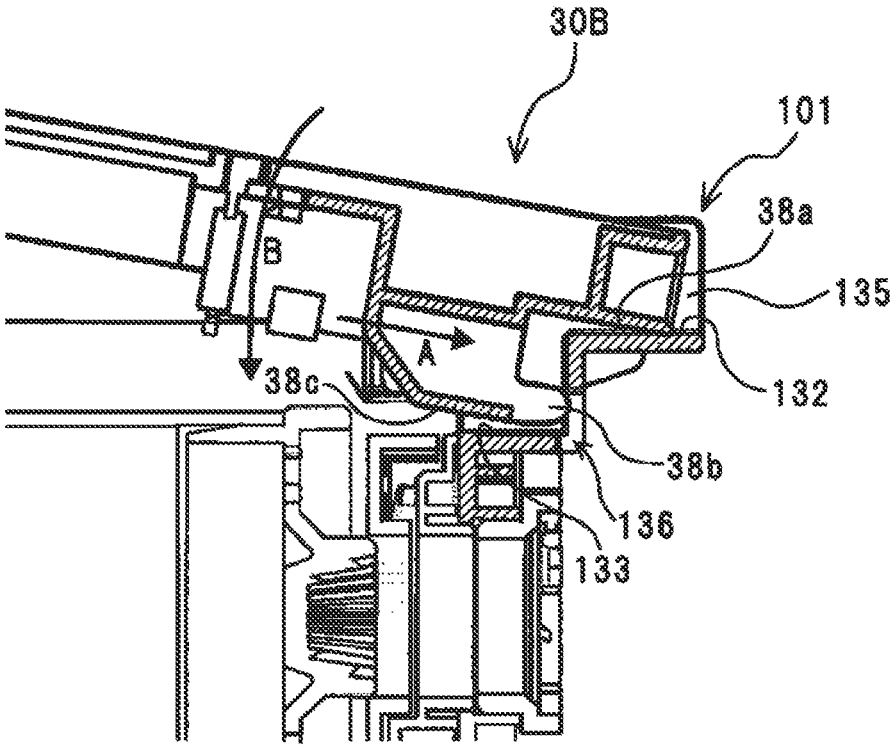
FIG. 16A and FIG. 16B are cross-sectional views for explaining the operation of attaching the rear side portion of the charging module to the imaging unit.
Figure 16B:
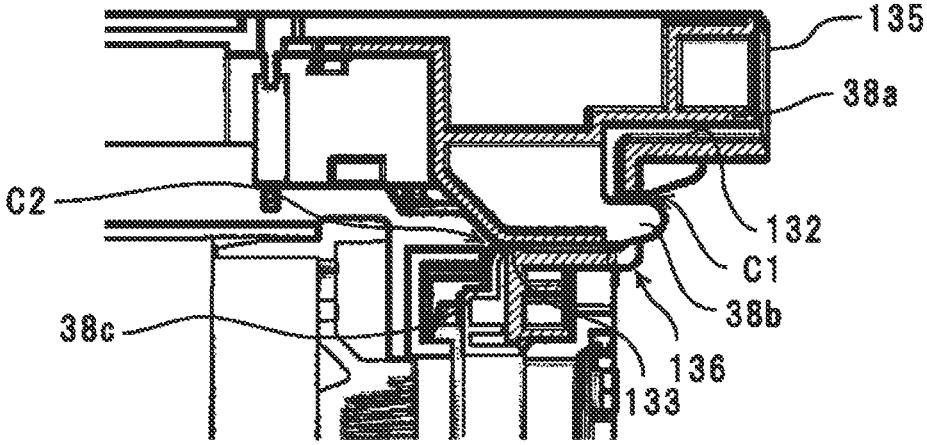

FIG. 16A and FIG. 16B are cross-sectional views for explaining the operation of attaching the rear side portion 30*b* of the charging module 30 to the imaging unit 100.

On the rear side portion 30*b* is disposed a rear side positioning member 38 for determining the positioning in the height direction and the transverse direction. At the time of attaching the rear side portion 30*b* of the charging module 30, when the rear side positioning member 38 is mounted on a tentative positioning base 132 disposed on the rear side portion of the imaging unit frame 101 of the imaging unit 100, the rear side positioning member 38 has a tentative positioning portion 38*a* used for tentative positioning of the rear side portion 30*b* of the charging module 30, a protrusion 38*b* that is placed below the tentative positioning portion 38*a* and that protrudes on the outside in the longitudinal direction of the charging module 30, a bottom face 30*c* that abuts against a lower restriction member 133 disposed on the rear side portion of the imaging unit frame 101 and that accordingly determines the position in the height direction of the rear side portion 30*b* of the charging module 30, and a depressed area

38*d* formed on a bottom face 38*c*. As illustrated in FIG. 14, the depressed area 38*d* has an inward depression from the outside in the longitudinal direction of the charging module 30. In the depressed area 38*d* fits a positioning protrusion 134 that is present on the rear side portion of the imaging unit frame 101. With that, positioning in the transverse direction of the rear side portion 30*b* of the charging module 30 is achieved.

According to the present embodiment, in the case of attaching the charging module 30 to the imaging unit 100, firstly, the tentative positioning portion 38*a* of the rear side portion 30*b* of the charging module 30 is placed on the tentative positioning base 132 disposed on the rear side portion of the imaging unit frame 101 of the imaging unit 100 as illustrated in FIG. 10 or in FIG. 16A. With that, tentative positioning in the height direction is achieved with the tentative positioning base 132 and with the contact portion between the tentative positioning base 132 and the tentative positioning portion 38*a*. Moreover, on the rear side portion of the imaging unit frame 101 are present two tentative positioning walls 135 that make contact with the side faces (end faces in the transverse direction) of the tentative positioning portion 38*a*. With that, tentative positioning in the transverse direction is achieved. The distance between the two tentative positioning walls 135 is set to be slightly greater than the length in the transverse direction of the tentative positioning portion 38*a* (i.e., greater than the distance between the side faces of the tentative positioning portion 38*a*). Thus, as far as the tentative positioning in the transverse direction is concerned, there exists an allowance. For that reason, just by adjusting with hands the approximate position in the transverse direction of the rear side portion 30*b* of the charging module 30, the operator does not face any difficulty in placing the tentative positioning portion 38*a* of the rear side portion 30*b* on the tentative positioning base 132.

Once tentative positioning of the rear side portion 30*b* of the charging module 30 is achieved in the abovementioned manner, the operator slides the tentative positioning portion 38*a* on the tentative positioning base 132 so as to move the entire charging module 30 toward the rear side as indicated by an arrow A in FIG. 16A, and then brings down the front side portion 30*a* of the charging module 30 in the downward direction indicated by an arrow B in FIG. 16A. This task can be performed without difficulty because of the fact that tentative positioning of the rear side portion 30*b* has already been achieved. By performing this task, the protrusion 38*b* on the rear side positioning member 38 enter a positioning opening 136 formed on the rear side portion of the imaging unit frame 101, while the bottom face 38*c* of the rear side positioning member 38 rests on the lower restriction member 133 of the imaging unit frame 101. That results in the condition illustrated in FIG. 16B.

In the condition illustrated in FIG. 16B, the top edge of the protrusion 38*b* abuts against the inner wall in the upper portion of the positioning opening 136 formed on the imaging unit frame 101. Consequently, the rear side portion 30*b* of the charging module 30 is restricted from moving upward. Thus, with the bottom face 38*c* of the rear side positioning member 38 resting on the lower restriction member 133 of the imaging unit frame 101, the rear side portion 30*b* of the charging module 30 is restricted from moving downward; and with the protrusion 38*b* abutting against the inner wall in the upper portion of the positioning opening 136 formed on the imaging unit frame 101, the rear side portion 30*b* of the charging module 30 is restricted from moving upward. That enables achieving positioning in the height direction of the rear side portion 30*b* of the charging module 30.

Moreover, in the condition illustrated in FIG. 16B, the positioning protrusion 134 of the imaging unit frame 101 fits in the depressed area 38*d* formed on the bottom face 38*c* of the rear side positioning member 38. That enables achieving positioning in the transverse direction of the rear side portion 30*b* of the charging module 30.

In the present embodiment, as illustrated in FIG. 16B, an upper restriction point C1 that restricts the rear side portion 30*b* of the charging module 30 from moving upward is positioned toward the rear side as compared to a horizontal position of a lower restriction point C2 that restricts the rear side portion 30*b* of the charging module 30 from moving downward. With such a configuration, just by changing the orientation of the rear side portion 30*b* of the charging module 30 from the downward orientation illustrated in FIG. 16A to the horizontal orientation illustrated in FIG. 16B, positioning in the height direction of the rear side portion 30*b* of the charging module 30 is completed.

Figure 17:
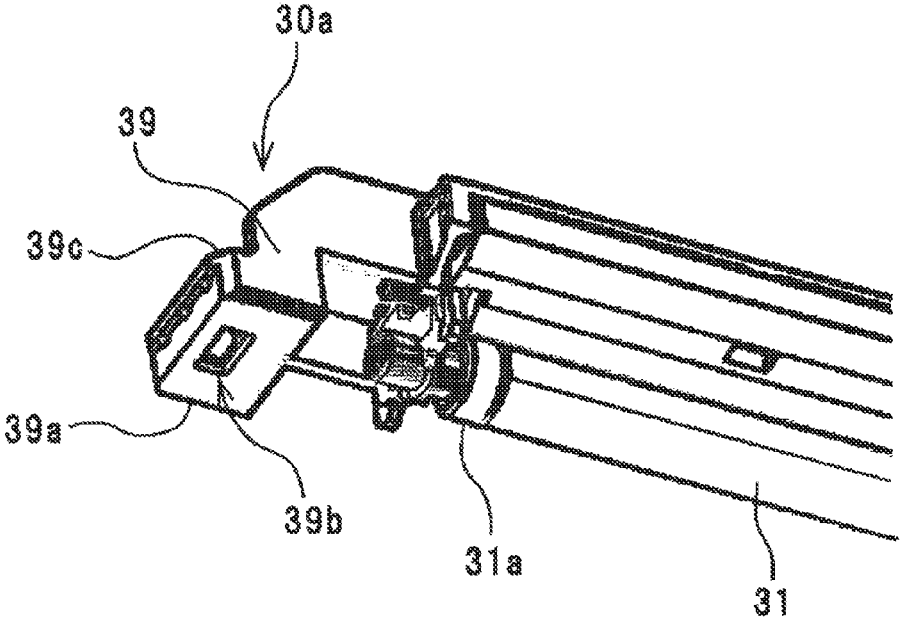
FIG. 17 is an enlarged perspective view, when viewed from below, of the front side portion of the charging module.

FIG. 17 is an enlarged perspective view, when viewed from below, of the front side portion 30*a* of the charging module 30.

Figure 18:
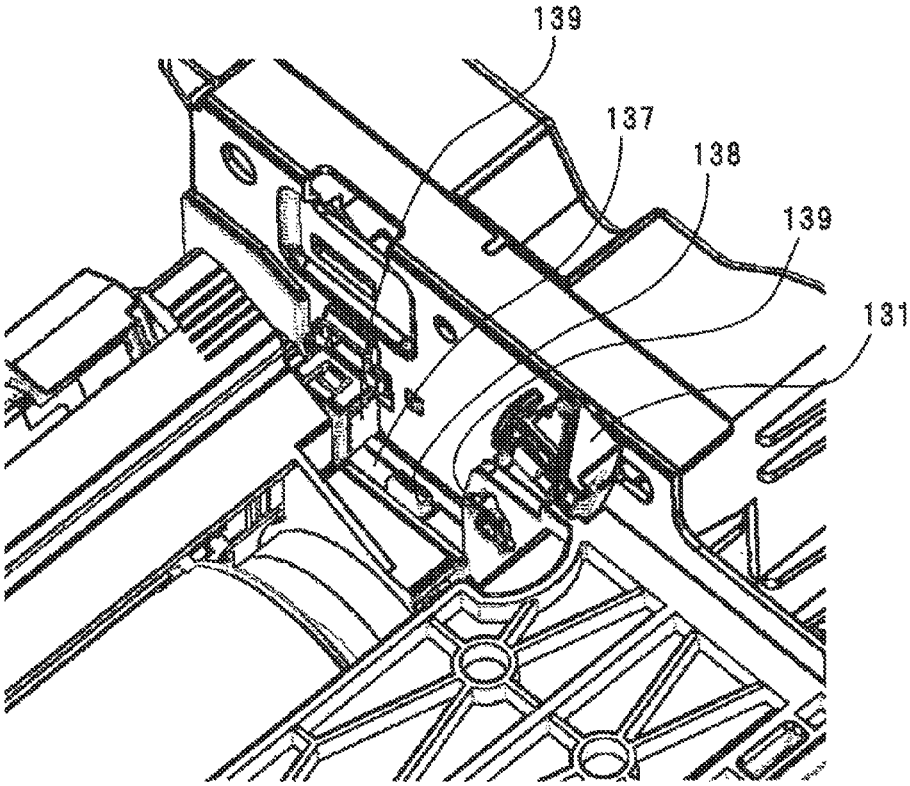
FIG. 18 is an enlarged perspective view, when viewed from above, of the front side portion of the imaging unit to which is attached the front side portion of the charging module.

FIG. 18 is an enlarged perspective view, when viewed from above, of the front side portion of the imaging unit 100 to which is attached the front side portion 30*a* of the charging module 30.

Figure 19:
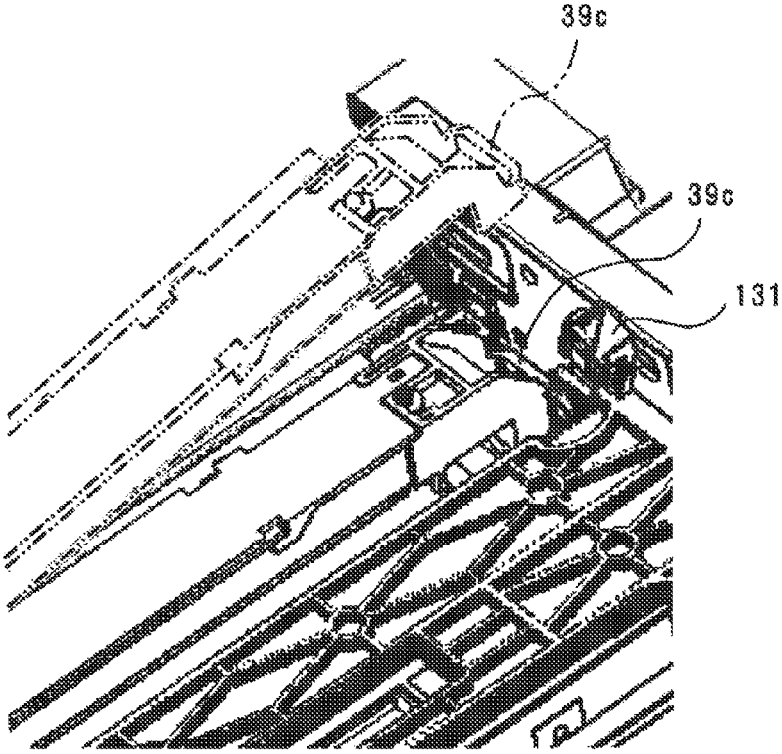
FIG. 19 is a cross-sectional view for explaining the task of attaching the front side portion of the charging module to the imaging unit.

FIG. 19 is a cross-sectional view for explaining the task of attaching the front side portion 30*a* of the charging module 30 to the imaging unit 100.

Figure 20:
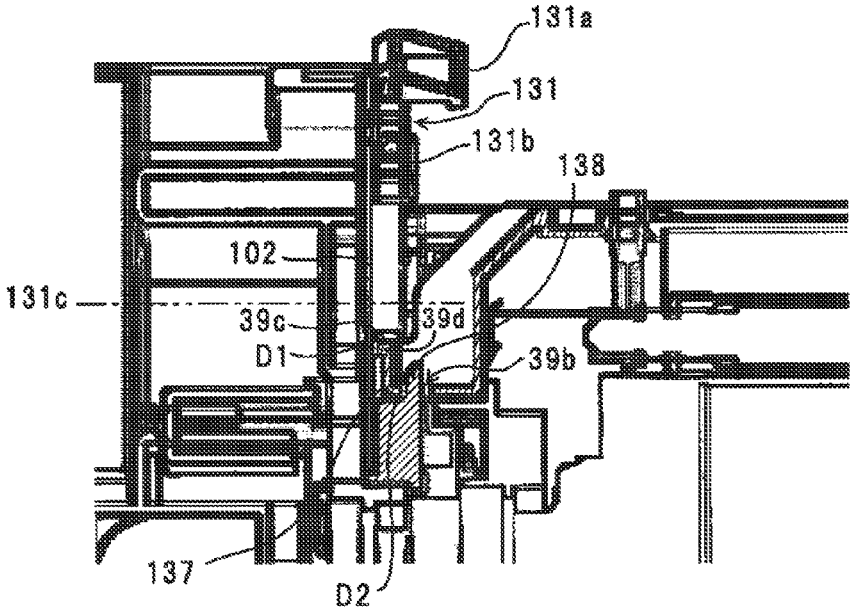
FIG. 20 is a cross-sectional view of a condition in which the front side portion of the charging module is attached to the imaging unit.

FIG. 20 is a cross-sectional view of a condition in which the front side portion 30*a* of the charging module 30 is attached to the imaging unit 100.

On the front side portion 30*a* of the charging module 30 is disposed a front-side positioning member 39 for determining the positioning in the front-back direction, the transverse direction, and the height direction. The front-side positioning member 39 has a bottom face 39*a* that rests on a positioning base 137 disposed on the front side portion of the imaging unit frame 101 of the imaging unit 100, has a positioning opening 39*b* formed on the bottom face 39*a*, and has a locking target portion 39*c* against which abuts the charging module lock member 131 disposed as the lock mechanism on the front side portion of the imaging unit 100. In the positioning opening 39*b* fits a positioning protrusion 138 present on the front side portion of the imaging unit frame 101. That enables achieving positioning in the transverse direction of the front side portion 30*a* of the charging module 30.

On the front side portion of the imaging unit frame 101 are disposed two tentative positioning walls 139, each abutting against a side face (end face in the transverse direction) of the front-side positioning member 39. That results in achieving positioning in the transverse direction. The distance between the two tentative positioning walls 139 is set to be slightly greater than the length in the transverse direction of the front-side positioning member 39 (i.e., greater than the distance between the side faces of the front-side positioning member 39). Thus, as far as the tentative positioning in the transverse direction is concerned, there exists an allowance. For that reason, just by adjusting with hands the approximate position in the transverse direction of the front side portion 30*a* of the charging module 30, the operator does not face any difficulty in suitably bringing down the bottom face 39*a* of the front side portion 30*a* on the positioning base 137 of the imaging unit frame 101. Because of that, it becomes easier to fit the positioning protrusion 138 of the imaging unit frame 101 in the positioning opening 39*b* formed on the bottom face 39*a* of the charging module 30.

In the condition in which the positioning protrusion 138 of the imaging unit frame 101 fits in the positioning opening 39*b* formed on the bottom face 39*a* of the charging module 30; when the bottom face 39*a* of the front side portion 30*a* of the charging module 30 is placed on the positioning base 137 of the imaging unit frame 101, positioning in the transverse direction of the front side portion 30*a* of the charging module 30 is achieved due to the abovementioned fitting.

Moreover, when the bottom face 39*a* is placed on the positioning base 137 of the imaging unit frame 101, then, as illustrated in FIG. 20, a protrusion 39*d* that protrudes toward the front side of the front-side positioning member 39 passes through a gap in the imaging unit frame 101 and abuts against the front plate 102 attached to the front side of the imaging unit frame 101. With that, the front side portion 30*a* of the charging module 30 is restricted from moving in the anterior direction. Furthermore, when the bottom face 39*a* is placed on the positioning base 137 of the imaging unit frame 101, then, as illustrated in FIG. 20, the inner wall on the front side of the positioning opening 39*b* formed on the front-side positioning member 39 abuts against the positioning protrusion 138 present on the imaging unit frame 101. With that, the front side portion 30*a* of the charging module 30 is restricted from moving in the posterior direction.

Thus, when the bottom face 39*a* is placed on the positioning base 137 of the imaging unit frame 101 and when the positioning protrusion 138 present on the imaging unit frame 101 fits in the positioning opening 39*b* formed in the charging module 30, positioning in the transverse direction as well as in the front-back direction of the front side portion 30*a* of the charging module 30 is achieved.

In this way, once the bottom face 39*a* of the charging module 30 is placed on the positioning base 137 of the imaging unit frame 101, the operator turns the charging module lock member 131 around a rotary shaft 131*c* so that the charging module lock member 131 changes from the unlocked state illustrated in FIG. 11B to the locked state illustrated in FIG. 11A. At that time, a pressing member 131*b* of the charging module lock member 131 abuts against the locking target portion 39*c* in the front-side positioning member 39 of the charging module 30, and the charging module lock member 131 falls in the locked state while pressing the front side portion 30*a* of the charging module 30 against the positioning base 137. That enables achieving positioning in the height direction of the front side portion 30*a* of the charging module 30.

Figure 21A:
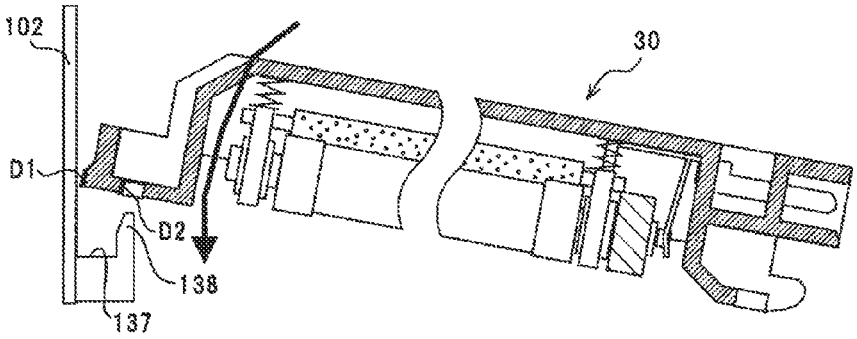
FIG. 21A and FIG. 21B are explanatory diagrams for explaining a configuration example of a charging module that cannot be installed in the imaging unit.
Figure 21B:
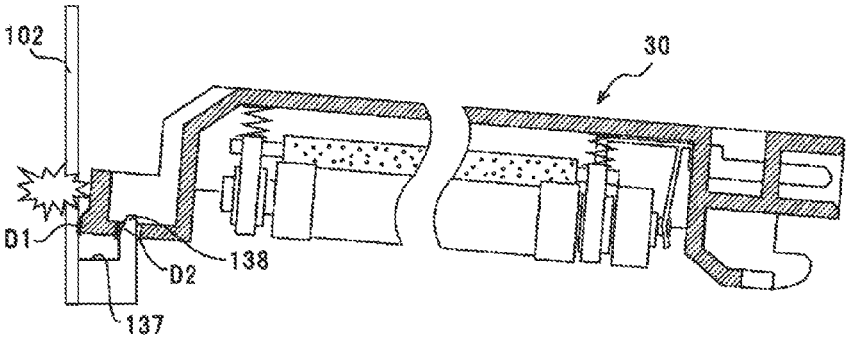
Figure 22A:
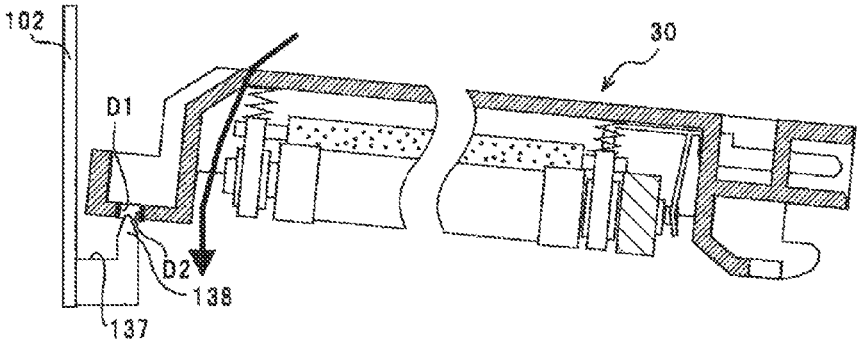
FIG. 22A and FIG. 22B are explanatory diagrams for explaining another configuration example of a charging module that cannot be installed in the imaging unit.
Figure 22B:
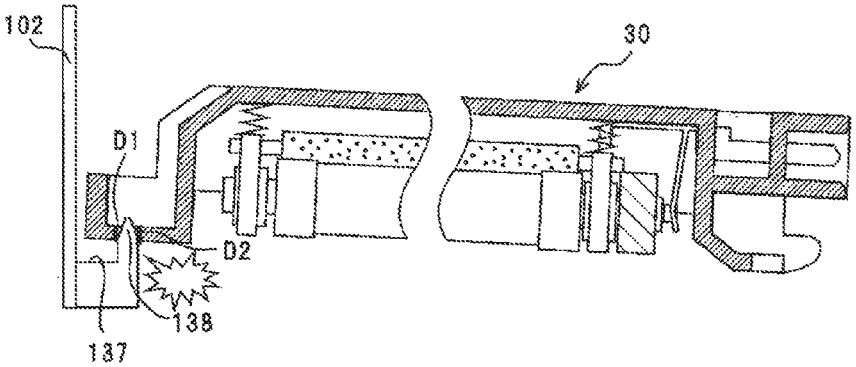
Figure 23A:
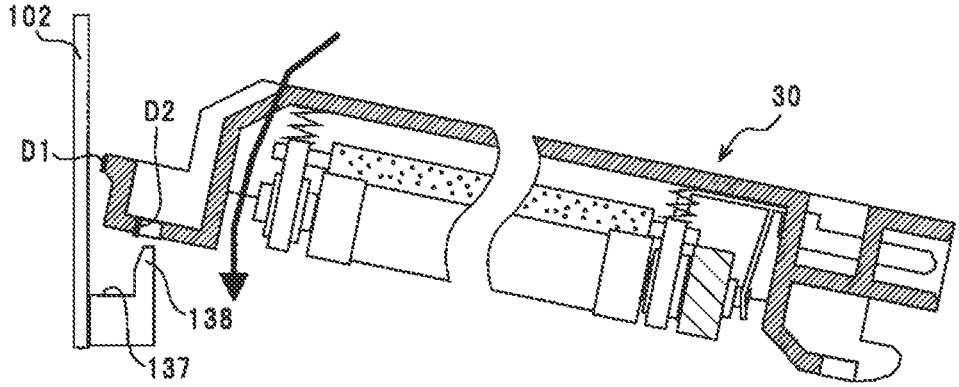
FIG. 23A and FIG. 23B are explanatory diagrams for explaining a configuration example of the charging module according to the embodiment that can be installed in the imaging unit.
Figure 23B:
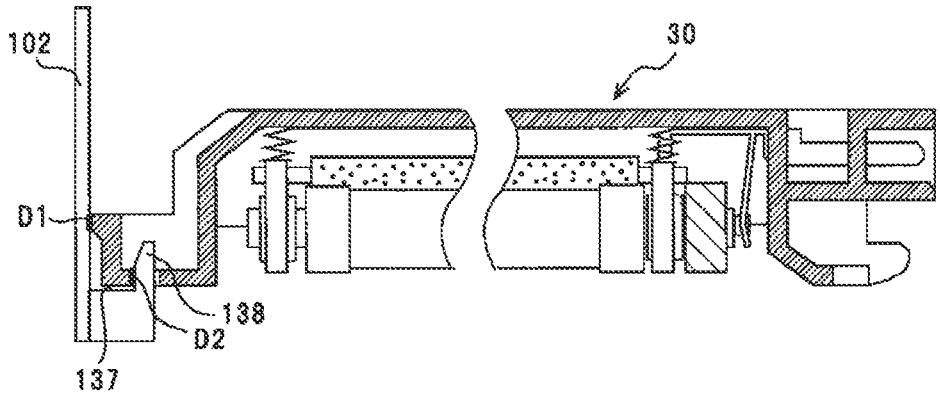

In the present embodiment, as illustrated in FIG. 20, a front restriction point D1 that restricts the front side portion 30*a* of the charging module 30 from moving in the anterior direction is positioned toward the upper side as compared to a vertical position of a rear restriction point D2 that restricts the front side portion 30*a* of the charging module 30 from moving in the posterior direction. With such a configuration, just by changing the orientation of the front side portion 30*a* of the charging module 30 from the upward orientation illustrated in FIG. 19 to the horizontal orientation illustrated in FIG. 20, positioning in the front-back direction of the front side portion 30*a* of the charging module 30 can completed without difficulty. Meanwhile, as illustrated in FIG. 21 or FIG. 22, in case the front restriction point D1 and the rear restriction point D2 are positioned at the same level in the vertical direction; then, while turning the front side portion 30*a* of the charging module 30 in a manner indicated by an arrow in FIG. 21A or FIG. 22A, the front side portion 30*a* gets stuck along the way as illustrated in FIG. 21B or FIG. 22B. In contrast, in the present embodiment, the front restriction point D1 is positioned at an upper level in the vertical direction than position in the vertical direction of the rear restriction point D2. Thus, while turning the front side portion 30*a* of the charging module 30 in a manner indicated by an arrow in FIG. 23A, the front side portion 30*a* does not get stuck along the way and can be attached smoothly as illustrated in FIG. 23B.

Given below is the explanation regarding the cleaning module 50 mounted on the imaging unit 100.

Figure 24:
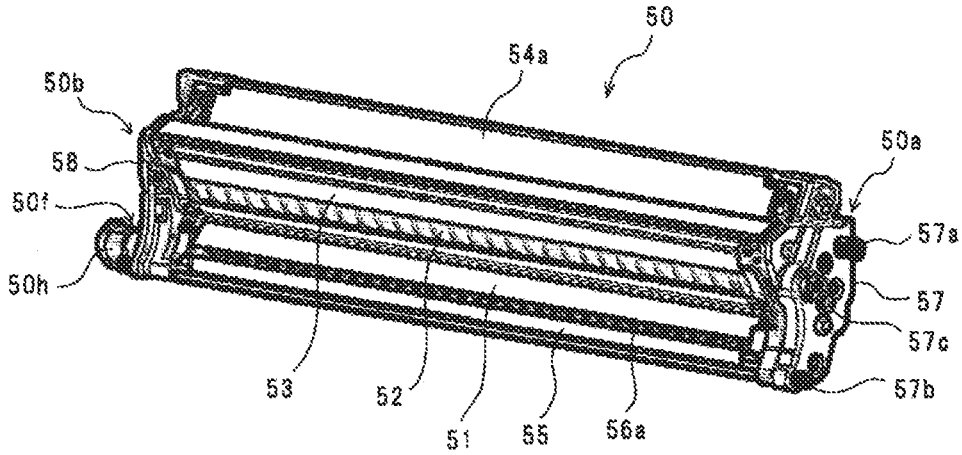
FIG. 24 is a perspective view of a cleaning module according to the embodiment that has been removed from the imaging unit.

FIG. 24 is a perspective view of the cleaning module 50 that has been removed from the imaging unit 100.

According to the present embodiment, in the cleaning module 50; the cleaning blade 51 and the lubricant agent applying brush 52 are exposed through a cleaning module opening that opens toward the surface of the photosensitive member 21. In that condition, the cleaning module 50 is supported by a front side portion 50*a* and a rear side portion 50*b* of a cleaning module frame. To the lower end of the cleaning module opening is attached a lower seal member 55, and at the upper end of the cleaning module opening is disposed the smoothing blade 53. Thus, from the upstream side in the surface movement direction of the photosensitive member 21 (i.e., on the lower side in the vertical direction); the lower seal member 55, the cleaning blade 51, the lubricant agent applying brush 52, and the smoothing blade 53 make contact with and face the surface of the photosensitive member 21 in that order. Herein, the cleaning module 50 according to the present embodiment can be broadly divided into a cleaning unit, which cleans the transfer residual toner from the surface of the photosensitive member 21, and a lubricant agent supplying unit, which supplies a lubricant agent to the surface of the photosensitive member 21.

Regarding the cleaning unit, the cleaning blade 51 abuts against the surface of the photosensitive member 21 from the counter direction. The transfer residual toner that is scraped off by the cleaning blade 51 falls down inside a cabinet due to gravity. Herein, the lower seal member 55 is attached so as to prevent the transfer residual toner, which is scraped off by the cleaning blade 51, from spilling out from a gap between the cabinet and the surface of the photosensitive member 21. The lower seal member 55 is a highly flexible mylar arranged to abut against the surface of the photosensitive member 21 in the trailing direction and across the axial direction of the photosensitive member 21. Inside the cabinet is disposed a waste toner carrying screw 56*a* as illustrated in FIG. 2. The waste toner carrying screw 56*a* has a helical blade fastened to the screw shaft and carries the transfer residual toner, which has been scraped off by the cleaning blade 51 and which has fallen in the cabinet, toward the rear side along the direction of axis of the screw shaft.

Regarding the lubricant agent supplying unit, the lubricant agent applying brush 52 abuts against the surface of the photosensitive member 21 as well as against the solid lubricant agent 54 as illustrated in FIG. 2. The lubricant agent applying brush 52 is rotary driven in the counter direction with respect to the surface of the photosensitive member 21. Upon being rotary driven, the lubricant agent applying brush 52 scrapes off the solid lubricant agent 54, and the powdered lubricant agent obtained by scraping gets attached to the lubricant agent applying brush 52. Then, with the rotation of the lubricant agent applying brush 52, the powdered lubricant agent is carried to the position of contact with the surface of the photosensitive member 21 and is applied to the surface of the photosensitive member 21. Subsequently, due to the surface movement of the photosensitive member 21, the powdered lubricant agent that has been applied to the surface of the photosensitive member 21 passes the position at which the smoothing blade 53 is abutting against surface of the photosensitive member 21. At that position, the lubricant agent is smoothened so that the application unevenness caused by the lubricant agent applying brush 52 is eliminated. Meanwhile, the solid lubricant agent 54 is guided by a lubricant agent holder 54*a* and is biased by a spring 54*b* toward the lubricant agent applying brush 52. Hence, even when the solid lubricant agent decreases in quantity, the abutting pressure between the solid lubricant agent 54 and the lubricant agent applying brush 52 can be maintained at a constant level. That enables the lubricant agent applying brush 52 to scrape off the solid lubricant agent 54 in a stable manner. Meanwhile, in the present embodiment, the scraping amount of the solid lubricant agent 54, which is scraped by the lubricant agent applying brush 52, is adjusted to be in the range of 120 mg/km to 150 mg/km against the run (km) of the photosensitive member 21.

Of the powdered lubricant agent that is scraped off from the solid lubricant agent 54 and that is attached to the lubricant agent applying brush 52, the excess lubricant agent is flicked away at a position of contact between a flicker 59 and the solid lubricant agent 54. The flicked lubricant agent then falls down inside a cabinet of the lubricant agent supplying unit. Meanwhile, in the present embodiment, the flicker 59 is integrally molded with the cabinet. Alternatively, the flicker 59 and the cabinet can also be separate components. Moreover, a small amount of the transfer residual toner that sneaks through the cleaning position of the cleaning blade 51 gets attached to the lubricant agent applying brush 52. Such transfer residual toner is also flicked away at the position of contact between the flicker 59 and the solid lubricant agent 54, and falls down inside the cabinet of the lubricant agent supplying unit. Since the excess lubricant agent that falls down inside the cabinet accumulates at the bottom of the cabinet due to gravity, it gets reattached to the lubricant agent applying brush 52 and is applied to the surface of the photosensitive member 21. Hence, as long as the excess lubricant agent is in proper quantity, it contributes in enhancing the efficiency of applying the lubricant agent scraped off from the solid lubricant agent 54 to the surface of the photosensitive member 21. However, if the excess lubricant agent accumulates in large quantity, then there is an excess in the quantity of the lubricant agent or the transfer residual toner that passes over the smoothing blade 53. That may cause problems such as defects in images or contamination inside the image forming apparatus due to the taint on the charging members.

In that regard, in the present embodiment, in order to discharge the excess lubricant agent that gets accumulated inside the cabinet of the lubricant agent supplying unit, an excess lubricant agent carrying screw 56*b* is disposed as illustrated in FIG. 2. The excess lubricant agent carrying screw 56*b* has a helical blade fastened to a screw shaft and carries the excess lubricant agent toward the front side along the direction of axis of the screw shaft.

Figure 25:
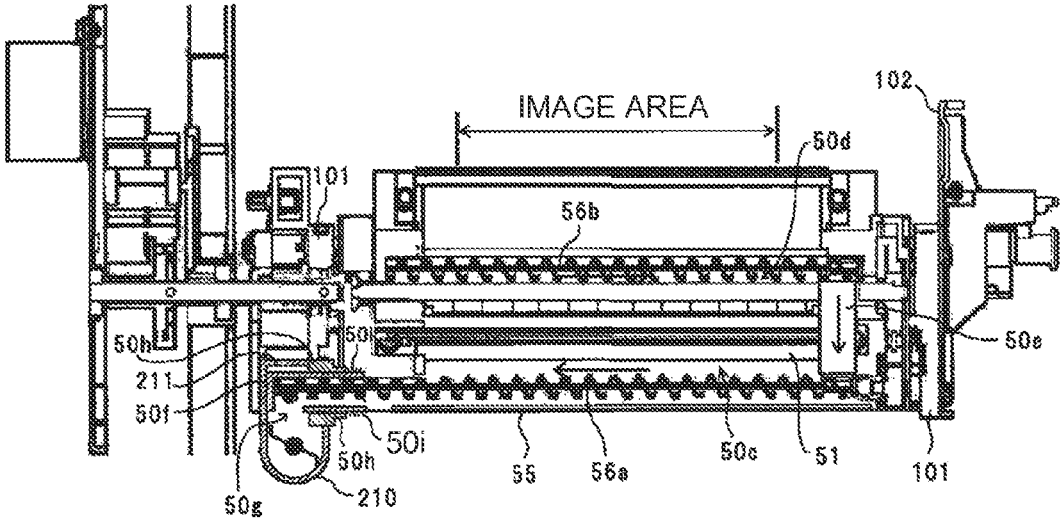
FIG. 25 is a cross-sectional view of the cleaning module for the purpose of explaining a carrying path through which is carried the excess lubricant agent and the transfer residual toner to a waste toner carrying path.

FIG. 25 is a cross-sectional view of the cleaning module 50 for the purpose of explaining a carrying path through which is carried the excess lubricant agent and the transfer residual toner to a waste toner carrying path 210.

In the present embodiment, the cleaning module 50 needs to carry the transfer residual toner produced in the cleaning unit and the excess lubricant agent that is produced in the lubricant agent supplying unit to a waste toner bottle (not illustrated), which is disposed outside the cleaning module 50 and in the main body of the image forming apparatus. The cleaning module 50 is mounted on the imaging unit 100 in a detachably attachable manner with respect to the main body of the image forming apparatus. Hence, as far as a carrying path for carrying the transfer residual toner and the excess lubricant agent is concerned; at the time of installing the imaging unit 100, a carrying path in the imaging unit 100 and a carrying path in the main body of the image forming apparatus need to be connected. To establish that connection, it becomes necessary to achieve positioning among those carrying paths. If the number of connection points between the carrying paths is large, then the number of places in need of positioning increases thereby leading to an increase in the manufacturing cost. Moreover, at the time of attaching or detaching the imaging unit 100, it is highly likely that the transfer residual toner or the excess lubricant agent remaining inside a carrying path spills out from a connection point. Thus, larger the number of connection points between the carrying paths, higher is the risk of spilling.

In that regard, in the present embodiment, as illustrated in FIG. 25, a lower carrying path 50*c* for carrying the transfer residual toner and an upper carrying path 50*d* for carrying the excess lubricant agent are connected by a connection path 50*e* at the front side inside the cleaning module 50. With that, once the excess lubricant agent accumulated inside the cabinet of the lubricant agent supplying unit is carried by the excess lubricant agent carrying screw 56*b* to the front end of the upper carrying path 50*d*, it falls down in the lower carrying path 50*c* through the connection path 50*e*. Then, along with the transfer residual toner accumulated inside the cabinet of the cleaning module 50, the excess lubricant agent that has fallen down in the lower carrying path 50*c* is carried by the waste toner carrying screw 56*a* to the rear end of the lower carrying path 50*c*. Herein, the rear end of the lower carrying path 50*c* is connected to a single discharging unit 50*f* that protrudes from the rear side portion 50*b* of the cleaning module 50 toward the rear side on the outside of the cleaning module 50. At the bottom at the end of the discharging unit 50*f* opens a discharging spout 50*g*. The transfer residual toner and the excess lubricant agent (hereinafter, collectively referred to as "waste toner") that are carried inside the discharging unit 50*f* through the lower carrying path 50*c* fall down from the discharging spout 50*g* into the waste toner carrying path 210.

However, in case the connection path 50*e*, in which the lower carrying path 50*c* and the upper carrying path 50*d* converge, is positioned on the inside of the image area on the surface of the photosensitive member 21 (i.e., an area on the surface of the photosensitive member 21 on which a toner image can be formed) in the direction of the rotary shaft of the photosensitive member 21, then following problems may occur. Since the excess lubricant agent in the upper carrying path 50*d* enters the lower carrying path 50*c* at the junction therebetween, the quantity of the transfer residual toner or the excess lubricant agent near the junction inside the lower carrying path 50*c* increases locally. If, for example, the inflow from the upper carrying path 50*d* temporarily increases thereby leading to an excessively large amount of the transfer residual toner or the excess lubricant agent at the junction inside the lower carrying path 50*c*, then the transfer residual toner or the excess lubricant agent near the junction may close in on the surface of the photosensitive member 21 and may get attached to the image area on the surface of the photosensitive member 21. That may cause filming or scratches on the surface of the photosensitive member 21, or may lead to an increase in the quantity of the toner or the lubricant agent supplied to various components such as the cleaning blade 51 and the charging roller 31. That may affect the longevity of the components, or may lead to an increase in the quantity of the toner or the lubricant agent scattering inside the image forming apparatus thereby causing various problems.

In that regard, in the present embodiment, the connection path 50*e*, in which the lower carrying path 50*c* and the upper carrying path 50*d* converge, is positioned on the outside of the image area in the direction of the rotary shaft of the photosensitive member 21. That enables achieving reduction in the abovementioned problems.

In the present embodiment, the waste toner carrying screw 56*a* has an outer diameter ϕ of 10 mm, a screw pitch of 8 mm, and a rotational frequency of 180 rpm. In comparison, the excess lubricant agent carrying screw 56*b* has an outer diameter ϕ of 10 mm, a screw pitch of 8 mm, and a rotational frequency of 100 rpm. Thus, as compared to the waste toner carrying screw 56*a* that carries the transfer residual toner removed from the cleaning blade 51, the excess lubricant agent carrying screw 56*b* that carries the excess lubricant agent is set to have a smaller rotational frequency so as to reduce the carrying capacity of the lubricant agent. That is done in order to enhance the reuse efficiency of the lubricant agent by means of reattaching the excess lubricant agent to the lubricant agent applying brush 52 and supplying it to the surface of the photosensitive member 21.

Figure 26:
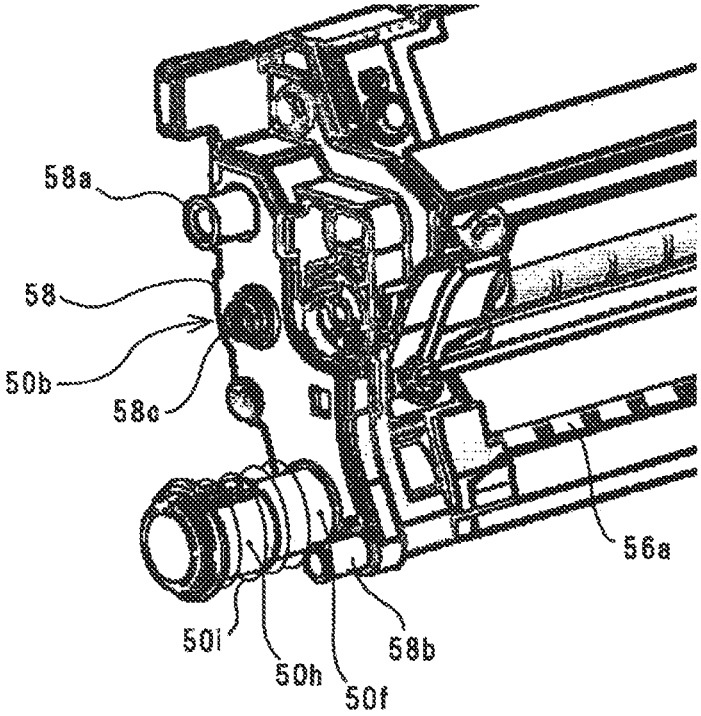
FIG. 26 is an enlarged perspective view of the rear side portion of the cleaning module.

FIG. 26 is an enlarged perspective view of the rear side portion 50*b* of the cleaning module 50.

The discharging unit 50*f* includes a shutter 50*h* for opening and closing the discharging spout 50*g*. When the imaging unit 100 is not positioned at the installation position, the shutter 50*h* is biased rearward due to the biasing force of a spring 50*i* and is maintained in a closed state while blocking the discharging spout 50*g*. Once the imaging unit 100 is positioned at the installation position; as illustrated in FIG. 25, the discharging unit 50*f* at the rear side portion 50*b* of the cleaning module 50 gets inserted inside a coupling target member 211 formed on the upper side of the waste toner carrying path 210 in the main body of the image forming apparatus. While the imaging unit 100 is slid toward the installation position, the end face on the rear side of the shutter 50*h* in the discharging unit 50*f* abuts against the end face on the front side of the coupling target member 211 in the main body of the image forming apparatus. That blocks the sliding of the imaging unit 100. As a result, with respect to the discharging unit 50*f* that moves toward the rear side along with the imaging unit 100, the shutter 50*h* relatively moves toward the front side by opposing the biasing force of the spring 50*i*. Thus, when the imaging unit 100 is positioned at the installation position, as illustrated in FIG. 25, the shutter 50*h* is maintained in an open state in which the discharging spout 50*g* is opened. At that time, the discharging spout 50*g* faces a receiving opening formed in the waste toner carrying path 210 in the main body of the image forming apparatus. With that, the waste toner that falls down from the discharging spout 50*g* can be accumulated in the waste toner carrying path 210.

In the cleaning module 50 according to the present embodiment, on the front side portion 50*a* are disposed a main reference member 57*a* and a sub-reference member 57*b*, while on the rear side portion 50*b* are disposed a main reference member 58*a* and a sub-reference member 58*b*. On the main reference members 57*a* and 58*a* are formed fitting holes in which respectively fit main reference pins 152 and 153 (described later) disposed on the imaging unit frame 101 of the imaging unit 100. When the main reference pins 152 and 153 fit in the fitting holes and get coupled with the main reference members 57*a* and 58*a*, respectively, positioning in the vertical direction and in the transverse direction of the cleaning module 50 is achieved with respect to the imaging unit 100. Moreover, the sub-reference members 57*b* and 58*b* respectively fit in sub-reference recesses 156*a* and 157*a* (described later) formed on the imaging unit frame 101 of the imaging unit 100. By setting such sub-references, not only the rotation of the cleaning module 50 around the main references is restricted but also the position of rotational direction around the main references is determined.

Figure 27:
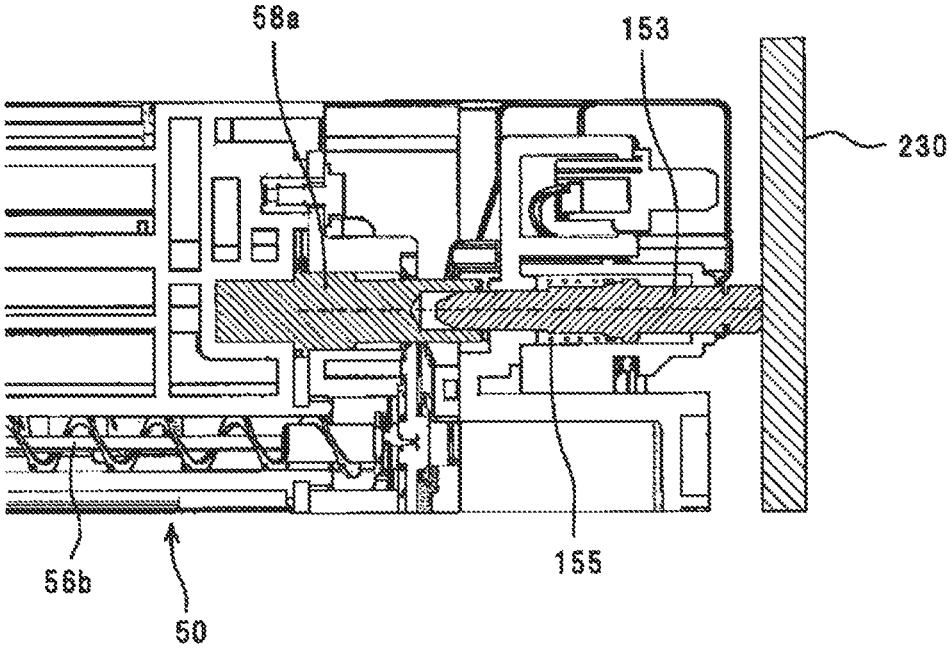
FIG. 27 is a partial cross-sectional view of the rear side portion of the imaging unit, which is positioned at the installation position, for the purpose of explaining a lock mechanism of the rear side portion of the cleaning module with respect to the imaging unit.

FIG. 27 is a partial cross-sectional view of the rear side portion of the imaging unit 100, which is positioned at the installation position, for the purpose of explaining the lock mechanism of the rear side portion 50*b* of the cleaning module 50 with respect to the imaging unit 100.

In the present embodiment, in the condition in which the imaging unit 100 is pulled out from the main body of the image forming apparatus, the rear-side main reference pin 153 disposed on the rear side portion of the imaging unit 100 is maintained in a displaced state toward the rear side by the biasing force of a spring 155. As a result, the rear end of the rear-side main reference pin 153 protrudes rearward from the rear side portion of the imaging unit 100 and the front end of the rear-side main reference pin 153 is positioned away from the fitting hole formed on the rear-side main reference member 58*a* on the rear side portion 50*b* of the cleaning module 50. Hence, in the condition in which the imaging unit 100 is pulled out from the main body of the image forming apparatus, the rear-side main reference member 58*a* of the cleaning module 50 always remains in an unlocked state in which the lock against the imaging unit 100 is released.

On the other hand, when the imaging unit 100 is slid toward the installation position inside the main body of the image forming apparatus, the rear end of the rear-side main reference pin 153 of the imaging unit 100 makes contact with a main body frame 230 of the main body of the image forming apparatus. With that, the rear-side main reference pin 153 is blocked from moving rearward. As a result, by further sliding the imaging unit 100 toward the rear side, the rear-side main reference pin 153 moves toward the front side with respect to the imaging unit 100 and the front end of the rear-side main reference pin 153 enters the fitting hole formed on the rear-side main reference member 58*a* of the cleaning module 50. Then, in the condition in which the imaging unit 100 is positioned at the installation position, as illustrated in FIG. 27, the rear-side main reference pin 153 of the imaging unit 100 enters the fitting hole formed on the rear-side main reference member 58*a* of the cleaning module 50 and falls in the locked state. Thus, positioning of the rear side portion 50*b* of the cleaning module 50 is achieved.

Figure 28:
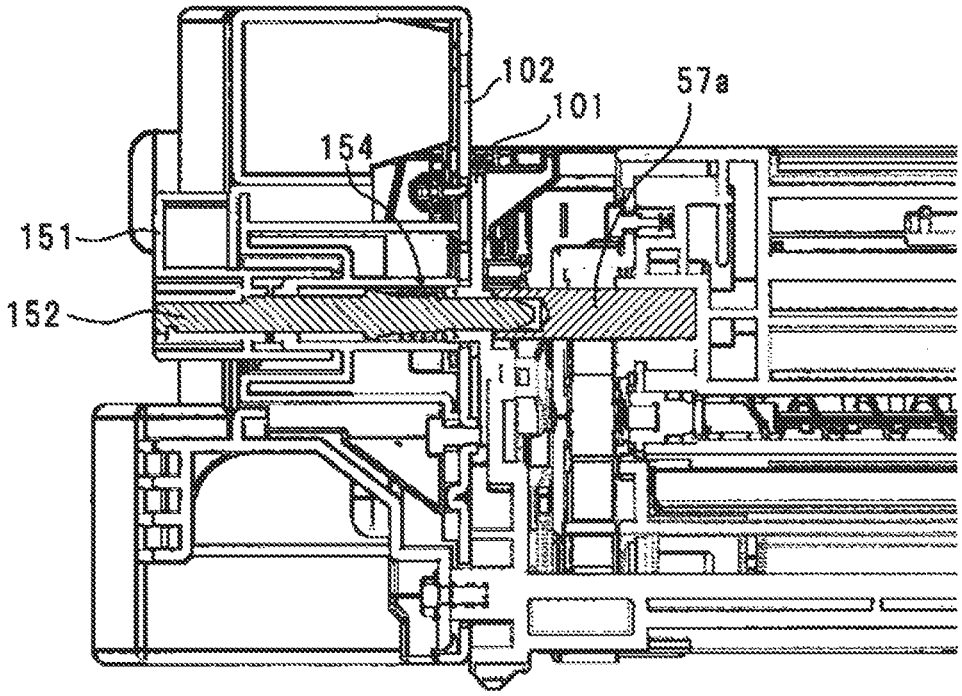
FIG. 28 is a partial cross-sectional view of the front side portion of the imaging unit, which is positioned at the installation position, for the purpose of explaining a lock mechanism of the front side portion of the cleaning module with respect to the imaging unit.

FIG. 28 is a partial cross-sectional view of the front side portion of the imaging unit 100, which is positioned at the installation position, for the purpose of explaining the lock mechanism of the front side portion 50*a* of the cleaning module 50 with respect to the imaging unit 100.

Figure 29A:
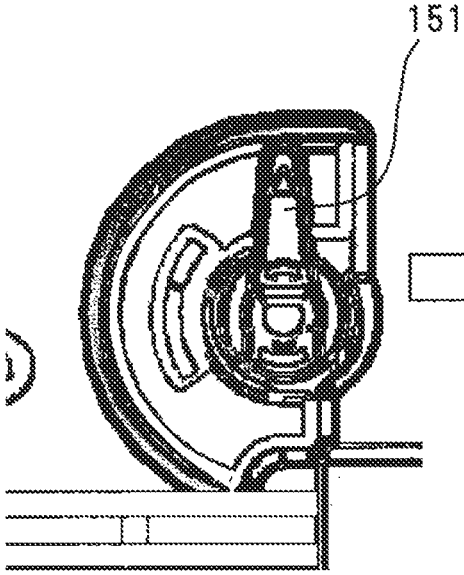
FIG. 29A is an explanatory diagram illustrating the orientation of a locking operation lever when the cleaning module is in a locked state.
Figure 29B:
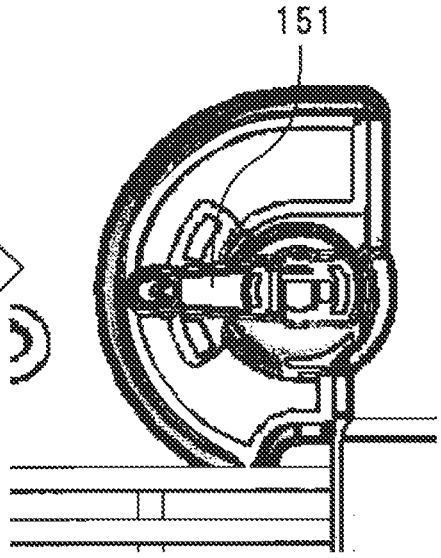
FIG. 29B is an explanatory diagram illustrating the orientation of the locking operation lever when the cleaning module is in an unlocked state.

FIG. 29A is an explanatory diagram illustrating the orientation of a locking operation lever 151 when the cleaning module 50 is in the locked state; and FIG. 29B is an explanatory diagram illustrating the orientation of the locking operation lever 151 when the cleaning module 50 is in the unlocked state.

When the imaging unit 100 is pulled out from the main body of the image forming apparatus up to the replacement enabling position, the rear side portion 50*b* of the cleaning module 50 gets released from the locked state with respect to the imaging unit 100 as descried above. Then, once the front side portion 50*a* of the cleaning module 50 is released from the locked state with respect to the imaging unit 100, the cleaning module 50 can be removed from the imaging unit 100. While removing the cleaning module 50 from the imaging unit 100, firstly, the operator holds the locking operation lever 151 disposed on the front side portion of the imaging unit 100 and turns it from the locked state illustrated in FIG. 29A to the unlocked state illustrated in FIG. 29B.

On the central shaft of rotation of the locking operation lever 151 is fastened the front-side main reference pin 152 that is biased by the biasing force of a spring 154 toward the front side with respect to the imaging unit frame 101 of the imaging unit 100. Hence, when the locking operation lever 151 is in the unlocked state as illustrated in FIG. 29B, it is maintained protruded toward the front side from the imaging unit 100 by the biasing force of the spring 154. At that time, the front-side main reference pin 152 that is fastened to the locking operation lever 151 moves toward the front side and gets positioned away from the fitting hole formed on the main reference member 57*a* on the front side portion 50*a* of the cleaning module 50. Thus, when the locking operation lever 151 is turned to the unlocked state, the front-side main reference member 57*a* of the cleaning module 50 falls in the unlocked state with respect to the imaging unit 100.

In contrast, in the case of locking the front-side main reference member 57*a* of the cleaning module 50 with respect to the imaging unit 100, firstly, the operator presses the locking operation lever 151 against the biasing force of the spring 154 and moves it toward the rear side. Then, from that condition, the operator turns the locking operation lever 151 up to the locked state as illustrated in FIG. 29A and disengages the hand from the locking operation lever 151. With that, although the locking operation lever 151 is subjected to the biasing force toward the front side of the spring 154; the front end of a protrusion (not illustrated) of the locking operation lever 151, which is in the orientation of being turned to the locked state, hits a stopper (not illustrated) of the imaging unit 100. As a result, the locking operation lever 151 is maintained in the locked state. In order to prevent the locking operation lever 151 from turning toward the unlocked state illustrated in FIG. 29, the stopper has a restriction member that abuts against the protrusion of the locking operation lever 151 for the purpose of movement restriction. Meanwhile, at the time of turning the locking operation lever 151 toward the unlocked state, the operator slightly presses the locking operation lever 151 inside the imaging unit 100 against the biasing force of the spring 154. With that, the protrusion of the locking operation lever 151 can overleap the restriction member of the stopper. That enables the operator to turn the locking operation lever 151 toward the unlocked state.

Figure 30:
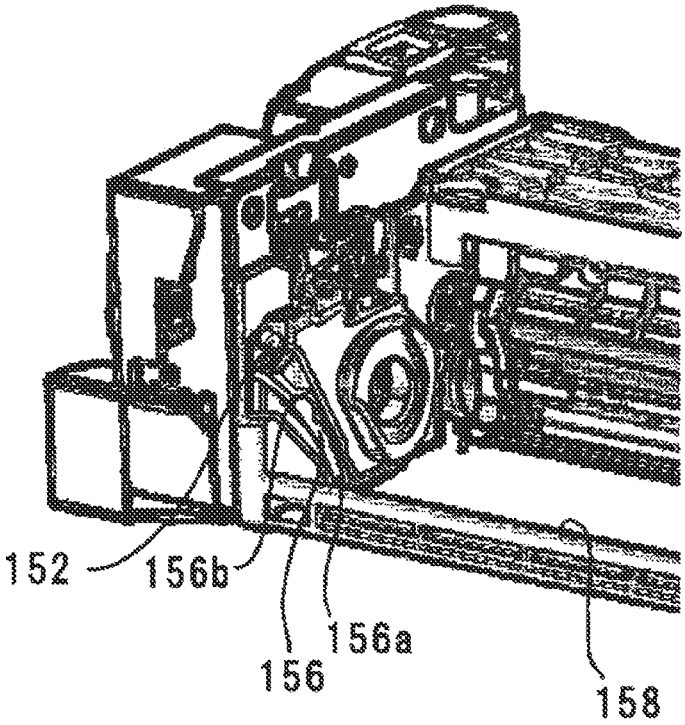
FIG. 30 is a perspective view when viewed from the inner wall on the front side portion of the imaging unit from which the cleaning module has been removed.

FIG. 30 is a perspective view when viewed from the inner wall on the front side portion of the imaging unit 100 from which the cleaning module 50 has been removed.

Figure 31:
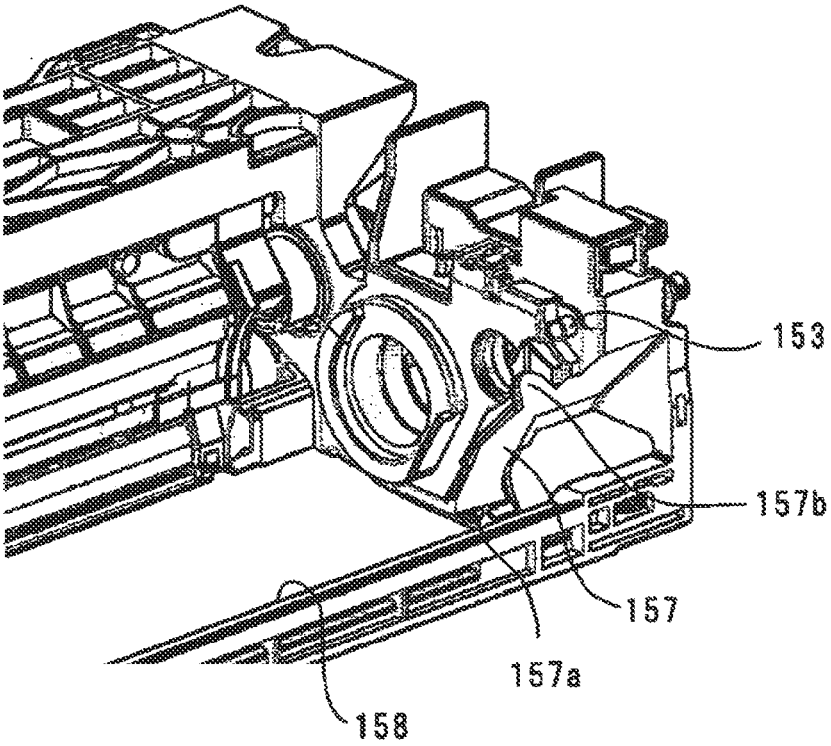
FIG. 31 is a perspective view when viewed from the inner wall on the rear side portion of the imaging unit from which the cleaning module has been removed.

FIG. 31 is a perspective view when viewed from the inner wall on the rear side portion of the imaging unit 100 from which the cleaning module 50 has been removed.

In FIGS. 30 and 31, although the cleaning module 50 has been removed from the imaging unit 100, for the purpose of explanation, the front-side main reference pin 152 and the rear-side main reference pin 153 are illustrated at the respective positions during the locked state of the cleaning module 50.

When the cleaning module 50 is attached to the imaging unit 100, the front-side sub-reference member 57*b* of the cleaning module 50 fits in the front-side sub-reference recess 156*a* formed on the lower end of a sub-reference guiding groove 156 that is formed on the inner wall on the front side portion of the imaging unit 100 as illustrated in FIG. 30. With that, the front-side sub-reference recess 156*a* restricts the front-side sub-reference member 57*b* from moving in any direction other than the direction along the sub-reference guiding groove 156. As a result, the front side portion 50*a* of the cleaning module 50 is restricted from moving in the direction of rotation around the main reference member 57*a*.

Moreover, as illustrated in FIG. 31, the rear-side sub-reference member 58*b* of the cleaning module 50 fits in the rear-side sub-reference recess 157*a* formed on the lower end of a sub-reference guiding upper wall 157 that is formed on the inner wall on the rear side portion of the imaging unit 100. With that, the rear-side sub-reference recess 157*a* restricts the rear-side sub-reference member 58*b* from moving in any direction other than the direction along the sub-reference guiding upper wall 157. As a result, the rear side portion 50*b* of the cleaning module 50 is restricted from moving in the direction of rotation around the main reference member 58*a*.

Figure 32A:
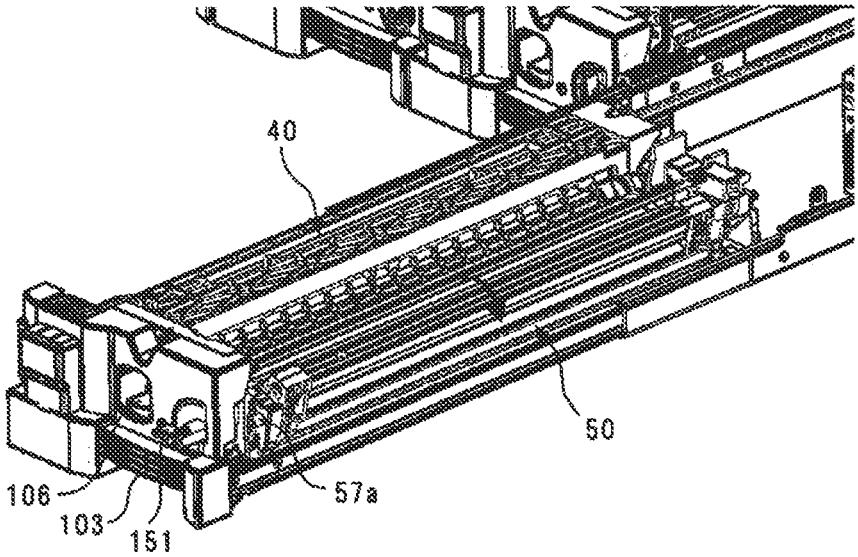
FIG. 32A and FIG. 32B are perspective views illustrating a condition at the time of removing the cleaning module from the imaging unit.
Figure 32B:
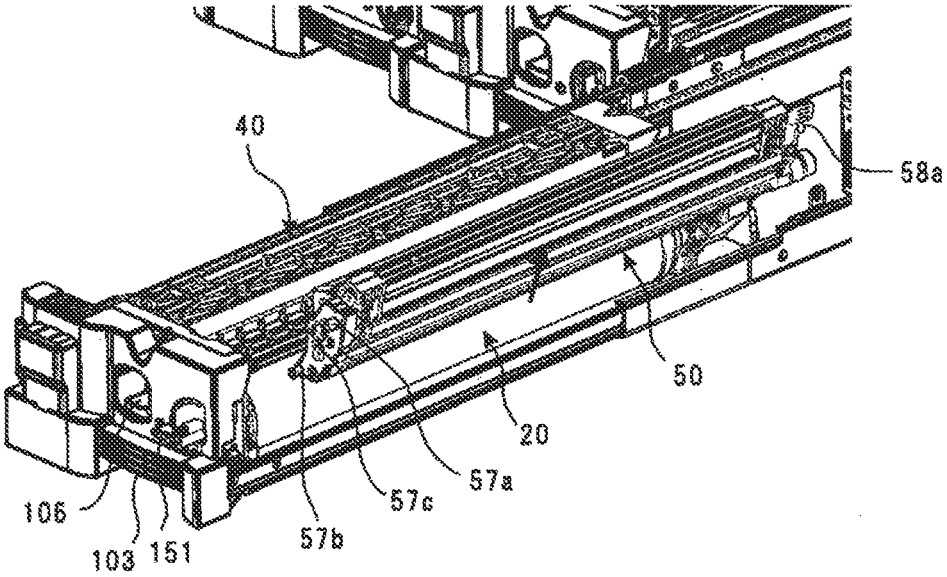

FIGS. 32A and 32B are perspective views for illustrating the condition at the time of removing the cleaning module 50 from the imaging unit 100.

Even if the operator turns the locking operation lever 151 up to the unlocked state thereby releasing the front side portion 50*a* of the cleaning module 50 from the locked state with respect to the imaging unit 100, the sub-reference members 57*b* and 58*b* of the cleaning module 50 are still locked in and supported by the sub-reference recesses 156*a* and 157*a*. Hence, the cleaning module 50 does not fall down from the imaging unit 100. In the present embodiment, after the main reference members 57*a* and 58*a* of the cleaning module 50 are released from the locked state, unless the cleaning module 50 is turned around the sub-reference members 57*b* and 58*b* by about 100° in the direction indicated by an arrow in FIG. 32A, the cleaning module 50 cannot be pulled out and removed from the imaging unit 100 as illustrated in FIG. 32B.

More particularly, at the time of attaching or detaching the cleaning module 50 with respect to the imaging unit 100; the cleaning blade 51, the lubricant agent applying brush 52, and the smoothing blade 53 that have the transfer residual toner or the lubricant agent attached thereto are exposed to the outside. While attaching or detecting the cleaning module 50, it suffers from some kind of a physical impact. Because of the impact, there are times when the transfer residual toner or the lubricant agent falls down. In case the transfer residual toner or the lubricant agent falls down on the imaging unit 100, then the same may get attached to the hands or the clothes of the operator during the replacement task. Moreover, the transfer residual toner or the lubricant agent may also fall down on the floor thereby making it dirty.

In this regard, in the present embodiment, the cleaning module 50 is configured to be removable from the imaging unit 100 in an attached-material anti-falling orientation in which the transfer residual toner or the lubricant agent attached to the cleaning blade 51, the lubricant agent applying brush 52, and the smoothing blade 53 falls inside the cabinets of the cleaning unit and the lubricant agent supplying unit of the cleaning module 50.

Figure 33A:
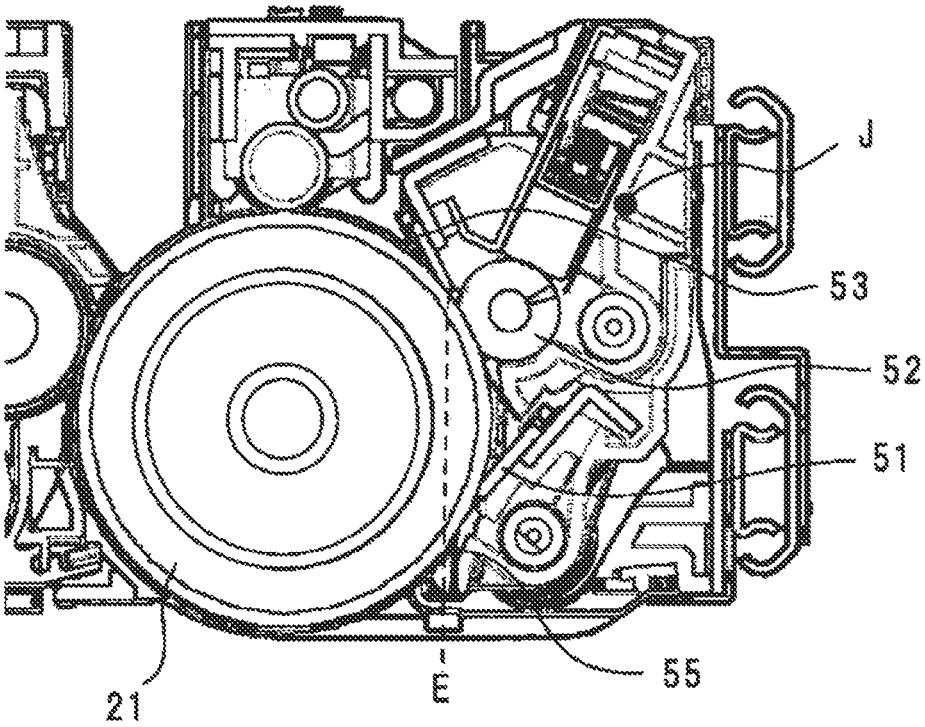
FIG. 33A is an explanatory diagram of a condition in which the cleaning module is positioned at the installation position in the imaging unit.

FIG. 33A is an explanatory diagram of a condition in which the cleaning module 50 is positioned at the installation position in the imaging unit 100.

Figure 33B:
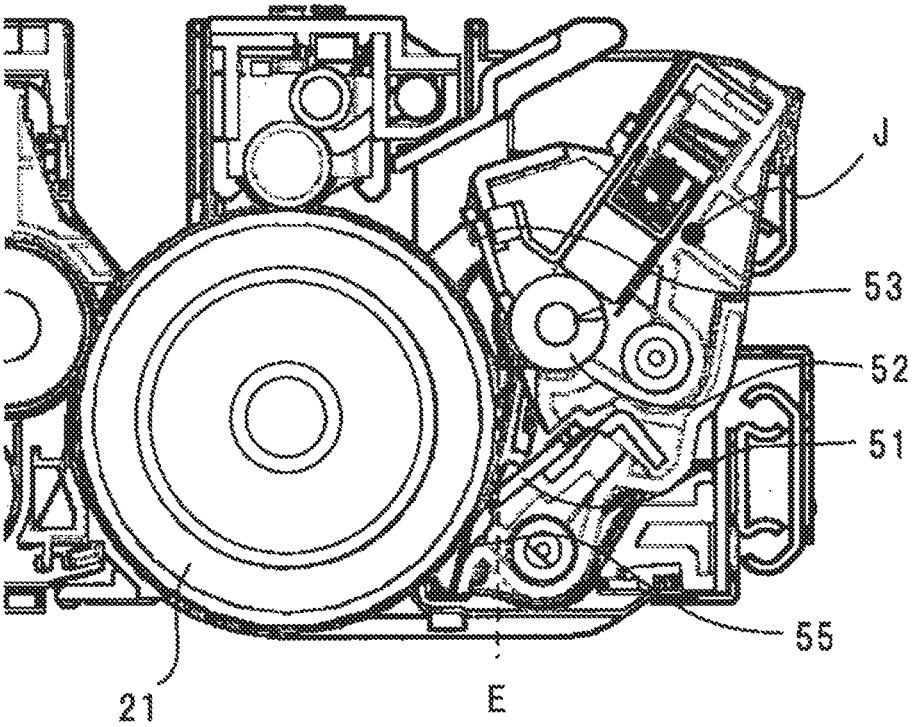
FIG. 33B is an explanatory diagram of a condition in which the cleaning module is turned for about 10° into an attached-material anti-falling orientation.

FIG. 33B is an explanatory diagram of a condition in which the cleaning module 50 is turned for about 10° into the attached-material anti-falling orientation.

In the present embodiment, when the cleaning module 50 is installed in the imaging unit 100, as illustrated in FIG. 33A, as compared to the position in the transverse direction of the lower end of the cleaning module opening (i.e., the upper end of the lower seal member 55) in the cleaning module 50, the positions in the transverse direction of the cleaning blade 51 and the lubricant agent applying brush 52 are more on the opposite side of the surface of the photosensitive member 21 (i.e., more on the side of the cleaning module 50). With that, the transfer residual toner or the lubricant agent attached to the cleaning blade 51 and the lubricant agent applying brush 52 can be dropped inside the cabinet of the cleaning module 50. However, regarding the smoothing blade 53, as illustrated in FIG. 33A, a position E in the transverse direction of the smoothing blade 53 is either located directly above the position in the transverse direction of the lower end of the cleaning module opening (i.e., the upper end of the lower seal member 55) in the cleaning module 50 or located more on the side of the photosensitive member 21 than the position in the transverse direction of the lower end of the cleaning module opening (i.e., the upper end of the lower seal member 55) in the cleaning module 50. That is, in the orientation of the cleaning module 50 being positioned at the installation position, the position E in the transverse direction of the smoothing blade 53 is located away from the inside of the cabinet of the cleaning module 50. Because of that, in the orientation of the cleaning module 50 being positioned at the installation position, if an attempt is made to remove the cleaning module 50 from the imaging unit 100, then the transfer residual toner or the lubricant agent attached to the smoothing blade 53 does not fall inside the cabinet of the cleaning module 50. That may cause the abovementioned problems.

Moreover, regarding the cleaning blade 51 and the lubricant agent applying brush 52 too, the positions thereof in the transverse direction are slightly shifted toward the inside of the cabinet of the cleaning module 50 with respect to the lower seal member 55. Because of that, in the orientation of the cleaning module 50 being positioned at the installation position, if an attempt is made to remove the cleaning module 50 from the imaging unit 100, then the transfer residual toner or the lubricant agent attached to the cleaning blade 51 and the lubricant agent applying brush 52 also falls away from the cabinet of the cleaning module 50. That may cause the abovementioned problems.

In that regard, in the present embodiment, the configuration is such that the cleaning module 50 is removed from the imaging unit 100 not when the cleaning module 50 being positioned at the installation position, but when the positions in the transverse direction of the cleaning blade 51, the lubricant agent applying brush 52, and the smoothing blade 53 are located on the inside of the cabinet of the cleaning module 50 (i.e., during the attached-material anti-falling orientation).

Figure 34A:
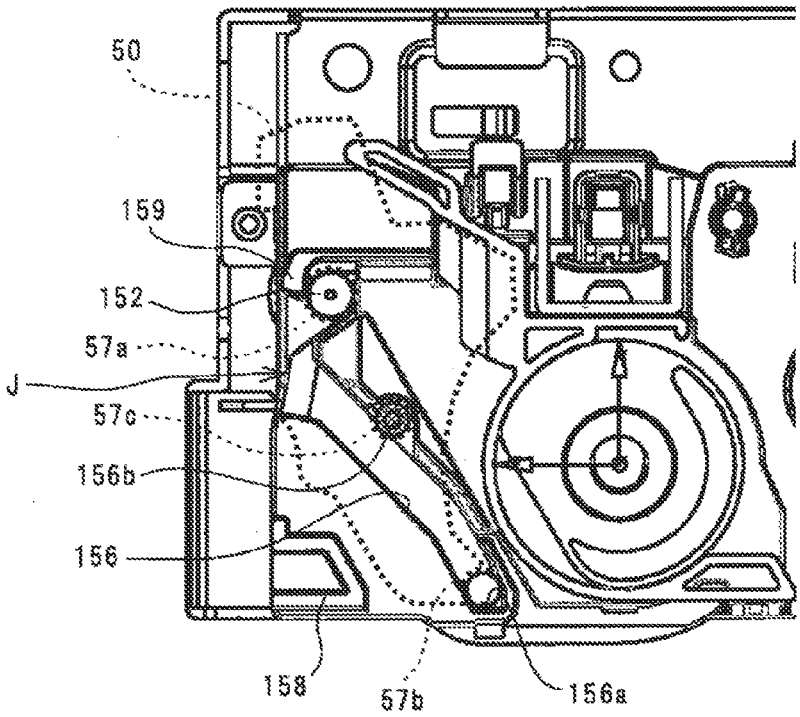
FIG. 34A is an explanatory diagram illustrating the inner face of the front side portion of the imaging unit for explaining a condition in which the cleaning module is positioned at the installation position thereof.

FIG. 34A is an explanatory diagram illustrating the inner face of the front side portion of the imaging unit 100 for explaining the condition in which the cleaning module 50 is positioned at the installation position.

Figure 34B:
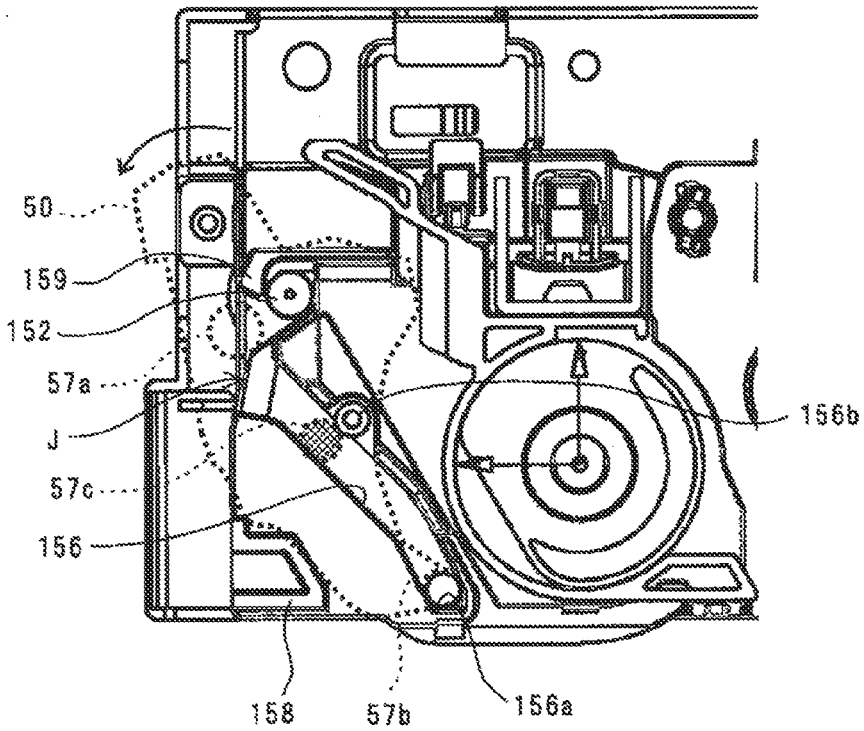
FIG. 34B is an explanatory diagram for explaining a condition in which the cleaning module is in the attached-material anti-falling orientation.

FIG. 34B is an explanatory diagram for explaining a condition in which the cleaning module 50 is in the attached-material anti-falling orientation.

Figure 35A:
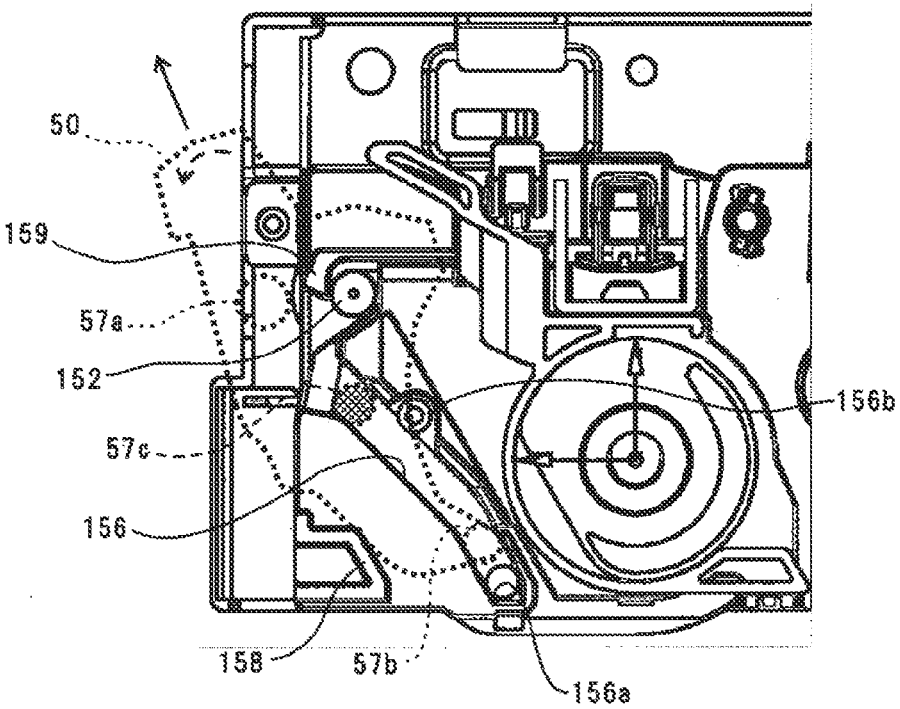
FIG. 35A and FIG. 35B are explanatory diagrams for explaining a condition in which the cleaning module in the attached-material anti-falling orientation is being removed obliquely upward from the imaging unit.
Figure 35B:
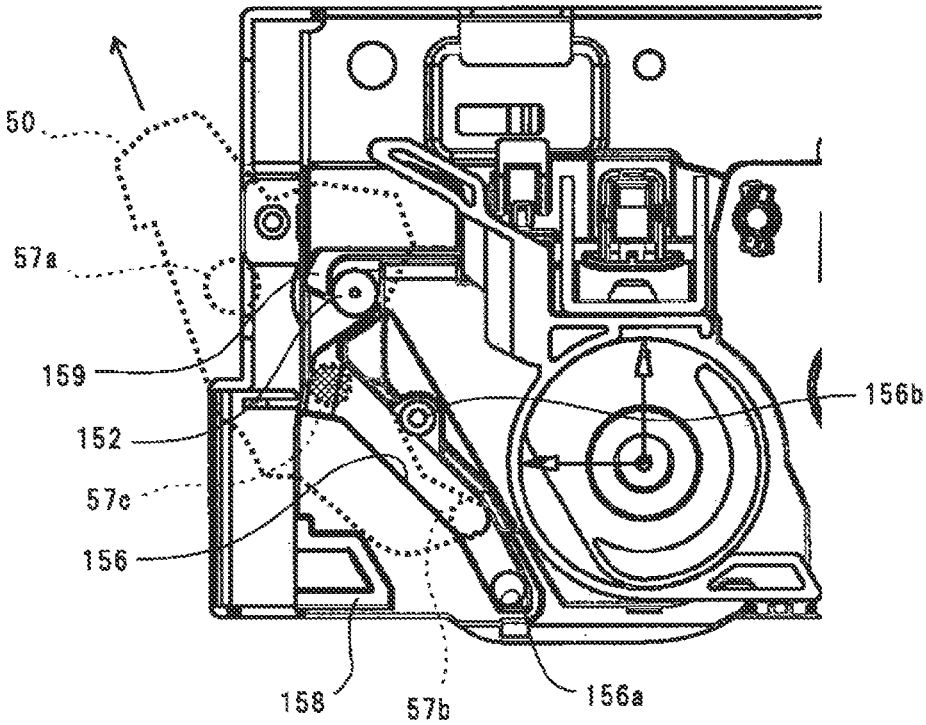

FIG. 35A and FIG. 35B are explanatory diagrams for explaining the condition in which the cleaning module 50 in the attached-material anti-falling orientation is being removed obliquely upward from the imaging unit 100.

In the present embodiment, when the operator turns the locking operation lever 151 up to the unlocked state thereby releasing the front side portion 50*a* of the cleaning module 50 from the locked state, the cleaning module 50 becomes rotatable around the sub-reference members 57*b* and 58*b* in the direction moving away from the photosensitive member 21. At that time, a gravity center J of the cleaning module 50, which is positioned at the installation position illustrated in FIG. 34A, has the position away from the photosensitive member 21 in the transverse direction as compared to the sub-reference members 57*b* and 58*b*. Hence, due to gravity, on the cleaning module 50 acts a force of rotation around the sub-reference members 57*b* and 58*b* in the direction moving away from the photosensitive member 21. Thus, as soon as the operator turns the locking operation lever 151 to release the cleaning module 50 from the locked state, the cleaning module 50 changes the orientation to the attached-material anti-falling orientation illustrated in FIG. 34B. However, in the present embodiment, once the cleaning module 50 turns for about 10°, a rotation preventing member 158 that is disposed in the imaging unit frame 101 of the imaging unit 100 prevents the cleaning module 50 from keep rotating. When the cleaning module 50 turns around the sub-reference members 57*b* and 58*b* for about 10°, the outer wall of the cleaning module 50 abuts against the rotation preventing member 158 and becomes unable to keep rotating. As a result, the cleaning module 50 is retained in the orientation at about 10° from the orientation at the installation position. Thus, the cleaning module 50 does not rotate excessively.

Moreover, in the present embodiment, in order to prevent pulling out of the cleaning module 50 from the installation position in the imaging unit 100, following configuration is implemented.

In the cleaning module 50, on the front side portion 50*a* is disposed a boss 57*c* as illustrated in FIG. 24; and on the rear side portion 50*b* is disposed a boss 58*c* as illustrated in FIG. 26. When the cleaning module 50 is positioned at the installation position, as illustrated in FIG. 34A, the front-side boss 57*c* enters into a boss recess 156*b* formed on the front-side sub-reference guiding groove 156 that is formed on the imaging unit frame 101 as illustrated in FIG. 30. Moreover, when the cleaning module 50 is positioned at the installation position, the rear-side boss 58*c* enters into the boss recess 156*b* formed on the sub-reference guiding upper wall 157 that is disposed on the imaging unit frame 101 as illustrated in FIG. 31. Thus, while the cleaning module 50 is in the orientation at the installation position, the bosses 57*c* and 58*c* get stuck in the boss recesses 156*b* and 157*b*, respectively, thereby preventing the cleaning module 50 from being pulled out. On the other hand, when the cleaning module 50 is turned around the sub-reference members 57*b* and 58*b* by about 10° into the attached-material anti-falling orientation illustrated in FIG. 34B, the bosses 57*c* and 58*c* get out of the boss recesses 156*b* and 157*b*, respectively, that are formed on the imaging unit frame 101. Because of that, the bosses 57*c* and 58*c* of the cleaning module 50 as well as the sub-reference members 57*b* and 58*b* become movable along the sub-reference guiding groove 156 and the sub-reference guiding upper wall 157. Consequently, as illustrated in FIGS. 35A and 35B, it becomes possible to remove the cleaning module 50 from the imaging unit 100 by pulling it out along the sub-reference guiding groove 156 and the sub-reference guiding upper wall 157.

Meanwhile, from the perspective of preventing the spilling of the transfer residual toner or the lubricant agent that is attached to the cleaning blade 51, the lubricant agent applying brush 52, and the smoothing blade 53; at the stage illustrated in FIG. 34B (i.e., at the stage immediately before starting to pull out the cleaning module 50), it is desirable to hold the cleaning module 50 in an orientation obtained by rotation of more than about 10° (i.e., in a more desirable attached-material anti-falling orientation). However, due to various restrictions such as the presence of the slide rails 105; in the present embodiment, the orientation at the stage illustrated in FIG. 34B cannot be changed to an orientation obtained by further rotation. There, in the present embodiment, while pulling out the cleaning module 50 from the imaging unit 100, the configuration enables gradual rotation of the cleaning module 50 around the sub-reference members 57*b* and 58*b* so as to obtain the more desirable attached-material anti-falling orientation.

More particularly, as illustrated in FIGS. 35A and 35B, the front-side sub-reference guiding groove 156, which his formed on the imaging unit frame 101 on the front side portion of the imaging unit 100, is formed to be like a greater-than sign. More particularly, the front-side sub-reference guiding groove 156 is so formed that the guiding direction of the upper portion thereof is closer to the horizontal direction than the guiding direction of the lower portion. Because of that, while pulling out the cleaning module 50 from the imaging unit 100, the front-side sub-reference member 57*b* of the cleaning module 50 is guided by the lower portion of the front-side sub-reference guiding groove 156, while the front-side boss 57*c* of the cleaning module 50 is guided by the upper portion of the front-side sub-reference guiding groove 156. In this way, since the front-side sub-reference member 57*b* and the front-side boss 57*c* of the cleaning module 50 are guided by portions having mutually different guiding directions, the cleaning module 50 is pulled out while being rotated. Hence, as illustrated in FIG. 35B, when the cleaning module 50 is pulled out to such a stage at which the front-side boss 57*c* thereof gets out of the front-side sub-reference guiding groove 156, the cleaning module 50 rotates further as compared to the orientation illustrated in FIG. 34B and gets into the more desirable attached-material anti-falling orientation.

In the present embodiment, as described above, as soon as the operator turns the locking operation lever 151 to unlock the cleaning module 50; due to the positional relationship between the gravity center J of the cleaning module 50 and the sub-reference members 57*b* and 58*b*, the cleaning module 50 changes the orientation from the orientation illustrated in FIG. 34A to the orientation illustrated in FIG. 34B. At that time, if the operator is not supporting the cleaning module 50 with hands, the outer wall of the cleaning module 50 collides with the rotation preventing member 158 of the imaging unit frame 101 and suffers from a large physical impact. Due to the large physical impact, the transfer residual toner or the lubricating agent that has attached to the cleaning blade 51, the lubricant agent applying brush 52, and the smoothing blade 53 gets stirred up and scattered.

Figure 36:
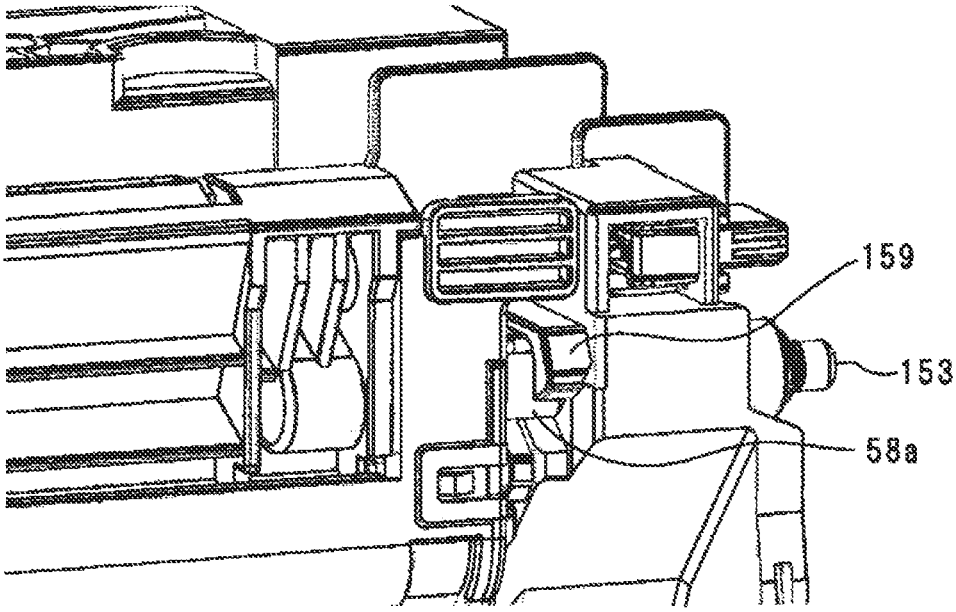
FIG. 36 is an enlarged perspective view of the surrounding portion of a rear-side main reference member disposed on the rear side portion of the cleaning module.

FIG. 36 is an enlarged perspective view of the surrounding portion of the rear-side main reference member 58*a* disposed on the rear side portion 50*b* of the cleaning module 50.

In the present embodiment, a hook member 159 is disposed on the imaging unit frame 101 for the purpose of tentative positioning of the rear-side main reference member 58*a* of the cleaning module 50 when the cleaning module 50 is positioned at the installation position inside the imaging unit 100. Moreover, although not illustrated, an identical hook member is disposed on the imaging unit frame 101 of the imaging unit 100 for the purpose of tentative positioning of the front-side main reference member 57*a* of the cleaning module 50. The hook member 159 is a substantially L-shaped member having an arm, which extends substantially horizontally in the direction away from the photosensitive member 21 from a fixed end that is fixed to the imaging unit frame 101, and having a stopper, which bends downward at the tip of the arm. When the cleaning module 50 is positioned at the installation position, the rear-side main reference member 58*a* of the cleaning module 50 gets stuck at the stopper of the hook member 159. At the same time, the front-side main reference member 57*a* of the cleaning module 50 also gets stuck at the stopper of the corresponding hook member (not illustrated). For that reason, even in case the operator unlocks the cleaning module 50 without supporting it with hands, the cleaning module 50 is retained at the installation position due to the hook member 159. As a result, the cleaning module 50 can be spared from being subjected to the physical impact at the time of unlocking.

At the time of removing the cleaning module 50, which has been unlocked, from the imaging unit 100; the operator holds suitable places on the front side portion 50*a* and the rear side portion 50*b* of the cleaning module 50 and applies a force to change the orientation of the cleaning module 50 from the orientation illustrated in FIG. 34A to the orientation illustrated in FIG. 34B. That is, the operator applies a force in the direction of rotating the cleaning module 50 around the sub-reference members 57*b* and 58*b*. Due to that force, the main reference members 57*a* and 58*a* move and cause a bend in the arm of the hook member 159. Because of that, the stopper of the hook member 159 is lifted so that the main reference members 57*a* and 58*a* are released from being tentatively positioned by the hook member 159.

Given below is the explanation regarding the photosensitive module 20 installed on the imaging unit 100.

Figure 37A:
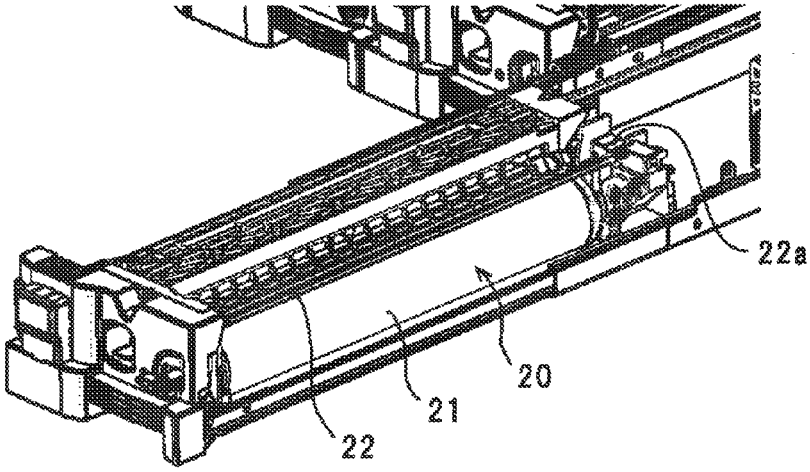
FIGS. 37A to 37C are explanatory diagrams for explaining a condition when a photosensitive module according to the embodiment is removed from the imaging unit.
Figure 37B:
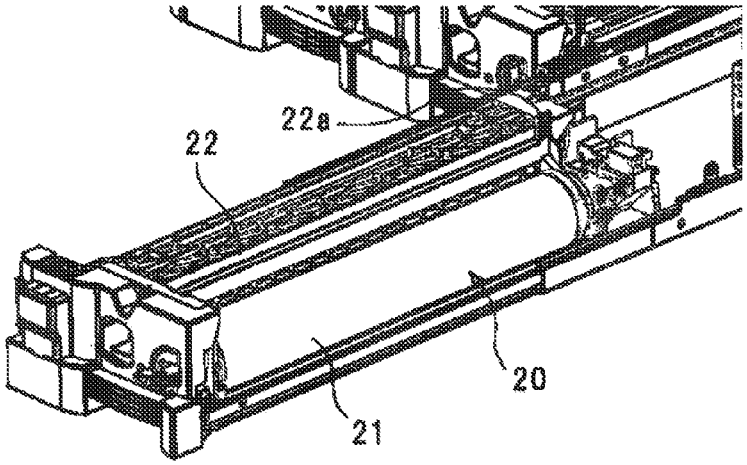
Figure 37C:
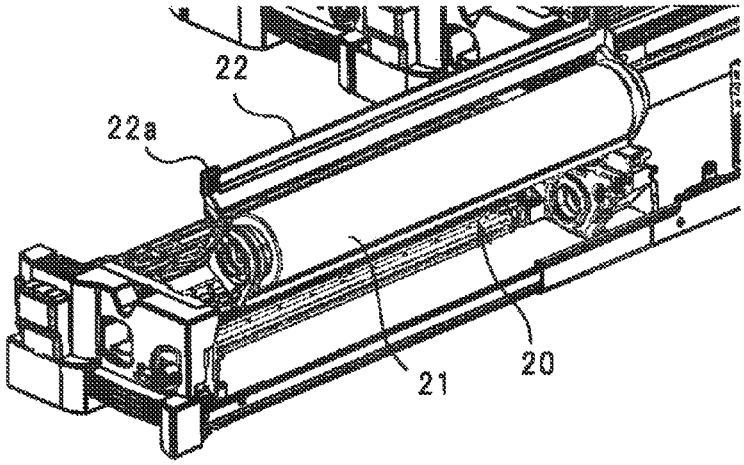

FIGS. 37A to 37C are explanatory diagrams illustrating the condition at the time of removing the photosensitive module 20 from the imaging unit 100.

When removing the photosensitive module 20 from the imaging unit 100, firstly, the operator needs to remove the charging module 30 and the cleaning module 50 from the imaging unit 100. For that reason, the task of replacing the photosensitive module 20 increases the burden on the operator. However, on the other hand, since the photosensitive module 20 requires a higher positioning accuracy among the replacement modules mounted on the imaging unit 100, the cumbersome task of replacing the photosensitive module 20 is beneficial in restricting undue attachment and detachment thereof with respect to the imaging unit 100. Moreover, considering the facts that a damage to the surface of the photosensitive member 21 in the photosensitive module 20 considerably affects the image quality and that the photosensitive module 20 is more expensive as compared to the other replacement modules, it is desirable to restrict undue attachment and detachment of the photosensitive module 20 with respect to the imaging unit 100, even if it means an increase in the burden during the task of replacing the photosensitive module 20.

However, in the present embodiment, the burden during the task of replacing the photosensitive module 20 is reduced by implementing the following method.

In the present embodiment, as compared to the replacement span of the photosensitive module 20 that cannot be replaced unless the other replacement modules are removed from the imaging unit 100; the charging module 30 and the cleaning module 50 that can be replaced while being positioned at the installation positions are configured to have shorter replacement spans. More particularly, in terms of the number of sheets subjected to image formation, the charging module 30 and the cleaning module 50 are configured to have the replacement spans of 300 thousand sheets. In comparison, in terms of the number of sheets subjected to image formation, the photosensitive module 20 is configured to have the replacement span of 1.2 million sheets. Such replacement spans of the replacement modules 20, 30, and 50 can be appropriately adjusted by means of selecting the material, devising a control method, or implementing a known method. In the present embodiment, the least common multiple of the replacement spans (in terms of the number of sheets subjected to image formation, same hereinafter) of all the replacement modules 20, 30, and 50 installed on the imaging unit 100 is 1.2 million, which is identical to the replacement span of 1.2 million of the photosensitive module 20 as the longest replacement span among the replacement spans of the replacement modules 20, 30, and 50. Hence, as long as there is no malfunctioning during the mechanical life, the timing of replacement for the photosensitive module 20 matches with the timing of replacement for the other replacement modules 30 and 50. Thus, in the present embodiment, although the other replacement modules 30 and 50 need to be removed to enable replacement of the photosensitive module 20, having the same timing of replacement for all the modules makes it possible to reduce the actual burden on the operator.

Besides, by having the same timing of replacement, all the replacement modules 20, 30, and 50 can be replaced during a single replacement task. Hence, as compared to the case of replacing each of the replacement modules 20, 30, and 50 at a different point of time, the total downtime against image formation can be reduced.

Moreover, in the present embodiment, the charging module 30 and the cleaning module 50 are configured to be replaceable even while the other replacement modules remain installed in the imaging unit 100. That also enables achieving reduction in the burden while replacing the replacement modules 30 and 50 having a high replacement frequency.

Furthermore, in the present embodiment, the charging module 30 and the cleaning module 50 are configured to have the same replacement span. Thus, as long as there is no malfunctioning during the mechanical life, the charging module 30 and the cleaning module 50 need to be replaced at the same time. That is, both the charging module 30 and the cleaning module 50 can be replaced during a single replacement task. Hence, as compared to the case of replacing each of the replacement modules 30 and 50 at a different point of time, the total downtime against image formation can be reduced.

Once the charging module 30 and the cleaning module 50 are removed from the imaging unit 100, in order to remove the photosensitive module 20 from the imaging unit 100, the operator holds a knob 22*a* of a photosensitive module frame 22, which serves as a partition between the charging module 30 and the cleaning module 50, and turns the photosensitive module frame 22 from a locked state illustrated in FIG. 37A to an unlocked state illustrated in FIG. 37B. Once the photosensitive module frame 22 is turned to the unlocked state, it becomes possible to lift the photosensitive module 20 obliquely upward in the direction away from the developing device 40 as illustrated in FIG. 37C.

Figure 38:
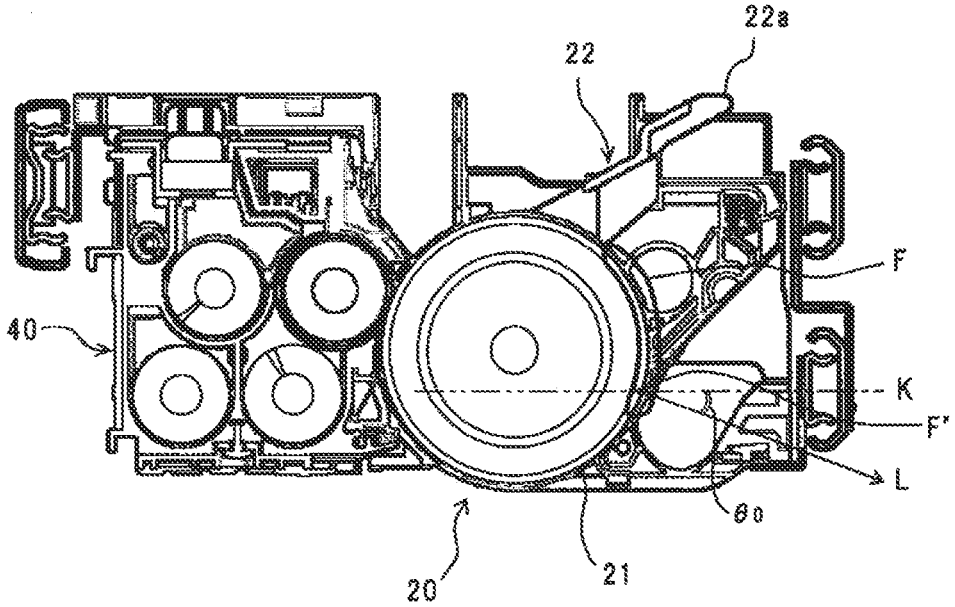
FIG. 38 is an explanatory diagram illustrating the position of a surface portion, on the surface of the photosensitive member in a locked state, that has been facing the cleaning module and that has a large quantity of the toner or the lubricant agent attached thereto.

In the present embodiment, as illustrated in FIG. 38, of the surface of the photosensitive member 21, a surface portion F that has been facing the cleaning module 50 has a large quantity of the toner or the lubricant agent attached thereto. That happens because, for example, the transfer residual toner or the lubricant agent that was accumulated by being blocked at the contact portions between the surface of the photosensitive member 21 and the cleaning blade 51, the lubricant agent applying brush 52, and the smoothing blade 53 gets attached to the surface of the photosensitive member 21 at the time of removing the cleaning module 50. In the present embodiment, the cleaning blade 51 of the cleaning module 50 abuts in the substantially horizontal direction against the surface of the photosensitive member 21. Thus, when the cleaning module 50 is removed, the toner or the lubricant agent on the cleaning module 50 gets attached to the side of the surface of the photosensitive member 21. As a result, in case the photosensitive module 20 in such an orientation is removed from the imaging unit 100, the vibrations during the task of removing it cause the toner or the lubricant agent to fall down from the surface of the photosensitive member 21. Particularly, in a blade abutting portion F' over which the cleaning blade 51 was abutting, the toner or the lubricant agent gets attached in a condensed form. Due to slight vibrations during the task of removing the cleaning module 50, the toner or the lubricant agent in a condensed form easily falls down from the surface of the photosensitive member 21.

In that regard, in the present embodiment, the photosensitive module 20 is configured in such a way that, when the photosensitive module frame 22 is turned from the locked state illustrated in FIG. 37A to the unlocked state illustrated in FIG. 37B, the photosensitive member 21 also rotates. More particularly, the photosensitive module 20 has a spring attached thereto that, when the imaging unit 100 is positioned at the installation position, gives the photosensitive member 21 a biasing force to make the rear side end face of the photosensitive member 21 abut against an opposite face on the rear side end face of the photosensitive module frame 22 (i.e., abut against the inside face of a rear side portion 22 of the photosensitive module frame 22). With that, when the imaging unit 100 is positioned at the replacement enabling position, the photosensitive module frame 22 and the photosensitive member 21 fall into an integrally-rotatable coupled state. On the other hand, when the imaging unit 100 is positioned at the installation position; then, as illustrated in FIG. 9, the photosensitive member drive joint 223 on the photosensitive member drive shaft 221 and the joint target member 21*b* on the photosensitive member 21 get coupled from the direction of the rotary shaft of the photosensitive member 21. As a result, the photosensitive member 21 gets displaced against the abovementioned biasing force and in the direction away from the rear side portion 22 of the photosensitive module frame 22, and falls in an uncoupled state in which it can rotate independent of the photosensitive module frame 22. On the rear side portion 22 of the photosensitive module frame 22 is formed a bearing eye for slidable bearing of the periphery of the joint target member 21*b* on the photosensitive member 21. At the time of driving the photosensitive member 21, the joint target member 21*b* on the photosensitive member 21 rotates and slidably bears on the bearing eye formed on the photosensitive module frame 22. In the condition in which the imaging unit 100 is pulled out from the main body of the image forming apparatus up to the replacement enabling position, the photosensitive member drive shaft 221 is drawn out of the insertion hole 21*a* formed on the photosensitive member 21. Hence, the photosensitive member 21 becomes free to rotate. At that time, as described above, the biasing force of the spring disposed on the photosensitive module 20 causes the rear side portion of the photosensitive member 21 to abut against the photosensitive module frame 22, and the photosensitive module frame 22 and the photosensitive member 21 fall into an integrally-rotatable coupled state. In this condition, if the photosensitive module frame 22 is rotated from the locked state illustrated in FIG. 37A to the unlocked state illustrated in FIG. 37B, the photosensitive member 21 also rotates.

Figure 39:
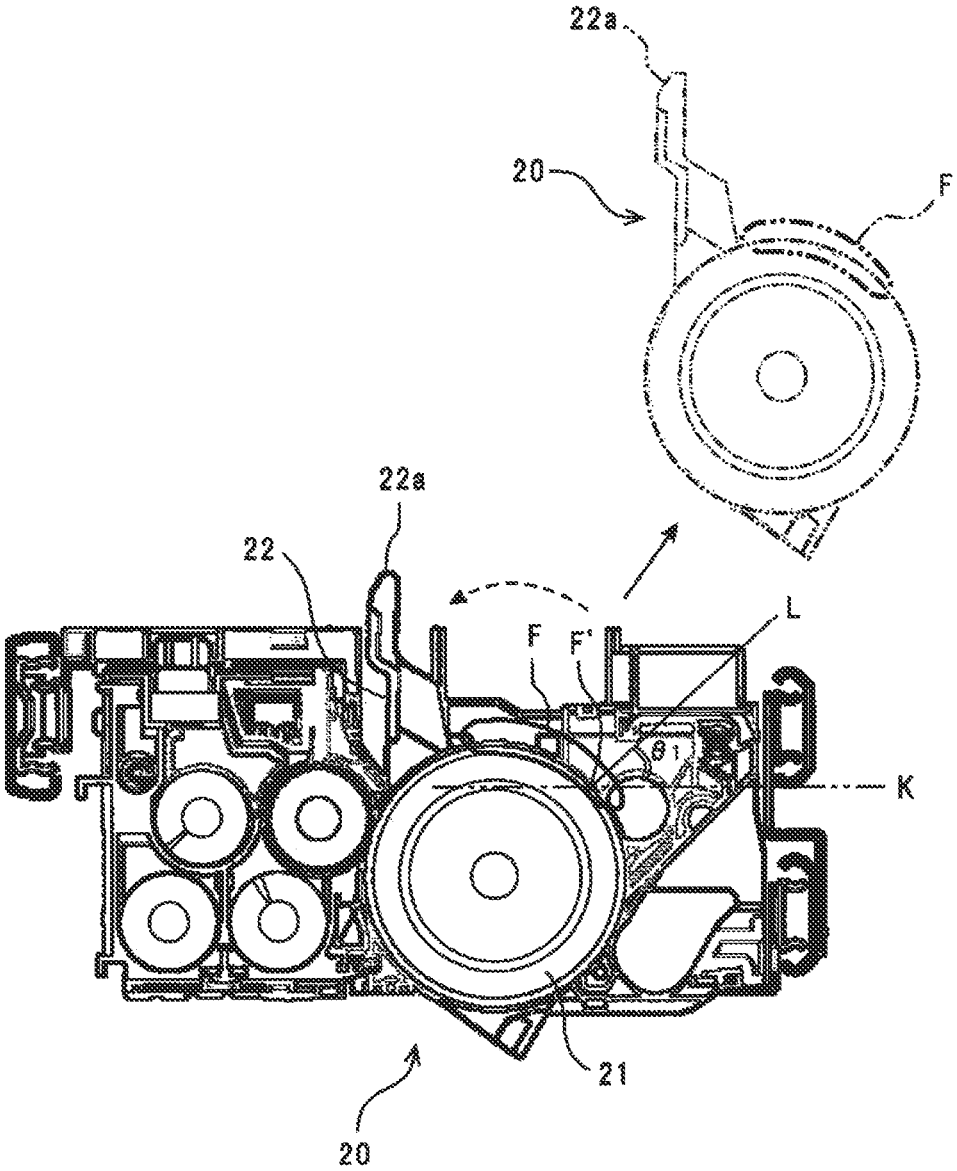
FIG. 39 is an explanatory diagram illustrating the position of a surface portion, on the surface of the photosensitive member in an unlocked state, that has been facing the cleaning module and that has a large quantity of the toner or the lubricant agent attached thereto.

Hence, when the photosensitive module frame 22 is rotated from the locked state illustrated in FIG. 37A to the unlocked state illustrated in FIG. 37B, the photosensitive member surface portion F that was facing the cleaning module 50 changes the orientation from the transverse orientation illustrated in FIG. 38 to the upward orientation illustrated in FIG. 39. More particularly, in the condition illustrated in FIG. 38; a normal line L, which oriented outward from the blade abutting portion F' of the photosensitive member 21 over which the cleaning blade 51 was abutting, makes an angle $\theta_0$ of about −15° with a horizontal plane K which passes through the cleaning-module-facing surface portion F'. In contrast, in the condition illustrated in FIG. 39, the normal line L and the horizontal plane K form an angle $\theta_1$ of about +45°. Thus, the angle $\theta_1$ is an acute angle defined to have a positive value when the normal line L lies on the upper side of the horizontal plane K and defined to have a negative value when the normal line L lies on the lower side of the horizontal plane K. While viewing the photosensitive member 21 from the direction of the rotary shaft thereof as illustrated in FIG. 38 or FIG. 39, when four quadrants are defined by means of defining a horizontal plane and a vertical plane through which passes the rotary shaft of the photosensitive member 21; the abovementioned angle lies in the range of 0° to +90° when the blade abutting portion F' is positioned in an upper right-hand first quadrant, lies in the range of 0° to +90° when the blade abutting portion F' is positioned in an upper left-hand second quadrant, lies in the range of 0° to −90° when the blade abutting portion F' is positioned in a lower left-hand third first quadrant, and lies in the range of 0° to −90° when the blade abutting portion F' is positioned in a lower right-hand fourth quadrant.

In the present embodiment, the configuration is such that, once the photosensitive module frame 22 is rotated up to the unlocked state illustrated in FIG. 37B, the photosensitive module 20 can be removed from the imaging unit 100 only when it is pulled out from the imaging unit 100 without changing the abovementioned obliquely upward orientation as illustrated in FIG. 37C or as indicated by an arrow in FIG. 39. Thus, according to the present embodiment, while the operator removes the photosensitive module 20 from the imaging unit 100; the surface portion F, which has a large quantity of the toner or the lubricant agent attached thereto, is maintained in the upward orientation as illustration in FIG. 39.

FIGS. 40A to 40D are explanatory diagrams for explaining a positional relationship, at the time of turning the photosensitive module frame 22 from the locked state to the unlocked state, between a coupling member 23 disposed on the front side portion of the photosensitive module 20 and a coupling target member 121 disposed on the imaging unit frame 101.

Meanwhile, an identical lock mechanism is also configured on the rear side portion of the photosensitive module 20. However, in the following explanation with reference to FIGS. 40A to 40D, only the lock mechanism on the front side portion of the photosensitive module 20 is explained.

Figure 40A:
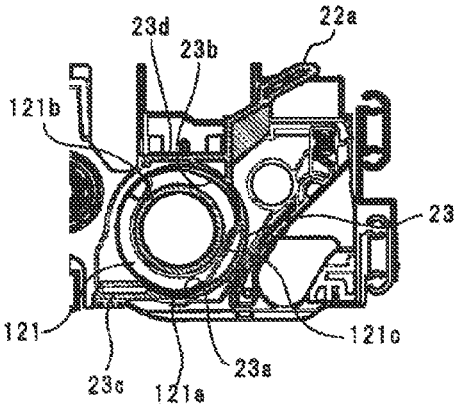
FIGS. 40A to 40D are explanatory diagrams for explaining a positional relationship, at the time of turning a photosensitive module frame of the photosensitive module from the locked state to the unlocked state, between a coupling member disposed on the front side portion of the photosensitive module and a coupling target member disposed on an imaging unit frame.

The coupling member 23 disposed on the front side portion of the photosensitive module 20 is integrally molded with the photosensitive module frame 22, and is rotatable around the rotary shaft of the photosensitive member 21 along the photosensitive module frame 22. When the photosensitive module 20 is installed in the imaging unit 100; as illustrated in FIG. 40A, the coupling member 23 disposed on the front side portion of the photosensitive module 20 gets coupled with the coupling target member 121 disposed on the inner wall of the imaging unit frame 101 on the front side portion of the imaging unit 100. Once the photosensitive module 20 is installed in the imaging unit 100, two circular arc portions 121*a* and 121*b* of the coupling target member 121 disposed on the imaging unit frame 101 abut against two circular arc portions 23*a* and 23*b*, respectively, of the coupling member 23 disposed on the photosensitive module 20. With that, the photosensitive module 20 gets locked with respect to the imaging unit frame 101 of the imaging unit 100. Moreover, positioning in the vertical direction and in the transverse direction of the photosensitive module 20 is achieved.

Figure 40B:
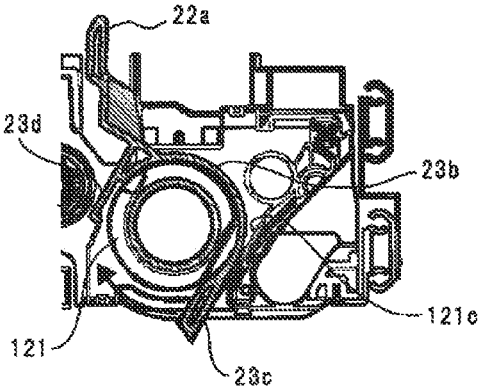
Figure 40C:
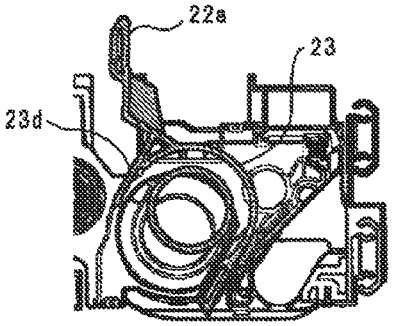
Figure 40D:
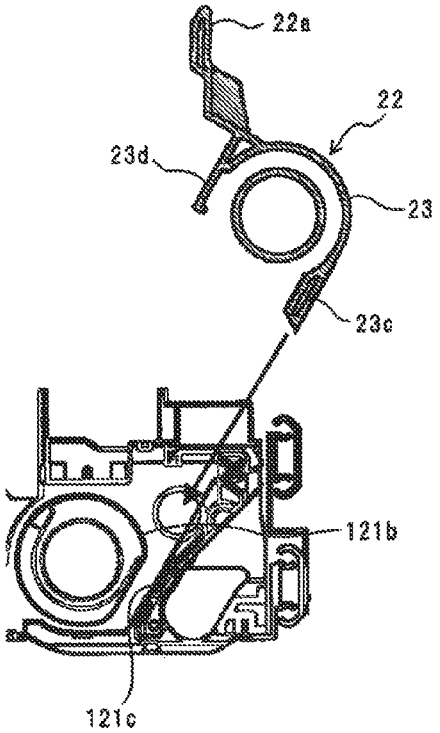

When the photosensitive module frame 22 is rotated from the locked state illustrated in FIG. 40A to the unlocked state illustrated in FIG. 40B, the coupling member 23 that is integrally molded with the photosensitive module frame 22 also rotates. On the coupling target member 121 of the imaging unit frame 101, a guiding groove 121*c* is formed that linearly extends along the direction of pulling out the photosensitive module 20 (i.e., along the obliquely upward direction). The width of the guiding groove 121*c* is set to be slightly greater than the width of a guiding target member 23*c* present on the coupling member 23 in the photosensitive module 20. The guiding target member 23*c* is an elongated and linear member along the direction of pulling out the photosensitive module 20 (i.e., along the obliquely upward direction) when the photosensitive module frame 22 is in the orientation of the unlocked state as illustrated in FIG. 40B. Once the photosensitive module frame 22 is in the orientation of the unlocked state, the elongated direction of the guiding target member 23*c* in the photosensitive module 20 matches with the groove direction of the guiding groove 121*c* in the imaging unit 100 as illustrated in FIG. 40B. Therefore, it becomes possible to lift the photosensitive module frame 22 obliquely upward along the groove direction of the guiding groove 121*c*. Thus, by lifting the photosensitive module frame 22 obliquely upward along the groove direction of the guiding groove 121*c*, the operator can remove the photosensitive module 20 from the imaging unit 100 as illustrated in FIGS. 40C and 40D.

Meanwhile, in order to attach the photosensitive module 20 to the imaging unit 100, the sequence opposite to the abovementioned sequence of removing the photosensitive module 20 can be followed. Thus, while attaching the photosensitive module 20 to the imaging unit 100, at the inlet of the guiding groove 121*c* of the imaging unit 100 in which is inserted the guiding target member 23*c* of the photosensitive module 20, the circular arc portion 121*b* is coupled to that guiding wall of the guiding groove 121*c* which is close to the rotary shaft of the photosensitive member 21. Thus, the inlet of the guiding groove 121*c* happens to have a tapering shape toward the direction of insertion of the guiding target member 23*c*. That enables smooth guiding of the guiding target member 23*c* into the guiding groove 121*c*.

Moreover, while attaching the photosensitive module 20 to the imaging unit 100, at the stage before the photosensitive module 20 entirely gets into the position illustrated in FIG. 40B, the photosensitive module frame 22 cannot be rotated toward the locked state illustrated in FIG. 40A. More particularly, as illustrated in FIG. 40C, when the guiding target member 23*c* of the photosensitive module 20 is midway into the guiding groove 121*c* of the imaging unit 100; even if an attempt is made to rotate the photosensitive module frame 22, the guiding target member 23*c* abuts against the inner wall of the guiding groove 121*c* thereby restricting the rotation of the photosensitive module frame 22. Once the photosensitive module 20 entirely gets into the position illustrated in FIG. 40B, the guiding target member 23*c* comes out of the guiding groove 121*c* in entirety. Hence, when an attempt is made to rotate the photosensitive module frame 22, the guiding target member 23*c* does not abut against the guiding groove 121*c* thereby enabling the photosensitive module frame 22 to rotate.

Figure 41:
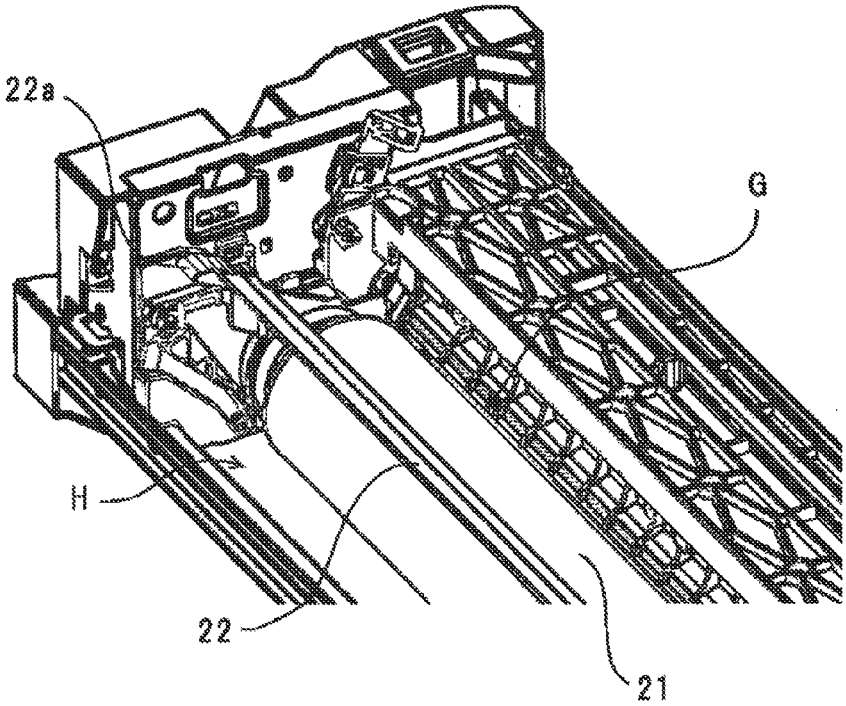
FIG. 41 is an explanatory diagram illustrating a condition in which, when the photosensitive module is in the locked state, the photosensitive module frame definitely partitions the space inside the imaging unit into a charging module space and a cleaning module space.

Moreover, in the present embodiment, when attaching the photosensitive module 20 to the imaging unit 100 is followed by setting the photosensitive module frame 22 to the locked state illustrated in FIG. 40A; then, as illustrated in FIG. 41, the photosensitive module frame 22 definitely partitions the space inside the imaging unit 100 into two spaces, namely, a charging module space G and a cleaning module space H. Thus, while attaching the charging module 30 and the cleaning module 50 to the imaging unit 100, the operator does not have to worry much about the locations for attaching those modules. That helps in enhancing the user-friendliness.

Figure 42:
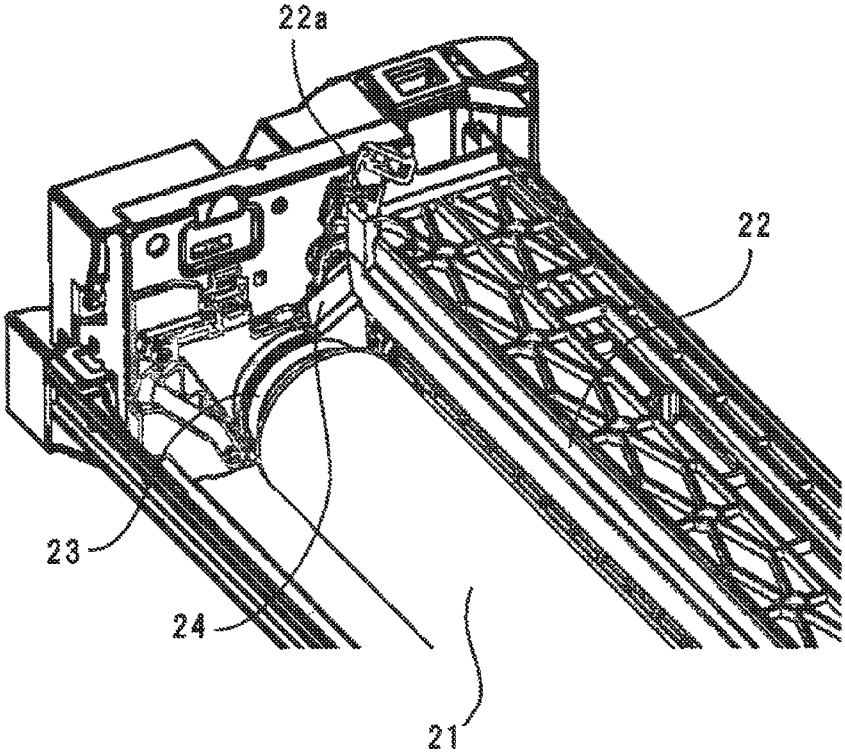
FIG. 42 is an explanatory diagram illustrating a faulty installation preventing protrusion disposed on photosensitive module frame of the photosensitive module.
Figure 43:
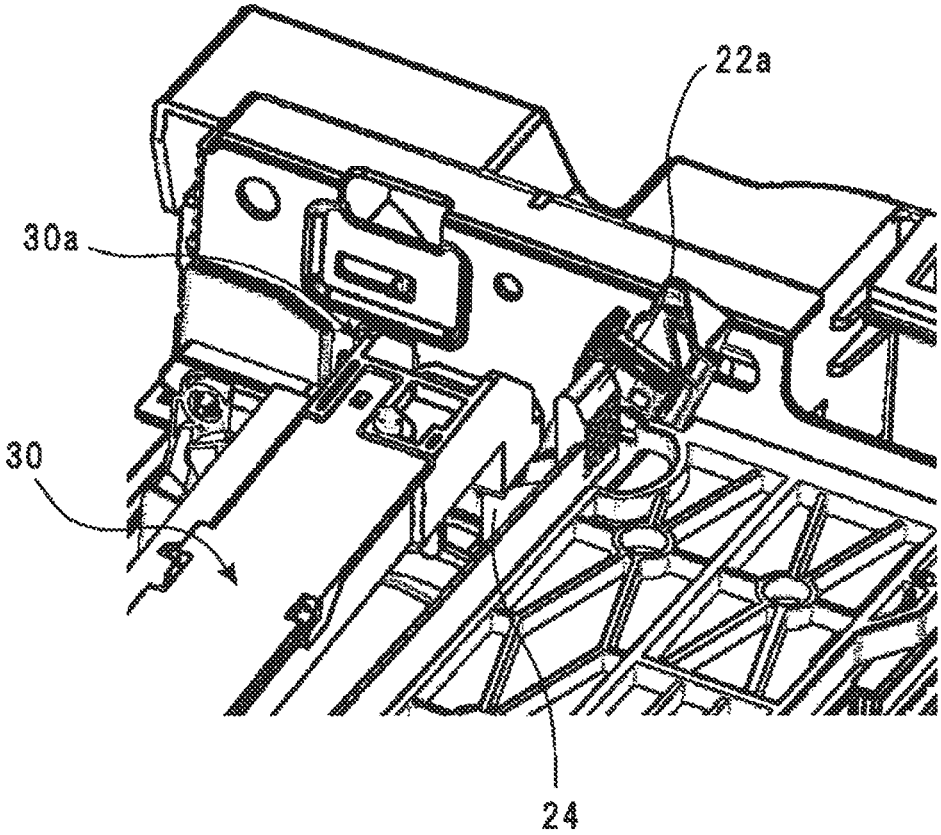
FIG. 43 is an explanatory diagram illustrating a condition when the charging module cannot be installed due to the faulty installation preventing protrusion.

Furthermore, in the present embodiment, when the photosensitive module 20 is not in the locked state with respect to the imaging unit 100, that is, when the photosensitive module frame 22 is in the unlocked state as illustrated in FIG. 40B; the imaging unit 100 is prevented from being pressed inward in the main body of the image forming apparatus. More particularly, as illustrated in FIG. 42, a faulty installation preventing protrusion 24 is disposed on the photosensitive module frame 22 of the photosensitive module 20. When the photosensitive module frame 22 is in the unlocked state as illustrated in FIG. 42, the faulty installation preventing protrusion 24 is so positioned that the front side portion 30*a* of the charging module 30 is prevented from resting on the positioning base 137. In that condition, if an attempt is made to install the charging module 30 in the imaging unit 100; then, as illustrated in FIG. 43, the front side portion 30*a* of the charging module 30 gets stuck against the faulty installation preventing protrusion 24 and cannot rest on the positioning base 137. Hence, the charging module 30 cannot be installed in the imaging unit 100. That makes the operator realize that the photosensitive module 20 is not in the locked state.

In the present embodiment, regarding the replacement modules 20, 30, and 50 that are to be mounted on the imaging unit 100, as far as switching between the locked state and the unlocked state of those modules with respect to the imaging unit frame 101 is concerned, the configuration is such that the operator needs to operate only the charging module lock member 131 of the charging module 30, the locking operation lever 151 of the cleaning module 50, and the knob 22*a* on the photosensitive module frame 22 of the photosensitive module 20. Thus, the operator need not use any other tool such as a driver.

Modification Example

Explained below is a modification example of the photosensitive module according to the present embodiment.

In the present modification example, FIGS. 44A to 44D are explanatory diagrams for explaining a positional relationship, at the time of turning the photosensitive module frame 22 from the locked state to the unlocked state, between the coupling member 23 disposed on the front side portion of the photosensitive module 20 and the coupling target member 121 disposed on the imaging unit frame 101.

According to the present modification example, except for the fact that a knob 122*a* that serves as a holding member for the operator to hold at the time of removing the photosensitive module 20 from the imaging unit 100 has a different shape, the photosensitive module 20 has the same configuration as the configuration of the photosensitive module 20 according to the abovementioned embodiment. Thus, only the explanation regarding the knob 122*a* is given below, and the remaining configuration is not explained again.

Figure 45A:
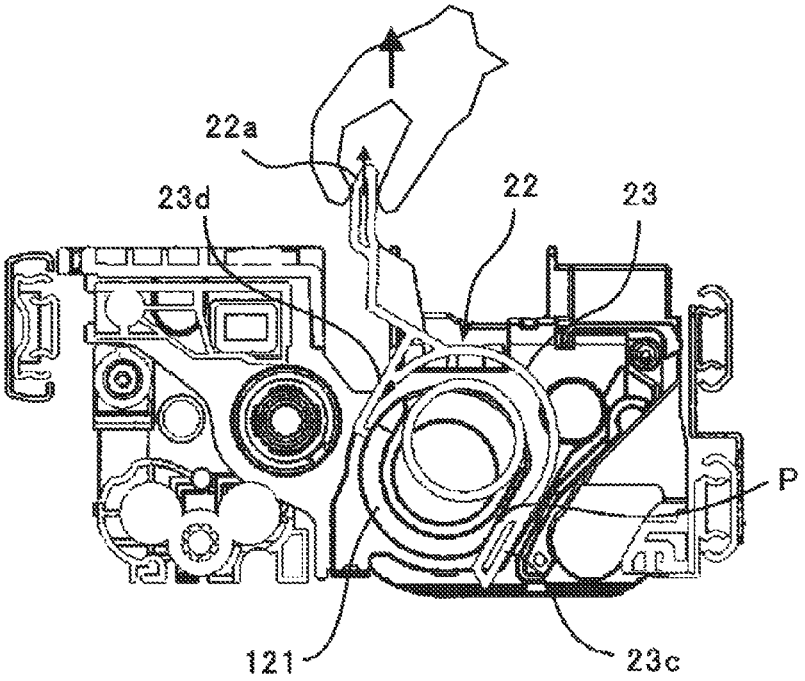
FIGS. 45A and 45B are explanatory diagrams for explaining the task of pulling out the photosensitive module according to the embodiment.

The weight of the photosensitive member 21 accounts for the majority of the weight of the photosensitive module 20. Hence, when viewed from the axial direction of the photosensitive member 21 (i.e., when viewed in the direction of the plane of paper of the drawings), the position of the center of gravity of the photosensitive module 20 is roughly at the position of the rotary shaft of the photosensitive member 21 (actually, at a position shifted slightly on the left side with reference to the drawings as compared to the rotary shaft of the photosensitive member 21). In the case of the photosensitive module 20 according to the abovementioned embodiment, as illustrated in FIG. 40B, when the photosensitive module frame 22 is rotated to the unlocked state (at the time of removing the photosensitive module 20 from the imaging unit 100), the position in the horizontal direction of the knob 22*a* when viewed from the axial direction of the photosensitive member 21 (i.e., the position of the knob 22*a* in the left-right direction with reference to the drawings) is considerably shifted on the left side with reference to the drawings as compared to the position of the center of gravity of the photosensitive module 20. Hence, while pulling out the photosensitive module 20 from the imaging unit 100 by holding the knob 22*a*, the photosensitive module 20 turns in the clockwise direction with reference to the drawings around the knob 22*a* and the position of the center of gravity of the photosensitive module 20 heads right below the knob 22*a*. However, many operators who hold the knob 22*a* try to pull out the photosensitive module 20 straight up. Hence, while pulling out the photosensitive module 20, at a position indicated by a letter P in FIG. 45A, the guiding target member 23*c* on the coupling member 23 of the photosensitive module 20 forcefully abuts against the guiding groove 121*c* of the imaging unit 100 thereby resulting in a large frictional force. Because of that, while pulling out the photosensitive module 20 straight up; it gets stuck against the position indicated by the letter P in FIG. 45A. Thus, as indicated by "x" in FIG. 45B, it may be difficult to smoothly pull out the photosensitive module 20.

Figure 44A:
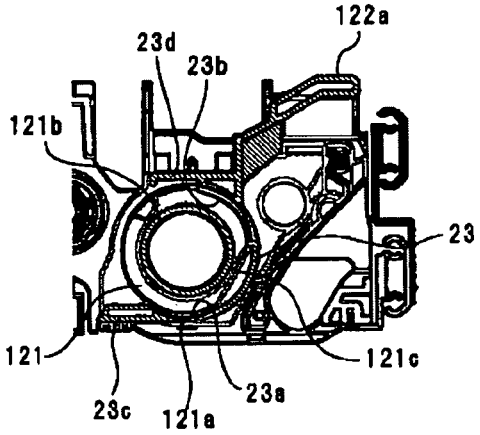
FIGS. 44A to 44D are explanatory diagrams for explaining a positional relationship, at the time of turning the photosensitive module frame from the locked state to the unlocked state, between the coupling member disposed on the front side portion of the photosensitive module and the coupling target member disposed on the imaging unit frame according to a modification example of the embodiment.
Figure 44B:
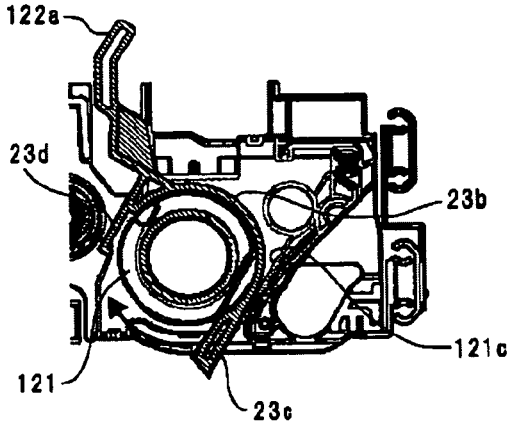
Figure 44C:
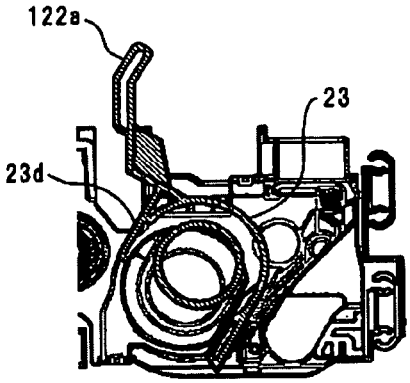
Figure 44D:
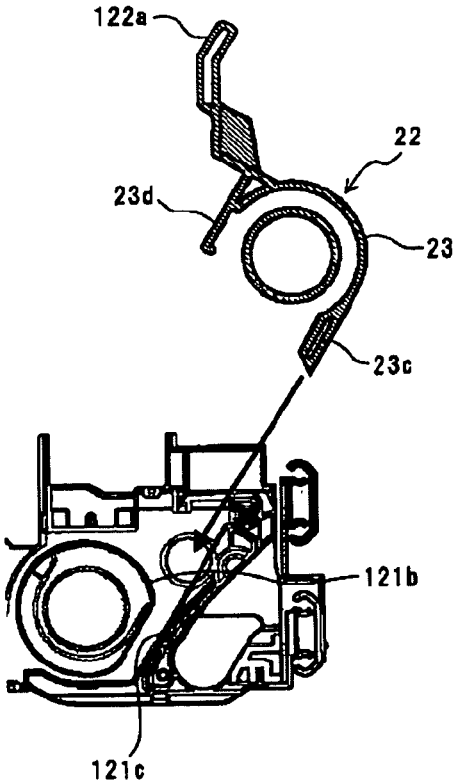
Figure 46A:
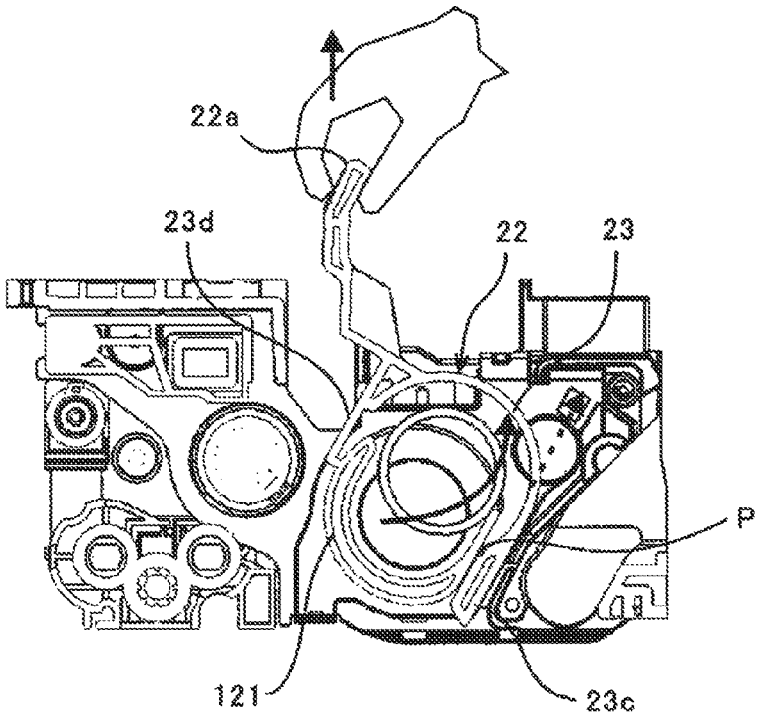
FIGS. 46A and 46B are explanatory diagrams for explaining the task of pulling out the photosensitive module according to the modification example.
Figure 46B:
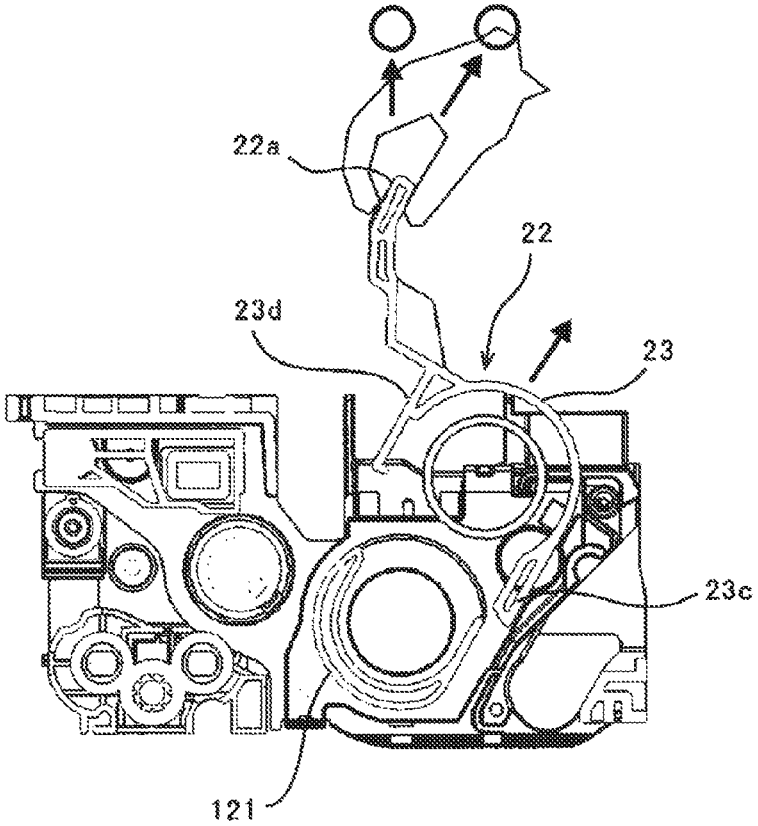

In that regard, in the present modification example, as illustrated in FIG. 44B, in the condition in which the photosensitive module frame 22 has been turned to the unlocked state, the knob 122*a* of the photosensitive module 20 is configured to extend in the right-hand direction with reference to the drawings as compared to the knob 22*a* according to the abovementioned embodiment. Consequently, in the condition in which the photosensitive module frame 22 has been turned to the unlocked state (i.e., at the time of removing the photosensitive module 20 from the imaging unit 100), the position in the horizontal direction of the knob 122*a* when viewed from the axial direction of the photosensitive member 21 (i.e., the position of the knob 122*a* in the left-right direction with reference to the drawings) is adjacent to the position of the center of gravity of the photosensitive module 20. Hence, while pulling out the photosensitive module 20 from the imaging unit 100 by holding the knob 122*a*, the photosensitive module 20 turns only by a small amount. Besides, due to the turning of the photosensitive module 20 at the position indicated by the letter P with respect to the inner wall face of the guiding groove 121*c* of the imaging unit 100, the guiding target member 23*c* abuts at a smaller abutting angle. Hence, with respect to the inner wall face of the guiding groove 121*c*, the vertical component of the abutting force, which is produced between the guiding target member 23*c* and the inner wall face of the guiding groove 121*c* due to the turning of the photosensitive module 20, is relatively smaller. As a result, in the present modification example, when an operator attempts to pull out the photosensitive module 20 straight up, as illustrated in FIG. 46A, the abutting pressure between the guiding target member 23*c* of the photosensitive module 20 and the guiding groove 121*c* of the imaging unit 100 at the position indicated by the letter P is considerably smaller as compared to the case in the abovementioned embodiment. Therefore, while pulling out the photosensitive module 20 straight up, only a small frictional force is produced between the guiding target member 23*c* of the photosensitive module 20 and the guiding groove 121*c* of the imaging unit 100 at the position indicated by the letter P. Thus, the photosensitive module 20 can be pulled out smoothly without it getting stuck.

Figure 45B:
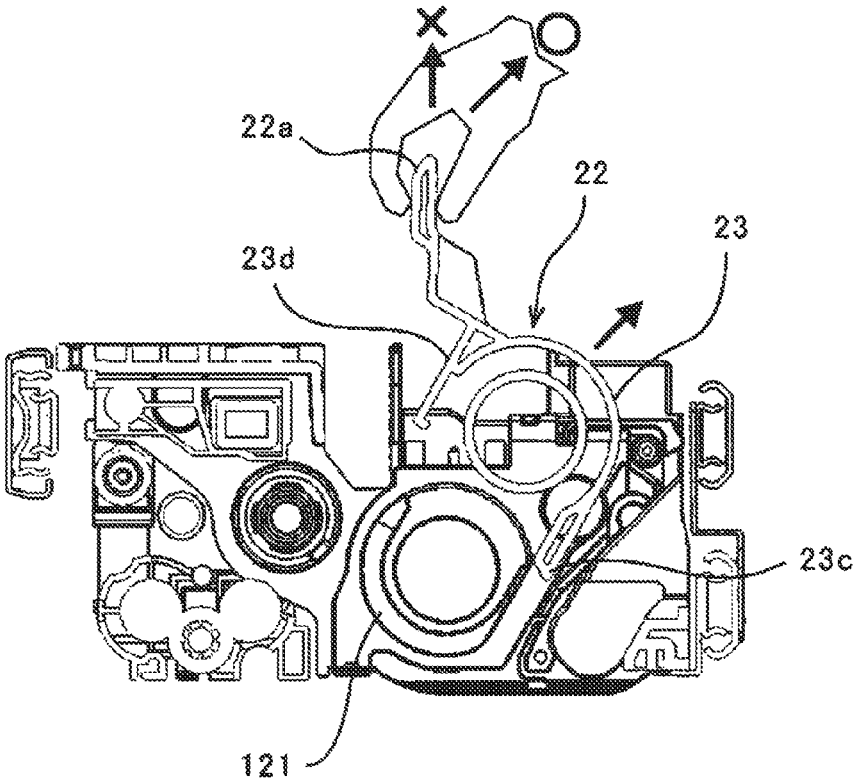

Meanwhile, in the abovementioned embodiment too, as indicated by "○" in FIG. 45B, if the photosensitive module 20 is pulled out obliquely upward so that, while preventing the photosensitive module 20 from turning in the clockwise direction with reference to FIG. 45B around the knob 22*a*, the guiding target member 23*c* of the photosensitive module 20 moves along the guiding groove 121*c* of the imaging unit 100. Then, a smaller frictional force is produced at the position indicated by the letter P in FIG. 45A. Hence, the photosensitive module 20 can be pulled out smoothly. However, in that case, while pulling out the photosensitive module 20, the operator is forced to use only the fingers that are holding the knob 22*a* to prevent the photosensitive module 20 from turning around the knob 22*a*. By taking into consideration the weight of the photosensitive member 21, it takes a good amount of power from the operator to perform that task. That may considerably affect the user-friendliness.

In contrast, according to the present modification example, a smaller amount of power is required to prevent the photosensitive module 20 from turning around the knob 122*a*. Hence, at the time of pulling out the photosensitive module 20, the photosensitive module 20 can be prevented from turning around the knob 122*a* with only a smaller amount of power at the fingers that are holding the knob 122*a*. That enables achieving enhancement in the user-friendliness.

Moreover, as illustrated in FIG. 40B, in the condition in which the photosensitive module frame 22 has rotated to the unlocked state, the knob 22*a* according to the abovementioned embodiment has the holding face thereof (i.e., the face making contact with the fingers with which the operator holds the knob 22*a*) lies parallel to the vertical plane. For that reason, the holding face of the knob 22*a* has a large angle difference with the direction (i.e., the obliquely upward direction) of pulling out the photosensitive module 20. Many operators try to pull out the photosensitive module 20 along the holding face of the knob 22*a*. Thus, as is the case in the abovementioned embodiment, if the holding face of the knob 22*a* lies parallel to the vertical plane, some operators may try to pull out the photosensitive module 20 straight up in the vertical direction that is different than the direction (i.e., the obliquely upward direction) of pulling out the photosensitive module 20. As a result, the task of pulling out the photosensitive module 20 may not be performed smoothly.

In that regard, in the present modification example, as illustrated in FIG. 44B, the knob 122*a* is configured in such a way that the holding face thereof lies substantially parallel to the direction (i.e., the obliquely upward direction) of pulling out the photosensitive module 20. Thus, if an operator attempts to pull out the photosensitive module 20 along the holding face of the knob 122*a*, the photosensitive module 20 gets pulled out in the normal direction of pulling it out. As a result, the task of pulling out the photosensitive module 20 can be performed smoothly.

In this way, according to the present modification example, irrespective of whether an operator attempts to pull out the photosensitive module 20 along the holding face in the obliquely upward direction or whether an operator attempts to pull out the photosensitive module 20 straight up regardless of the holding face, the photosensitive module 20 can be pulled out smoothly.

Given below is the explanation regarding the task of attaching the photosensitive module 20 to the imaging unit 100.

Figure 47A:
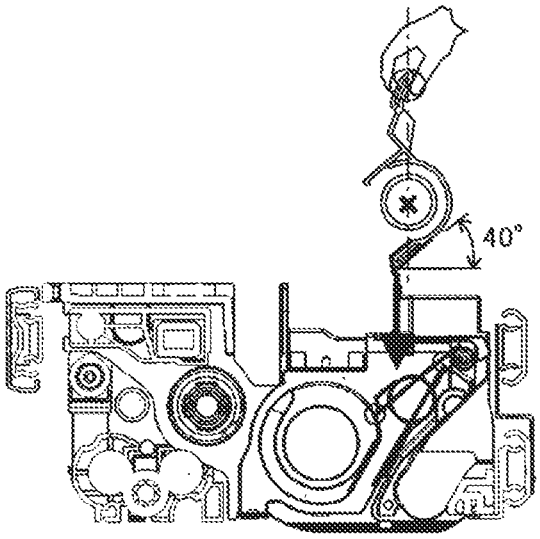
FIG. 47A is an explanatory diagram illustrating a condition in which a knob of the photosensitive module according to the embodiment is held with fingers.

FIG. 47A is an explanatory diagram illustrating a condition in which the knob 22*a* of the photosensitive module 20 according to the abovementioned embodiment is held with fingers.

Figure 47B:
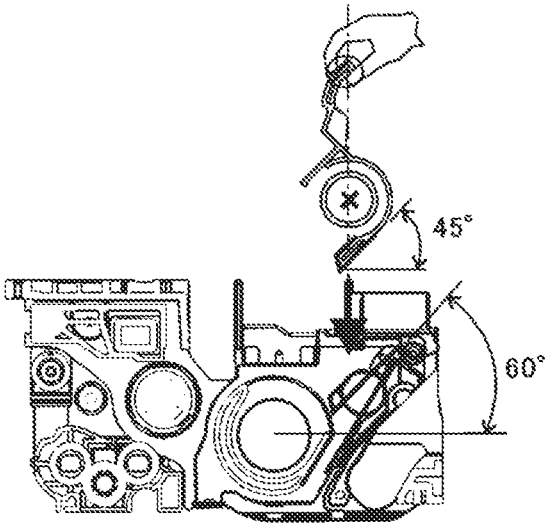
FIG. 47B is an explanatory diagram illustrating a condition in which a knob of the photosensitive module according to the modification example is held with fingers.

FIG. 47B is an explanatory diagram illustrating a condition in which the knob 122*a* of the photosensitive module 20 according to the present modification example is held with fingers.

As illustrated in the drawings, the direction in which the guiding groove 121*c* extends linearly along the normal direction of pulling out the photosensitive module 20 (i.e., along the obliquely upward direction) makes an angle of 60° with the horizontal plane. Regarding the photosensitive module 20 according to the abovementioned embodiment, when the knob 22*a* is held, the position of the center of gravity leads to the formation of an angle of 40° between the horizontal plane and a guiding target face of the guiding target member 23*c* on the coupling member 23 of the photosensitive module 20. Thus, during the attachment task, the operator has to insert the guiding target member 23*c* in the guiding groove 121*c* in such a way that the angle between the horizontal plane and the guiding target face of the guiding target member 23*c* becomes 60°. That is, in order to ensure that the angle between the horizontal plane and the guiding target face of the guiding target member 23*c* becomes 60°, the operator needs to turn the photosensitive module 20 by 20°.

In comparison, regarding the photosensitive module 20 according to the present modification example, when the knob 122*a* is held, the position of the center of gravity leads to the formation of an angle of 45° between the horizontal plane and the guiding target face of the guiding target member 23*c* on the coupling member 23 of the photosensitive module 20. Thus, in order to ensure that the angle between the horizontal plane and the guiding target face of the guiding target member 23*c* becomes 60°, the operator needs to turn the orientation of the photosensitive module 20 by 15°.

Thus, according to the present modification example, at the time of attaching the photosensitive module 20 to the imaging unit 100, the rotational orientation of the photosensitive module 20 needs to be adjusted to a smaller extent as compared to the abovementioned embodiment. Consequently, according to the present modification example, it becomes possible to smoothly attach the photosensitive module 20 to the imaging unit 100. That is because of the fact that, at the time of pulling out the photosensitive module 20, the position of the knob 122*a* in the left-right direction with reference to the drawings is adjacent to the position of the center of gravity of the photosensitive module 20. When the knob 122*a* is held, closer the angle between the horizontal plane and the guiding target face of the guiding target member 23*c* to 60°, smoother becomes the task of attaching the photosensitive module 20. Meanwhile, regarding the configuration according to the present embodiment, as long as the angle between the horizontal plane and the guiding target face is in the range from 45° to 70°, the photosensitive module 20 can be attached smoothly.

As described above, in the image forming apparatus according to the present embodiment, a toner image is formed on the surface of the photosensitive member 21 that serves as a latent image carrier of rotatory nature. Then, the toner image is transferred from the photosensitive member 21 onto the intermediate transfer belt 15 that serves as a transfer member. Once the toner image is transferred; the cleaning blade 51, which serves as a cleaning member and which abuts against the surface of the photosensitive member 21, cleans the transfer residual toner remaining on the surface of the photosensitive member 21. The image forming apparatus includes the imaging unit 100 having the common imaging unit frame 101 that integrally supports the photosensitive module 20, which serves as a latent image carrier module having the photosensitive member 21, and the cleaning module 50, which has the cleaning blade 51, as independently-replaceable replacement modules. Moreover, the image forming apparatus includes the slide rails 105 that serve as imaging unit supporting members for supporting the imaging unit 100 in a movable manner between the installation position of the imaging unit 100 inside the main body of the image forming apparatus and the exposure position at which the imaging unit 100 is exposed to the outside of the image forming apparatus. When the acute angle θ between the normal line L, which is oriented outward from the blade abutting portion F' that is the cleaning-module-facing surface portion of the photosensitive member 21 over which the cleaning blade 51 remains abutted before the separation of the surface of the photosensitive member 21 from the cleaning blade 51, and the horizontal plane K, which passes through the blade abutting portion F', is expressed as a positive value when the normal line L lies on the upper side of the horizontal plane K and expressed as a negative value when the normal line L lies on the lower side of the horizontal plane K; the imaging unit frame 101 supports the photosensitive module 20 in such a way that the photosensitive member 21 is able to rotate to a specific rotational position having the angle $\theta_1$ that is greater than the angle $\theta_0$ at the time of the separation of the surface of the photosensitive member 21 from the cleaning blade 51. Then, until the photosensitive member 21 rotates from the normal rotational position (i.e., the rotational position at the angle $\theta_0$) to the specific rotational position (i.e., the rotational position at the angle $\theta_1$), removal of the photosensitive module 20 from the imaging unit frame 101 is restricted. Once the photosensitive member 21 rotates up to the specific rotational position, removal of the photosensitive module 20 from the imaging unit frame 101 is allowed. Thus, according to the present embodiment, unless the photosensitive member 21 is rotated up to the specific rotational position (i.e., the rotational position at the angle $\theta_1$) illustrated in FIG. 39, the photosensitive module 20 cannot be removed from the imaging unit 100. Once the rotational position of the photosensitive member 21 is at the specific rotational position (i.e., the rotational position at the angle $\theta_1$), the amount of tilt of the blade abutting portion F' becomes smaller than the amount of tilt at the normal rotational position (i.e., the rotational position at the angle $\theta_0$). In other words, at the specific rotational position, the direction in which the blade abutting portion F' heads is on the upper side as compared to the normal rotational position. As a result, of the gravity acting on the attached material that is attached to the blade abutting portion F', the tangential direction component in the blade abutting portion F' or the component in the direction away from the blade abutting portion F' decreases (or becomes zero). Hence, the attached material does not get easily detached from the blade abutting portion F'. Therefore, even if there is some physical impact while removing the photosensitive module 20, the attached material can be prevented from falling down from the surface of the photosensitive member 21.

Moreover, in the present embodiment, the photosensitive module frame 22 of the photosensitive module 20 serves as a bearing member having a bearing eye on which slidably bears the joint target member 21*b*, which is a shaft member fastened to the photosensitive member 21. On the photosensitive module frame 22 is disposed the knob 22*a* that serves as a holding member for the operator to hold. In the condition in which the imaging unit 100 is positioned at the exposure position (replacement enabling position), the photosensitive module frame 22 and the photosensitive member 21 are in an integrally-rotatable coupled state. Thus, along with the rotation of the photosensitive module frame 22 around the rotary shaft of the photosensitive member 21, the photosensitive member 21 can rotate up to the specific rotational position (i.e., the rotational position at the angle $\theta_1$). When the imaging unit 100 is positioned at the installation position, an uncoupled state occurs in which the photosensitive member 21 can rotate independent of the photosensitive module frame 22. With such a simple configuration, only by holding the knob 22*a* and turning the photosensitive module frame 22, the operator can rotate the photosensitive member 21 to the specific rotational position (i.e., the rotational position at the angle $\theta_1$).

Particularly, in the present embodiment, the imaging unit is configured to be slidable along the direction of the rotary shaft of the photosensitive member 21 between the installation position and the exposure position (i.e., the replacement enabling position). In the condition in which the imaging unit 100 is positioned at the exposure position; in the photosensitive module 20, the photosensitive module frame 22 and the photosensitive member 21 are held in a coupled state by means of applying to the photosensitive member 21 a biasing force for making the leading side end face (i.e., the rear side end face) of the photosensitive member 21, which lies on the leading side (rear side) at the time of sliding the imaging unit 100 toward the installation position, abut against an opposite face of the photosensitive module frame 22 that lies opposite to the leading side end face. In the condition in which the imaging unit 100 is positioned at the installation position, the photosensitive member drive joint 223, which is formed as a coupling member on the photosensitive member drive shaft 221 in the main body of the image forming apparatus, and the joint target member 21*b*, which is formed as a coupling target member on the photosensitive member 21, get coupled from the direction of the rotary shaft of the photosensitive member 21. As a result, the photosensitive member 21 gets displaced against the abovementioned biasing force in such a way that the rear side end face of the photosensitive member 21 moves in the direction away from the opposite face of the photosensitive module frame 22. With that, the photosensitive member 21 and the photosensitive module frame 22 fall in an uncoupled state. Such a configuration can be implemented without difficulty.

Moreover, in the present embodiment, the imaging unit frame 101 of the imaging unit 100 integrally supports, as a replacement module, the charging module 30, which serves as a surface acting module including the charging roller 31 that serves as a surface acting member and which, until the photosensitive member 21 rotates up to the specific rotational position, performs a predetermined action on the surface of the photosensitive member 21 by means of making contact with the surface of the photosensitive member 21 at a location opposite to the area through which the blade abutting portion F' passes. In the present embodiment, in the condition in which the charging module 30 is attached to the imaging unit frame 101, the configuration is such that the charging module 30 is positioned on a path through which a portion of the photosensitive module frame 22 passes while the photosensitive member 21 rotates to the specific rotational position, so that the photosensitive member 21 is prevented from rotating to the specific rotational position. In case the photosensitive member 21 is allowed to rotate to the specific rotational position while the charging module 30 is positioned at the installation position thereof, then the attached material on the blade abutting portion F' gets attached to the charging module 30 during the rotation of the photosensitive member 21, thereby contaminating the charging module 30. However, in the present embodiment, the photosensitive member 21 is allowed to rotate to the specific rotational position only after the charging module 30 is removed. Hence, the attached material on the blade abutting portion F' does not get attached to the charging module 30.

Moreover, in the present embodiment, a photosensitive module lock mechanism is disposed as a module fastening unit for fastening the photosensitive module 20 to the imaging unit frame 101 when the photosensitive member 21 is positioned at the normal rotational position (i.e., the rotational position at the angle $\theta_0$). Besides, the faulty installation preventing protrusion 24 is disposed as a module installation restricting member for restricting the installation of the charging module 30 when the photosensitive member 21 is positioned at the specific rotational position (i.e., the rotational position at the angle $\theta_1$) and for releasing the restriction on the installation of the charging module 30 when the photosensitive member 21 is positioned at the normal rotational position (i.e., the rotational position at the angle $\theta_0$). Thus, in an improper installation condition in which the photosensitive module 20 is not positioned at the normal rotational position (i.e., the rotational position at the angle $\theta_0$), the charging module 30 cannot be attached to the imaging unit 100. Since it can be easily realized that the charging module 30 is not attached to the imaging unit 100, the operator does not press the imaging unit 100 to the installation position inside the main body of the image forming apparatus. That is, in an improper installation condition in which the photosensitive module 20 is not at the normal rotational position (i.e., the rotational position at the angle $\theta_0$), it becomes possible to prevent a situation in which the imaging unit 100 is pressed to the installation position inside the main body of the image forming apparatus.

Meanwhile, in the modification example, the photosensitive module 20 includes the knob 122*a* as a holding member for the operator to hold. The imaging unit frame 101 includes the guiding groove 121*c* as a guiding member that, when the operator holds the holding face of the knob 122*a* with the fingers to remove the photosensitive module 20 from the imaging unit frame 101, restricts the direction of movement of the photosensitive module 20 to a specific upward direction. At the time of removing the photosensitive module 20 from the imaging unit frame 101, the knob 122*a* is positioned in the upper portion of the photosensitive module 20, and the position in the horizontal direction of the knob 122*a* when viewed from the axial direction of the photosensitive member 21 is at or adjacent to the position of the center of gravity of the photosensitive module 20. Such a positioning enables smooth attachment and detachment of the photosensitive module 20 with respect to the imaging unit frame 101.

Moreover, in the modification example, the knob 122*a* has the holding face thereof lying substantially parallel to the normal direction of pulling out the photosensitive module 20. Thus, the operator who is holding the knob 122*a* can be prompted to pull out the photosensitive module 20 along the normal direction of pulling (i.e., along the obliquely upward direction). Hence, the task of pulling out the photosensitive module 20 can be performed smoothly.

Meanwhile, the explanation till now is given for an example in which the developing device 40 is integrally fastened to the imaging unit frame 101 of the imaging unit 100. However, that is not the only possible case. Alternatively, the developing device 40 can also be configured as a replacement module that is detachably attachable to the imaging unit 100. Still alternatively, other way round, the replacement modules according to the abovementioned embodiment, namely, the photosensitive module 20, the charging module 30, and the cleaning module 50 can be integrally fastened to the imaging unit frame 101.

Moreover, in the abovementioned embodiment, the image forming apparatus includes a plurality of imaging units 100Y, 100M, 100C, and 100K. However, the embodiment can also be implemented to an image forming apparatus including only a single imaging unit 100.

According to an aspect of the invention, unless the latent image carrier is rotated from the normal rotational position to the specific rotational position, the latent image carrier module cannot be removed from the imaging unit frame. Herein, the specific rotational position points to a rotational position at which the angle between a normal line, which is oriented outward from the cleaning-module-facing surface portion of the latent image carrier, and a horizontal plane, which passes through the origin of the normal line, becomes greater than the angle at the normal rotational position. That angle is an acute angle having a positive value when the normal line lies on the upper side of the horizontal plane and having a negative value when the normal line lies on the lower side of the horizontal plane. Thus, while viewing the latent image carrier from the direction of the rotary shaft thereof, when four quadrants are defined by means of defining a horizontal plane and a vertical plane through which passes the rotary shaft of the latent image carrier; the abovementioned angle lies in the range of 0° to +90° when the cleaning-module-facing surface portion is positioned in an upper right-hand first quadrant, lies in the range of 0° to +90° when the cleaning-module-facing surface portion is positioned in an upper left-hand second quadrant, lies in the range of 0° to −90° when the cleaning-module-facing surface portion is positioned in a lower left-hand third first quadrant, and lies in the range of 0° to −90° when the cleaning-module-facing surface portion is positioned in a lower right-hand fourth quadrant. Hence, once the latent image carrier is rotated from the normal rotational position to the specific rotational position, the amount of tilt of the cleaning-module-facing surface portion becomes smaller than the amount of tilt at the normal rotational position. In other words, at the specific rotational position, the direction in which the cleaning-module-facing surface portion heads is on the upper side as compared to the normal rotational position. As a result, of the gravity acting on the attached material that is attached to the cleaning-module-facing surface portion, the tangential direction component in the cleaning-module-facing surface portion or the component in the direction away from the cleaning-module-facing surface portion decreases. Hence, the attached material does not get easily detached from the cleaning-module-facing surface portion. Therefore, even if there is some physical impact while removing the latent image carrier, the attached material can be prevented from falling down from the surface of the latent image carrier.

Accordingly, the attached material that remains attached to a cleaning-module-facing surface portion on the surface of a latent image carrier is prevented from spilling out from the surface of the latent image carrier.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus in which image formation is performed by forming a toner image on a surface of a latent image carrier of rotatory nature and then by transferring the toner image from the latent image carrier onto a transfer member, and in which a residual transfer toner that remains on the surface of the latent image carrier after the toner image has been transferred is removed by a cleaning member abutting against the surface of the latent image carrier, the image forming apparatus comprising:

an imaging unit that includes a common imaging unit frame for integrally supporting a latent image carrier module, which has the latent image carrier, and a cleaning module, which has the cleaning member, as independently-replaceable replacement modules; and an imaging unit supporting member that supports the imaging unit in a movable manner between an installation position of the imaging unit inside a main body of the image forming apparatus and an exposure position at which the imaging unit is exposed to the outside of the image forming apparatus, wherein when an acute angle between a normal line, which is oriented outward from a cleaning-module-facing surface portion of the latent image carrier over which the cleaning member remains abutted before separation of the surface of the latent image carrier from the cleaning member, and a horizontal plane, which passes through the origin of the normal line, is expressed as a positive value when the normal line lies on the upper side of the horizontal plane and expressed as a negative value when the normal line lies on the lower side of the horizontal plane, the imaging unit frame supports the latent image carrier module in such a way that the latent image carrier is able to rotate to a specific rotational position having an angle greater than the angle at the time of the separation of the surface of the latent image carrier from the cleaning member, and until the latent image carrier rotates from a normal rotational position at the time of the separation to the specific rotational position, removal of the latent image carrier module from the imaging unit frame is restricted, and once the latent image carrier rotates up to the specific rotational position, removal of the latent image carrier module from the imaging unit frame is allowed.

2. The image forming apparatus according to claim 1, wherein the latent image carrier module includes a bearing member on which bears a shaft member fastened to the latent image carrier and includes a holding member that can be held by an operator and that is disposed on the bearing member, in a condition in which the imaging unit is positioned at the exposure position, the bearing member and the latent image carrier are in an integrally-rotatable coupled state such that, along with the rotation of the bearing member around the shaft member, the latent image carrier is able to rotate up to the specific rotational position, and in a condition in which the imaging unit is positioned at the installation position, an uncoupled state occurs in which the latent image carrier becomes able to rotate independent of the bearing member.

3. The image forming apparatus according to claim 2, wherein the imaging unit supporting member supports the imaging unit in a slidable manner along a direction of a rotary shaft of the latent image carrier between the installation position and the exposure position, in the condition in which the imaging unit is positioned at the exposure position, in the latent image carrier module, the bearing member and the latent image carrier are retained in the coupled state by means of applying to the latent image carrier a biasing force for making a leading side end face of the latent image carrier, which lies on the leading side at the time of sliding the imaging unit toward the installation position, abut against an opposite face of the bearing member that lies opposite to the leading side end face, and in the condition in which the imaging unit is positioned at the installation position, a coupling member on a photosensitive member drive shaft disposed in the main body of the image forming apparatus and a coupling target member on the latent image carrier get coupled from the direction of the rotary shaft of the latent image carrier so that the latent image carrier resists the biasing force and the rear side end face moves in a direction away from the opposite face of the bearing member, thereby resulting in the uncoupled state between the latent image carrier and the bearing member.

4. The image forming apparatus according to claim 2, wherein the imaging unit frame of the imaging unit integrally supports, as a replacement module, a surface acting module that includes a surface acting member and that, until the latent image carrier rotates up to the specific rotational position, performs an action on the surface of the latent image carrier by means of making contact with the surface of the latent image carrier at a location opposite to the area through which the cleaning-module-facing surface portion passes, and in a condition in which the surface acting module is attached to the imaging unit frame, the surface acting module is positioned on a path through which a portion of the bearing member passes while the latent image carrier rotates to the specific rotational position, so that the latent image carrier is prevented from rotating to the specific rotational position.

5. The image forming apparatus according to claim 1, further comprising:

a module fastening unit that fastens the latent image carrier module to the imaging unit frame when the latent image carrier is positioned at the normal rotational position; and a module installation restricting member that restricts the installation of the replacement modules other than the latent image carrier module when the latent image carrier is positioned at the specific rotational position and that releases the restriction on the installation of the replacement modules other than the latent image carrier module when the latent image carrier is positioned at the normal rotational position.

6. The image forming apparatus according to claim 1, wherein the latent image carrier module includes a holding member that can be held by an operator, the imaging unit frame includes a guiding member that, when the operator holds the holding member to remove the latent image carrier module from the imaging unit frame, restricts the direction of movement of the latent image carrier module to a specific upward direction, and at the time of removing the latent image carrier module from the imaging unit frame, the holding member is positioned in an upper portion of the latent image carrier module, and a position in the horizontal direction of the holding member when viewed from an axial direction of the latent image carrier is at or adjacent to a position of the center of gravity of the latent image carrier module.

7. The image forming apparatus according to claim 1, wherein the latent image carrier module includes a holding member that can be held by an operator with fingers, the imaging unit frame includes a guiding member that, when the operator holds a holding face of the holding member with fingers to remove the latent image carrier module from the imaging unit frame, restricts a direction of movement of the latent image carrier module to a specific upward direction, and at the time of removing the latent image carrier module from the imaging unit frame, the holding member is positioned in an upper portion of the latent image carrier module, and has the holding face thereof lying substantially parallel to the specific upward direction.

* * * * *